US009539460B2

(12) United States Patent
Ellis

(10) Patent No.: US 9,539,460 B2
(45) Date of Patent: Jan. 10, 2017

(54) WEIGHT TRAINING MACHINES

(76) Inventor: Joseph K. Ellis, Ocala, FL (US)

( * ) Notice: Subject to any disclaimer, the term of this patent is extended or adjusted under 35 U.S.C. 154(b) by 321 days.

(21) Appl. No.: 13/992,744

(22) PCT Filed: Dec. 19, 2011

(86) PCT No.: PCT/US2011/065738
§ 371 (c)(1),
(2), (4) Date: Jul. 13, 2013

(87) PCT Pub. No.: WO2012/087878
PCT Pub. Date: Jun. 28, 2012

(65) Prior Publication Data

US 2013/0324374 A1 Dec. 5, 2013

Related U.S. Application Data

(63) Continuation of application No. 13/179,487, filed on Jul. 9, 2011, now Pat. No. 8,388,504, which is a
(Continued)

(51) Int. Cl.
*A63B 21/00* (2006.01)
*A63B 21/06* (2006.01)
(Continued)

(52) U.S. Cl.
CPC ..... *A63B 21/0618* (2013.01); *A63B 21/00181* (2013.01); *A63B 21/068* (2013.01);
(Continued)

(58) Field of Classification Search
CPC ..... A63B 21/00
(Continued)

(56) References Cited

U.S. PATENT DOCUMENTS 3,859,873 A * 1/1975 Miyauchi et al. ..... 477/117
4,149,714 A 4/1979 Lambert, Jr.
(Continued)

*Primary Examiner* — Jerome W Donnelly
(74) *Attorney, Agent, or Firm* — Laurence P. Colton; Smith Tempel Blaha LLC

(57) ABSTRACT

A weight training machine for allowing at least two of a user's muscle groups to push or pull simultaneously in a synchronized and unified fashion, having at least one common counter or weight resistance mechanism; a first actuating means operatively connected to the at least one common counter or weight resistance mechanism for allowing actuation of the at least one common counter or weight resistance mechanism by a first of the user's muscle groups, and a second actuating means operatively connected to the at least one common counter or weight resistance mechanism for allowing actuation of the at least one common counter or weight resistance mechanism by a second of the user's muscle groups, wherein actuation of both the first actuating means and the second actuation means simultaneously acts upon and or resists against the at least one common counter or weight resistance mechanism. One embodiment is an exercise machine and a drive or actuating mechanism with a lever and fulcrum configuration. The fulcrum has an attached handle, arm, lever or platform means, bearings for operatively cooperating with an axle and/or the lever, and attachment means for additional actuating member or members being operatively connected to the axle. The lever has a means for contact with the user and a weight means for providing a counterweight to the weight of the user, as well as attachment means for operatively connecting with the fulcrum and/or axle. The actuating member or members are attached to the fulcrum, preferably pivotally, and comprise linkages to the axle and/or lever so as to be able to transfer force from the user to the lever. Other embodiments include weight training machines having a moment arm weight, weight stack, or weight plate weight
(Continued)

resistance mechanism for creating a weight resistance or weight load.

31 Claims, 63 Drawing Sheets

Related U.S. Application Data continuation-in-part of application No. 11/828,454, filed on Jul. 26, 2007, now Pat. No. 7,976,441.

(60) Provisional application No. 61/424,915, filed on Dec. 20, 2010.

(51) Int. Cl.

| | |
|---|---|
| ***A63B 21/068*** | (2006.01) |
| ***A63B 21/072*** | (2006.01) |
| ***A63B 21/075*** | (2006.01) |
| ***A63B 21/078*** | (2006.01) |
| ***A63B 23/04*** | (2006.01) |
| ***A63B 23/12*** | (2006.01) |
| *A63B 21/062* | (2006.01) |
| *A63B 23/035* | (2006.01) |
| *A63B 22/00* | (2006.01) |
| *A63B 21/16* | (2006.01) |

(52) U.S. Cl.

CPC ..... *A63B 21/0615* (2013.01); *A63B 21/075* (2013.01); *A63B 21/078* (2013.01); *A63B 21/0728* (2013.01); *A63B 21/1461* (2013.01); *A63B 21/1465* (2013.01); *A63B 21/1484* (2013.01); *A63B 21/1492* (2013.01); *A63B 21/155* (2013.01); *A63B 23/03575* (2013.01); *A63B 23/0405* (2013.01); *A63B 23/0494* (2013.01); *A63B 23/1209* (2013.01); *A63B 21/062* (2013.01); *A63B 21/154* (2013.01); *A63B 23/03525* (2013.01); *A63B 23/1263* (2013.01); *A63B 2021/0616* (2013.01); *A63B 2021/1609* (2013.01); *A63B 2022/0094* (2013.01); *A63B 2023/0411* (2013.01); *A63B 2208/0204* (2013.01); *A63B 2208/0228* (2013.01); *A63B 2220/17* (2013.01)

(58) Field of Classification Search

USPC ..... 482/72, 104, 97, 10, 99, 93

See application file for complete search history.

(56) References Cited

U.S. PATENT DOCUMENTS

| | | | | |
|---|---|---|---|---|
| 4,257,593 | A | 3/1981 | Keiser | |
| 4,645,197 | A * | 2/1987 | McFee | 482/31 |
| 4,828,254 | A | 5/1989 | Maag | |
| 5,106,080 | A | 4/1992 | Jones | |
| 5,125,881 | A | 6/1992 | Jones | |
| 5,135,449 | A | 8/1992 | Jones | |
| 5,358,462 | A | 10/1994 | Calderone | |
| 5,366,432 | A | 11/1994 | Habing | |
| 5,437,589 | A | 8/1995 | Habing | |
| 5,484,365 | A | 1/1996 | Jones | |
| 5,554,084 | A | 9/1996 | Jones | |
| 5,554,086 | A | 9/1996 | Habing | |
| 5,554,089 | A | 9/1996 | Jones | |
| 5,554,090 | A | 9/1996 | Jones | |
| 5,616,107 | A | 4/1997 | Simonson | |
| 5,620,402 | A | 4/1997 | Simonson | |
| 5,643,152 | A | 7/1997 | Simonson | |
| 5,776,039 | A * | 7/1998 | Perez, Jr. | 482/97 |
| 5,795,270 | A | 8/1998 | Woods | |
| 5,997,447 | A | 12/1999 | Giannelli | |
| 6,010,437 | A | 1/2000 | Jones | |
| 6,264,588 | B1 | 7/2001 | Ellis | |
| 6,287,241 | B1 | 9/2001 | Ellis | |
| 7,029,426 | B1 * | 4/2006 | Fuller, Sr. | 482/97 |
| 2004/0166993 | A1 | 8/2004 | Tiberio | |
| 2005/0233874 | A1 | 10/2005 | Bucay-Bissu | |
| 2006/0105889 | A1 | 5/2006 | Webb | |
| 2007/0054787 | A1 | 3/2007 | Simmons | |

* cited by examiner

WEIGHT TRAINING MACHINES

STATEMENT OF RELATED APPLICATIONS

This application is the PCT Chapter II National Phase of International Application No. PCT/US2011/065738 having an international filing date of 19 Dec. 2011 and a priority date of 20 Dec. 2010, which claims the benefit of U.S. Provisional Patent Application No. 61/242,915 having a filing date of 20 Dec. 2010, and which also claims the benefit of U.S. patent application Ser. No. 13/179,487 having a filing date of 9 Jul. 2011, which claims the benefit of U.S. patent application Ser. No. 11/828,454 having a filing date of 26 Jul. 2007.

BACKGROUND OF THE INVENTION

1. Technical Field

This invention relates to the general technical field of exercise, physical fitness and physical therapy equipment and machines. This invention relates more specifically to the field of exercise equipment for the combined exercising of two muscle groups, simultaneously in a synchronized and unified manner. This invention also relates to the field of exercise equipment for the elderly, for the handicapped, and for the infirm. This invention relates to the field of weight resistance mechanisms to generate weight resistance for such weight training equipment and machines.

2. Prior Art

Exercise, physical fitness and physical therapy equipment and machines are available in various configurations and for various purposes, and are available for all of the major muscle groups. The majority of such equipment and machines, especially in the exercise field, concentrate either on an aerobic or anaerobic workout or on areas of the body such as the legs, the hips and lower torso, the chest and upper torso, the back, the shoulders and the arms. The individual operations of these machines generally concentrates on a single muscle group such as biceps, pectorals, quadriceps and so forth. Other equipment and machines are designed to aid the user in the exercise regimen, such as to aid the elderly, handicapped, and/or infirm in an appropriate exercise regimen. There are numerous examples each of these different types of exercise equipment and machines.

Generally, such equipment and machines can be categorized into three broad categories: free weights, mechanically operated single action resistance machines, and electrically operated resistance machines. Mechanically operated single action resistance machines can be subcategorized into three broad categories: stack weight resistance operated, free weight resistance operated, and alternative resistance operated. Mechanically operated single action resistance machines are available for exercising, strengthening and rehabilitating various individual muscles, muscle groups, combinations of muscle groups, joints, and other parts of the body.

There are physical fitness and physical therapy equipment and machines having alternative weight resistance devices. One example is disclosed in US Patent Publication No. 20060105889 to Webb and assigned to Nautilus, Inc., which discloses an exercise machine having a rotatable weight selection index that is rotated to operably couple the exercise member to at least one weight plate such that the displacement of the exercise member causes the displacement of the weight plate. This device has a plurality of weight plates and the index allows the selection of different combinations of weight plates for operable coupling to the exercise member.

Other examples are the BOWFLEX® brand line of products offered by Nautilus, Inc., which incorporate flexible rods and spiral devices to produce a weight resistance.

U.S. Pat. No. 4,257,593 to Keiser discloses a pneumatic exercising device including a source of gas and a pneumatic resisting mechanism connected to the source of gas and operable to compress gas received from the source to provide a resistance to movement. In other words, this device uses a pneumatic weight resistance mechanism.

Other alternative weight resistance mechanisms include hydraulic cylinders and electromagnetic devices. Several examples of such mechanisms are shown on a brochure put out by the American College of Sports Medicine entitled Selectively and Effectively Using Home Weights.

This inventor previously has developed a composite motion movement machine for use in connection with exercise and physical therapy equipment. U.S. Pat. No. 6,264,588 discloses this composite motion movement machine, which combines a moving actuating member and a moving user support, the composite motion movement machine having a support member, a frame on which the user support is located, the frame being pivotally connected to the support member, a truck in slidable engagement with the support member and the frame, an actuating member being pivotally connected to the support member and operatively connected to the truck, the actuating member being adapted to move between a first position and a second position, and a linking mechanism operatively connecting said actuating member with said truck, wherein, when the user moves the actuating member between the first position and the second position, the truck moves along rails on the support member, forcing the frame to pivot relative to the support member and causing the user to actuate a resistance weight, thus exercising, strengthening or rehabilitating certain of the user's muscles. This machine can be used in connection with a variety of different weight resistance mechanism, such as stack weights, free weights, and alternative weight resistance devices.

U.S. Pat. No. 6,287,241 discloses this inventor's improvement on leg press exercise apparatuses by utilizing composite motion movement combined with a moving actuating member and a moving user support, the leg press having a support member, a frame on which the user support is located, the frame being pivotally connected to the support member, a truck in slidable engagement with the support member and the frame, an actuating member on which a push plate is located, the actuating member being pivotally connected to the support member and operatively connected to the truck, the actuating member being adapted to move between a first position and a second position, and a linking mechanism operatively connecting the actuating member the truck, wherein, when the user pushes the actuating member between the first position and the second position, the truck moves along rails on the support member, forcing the frame to pivot relative to the support member and causing the user to actuate a resistance weight, thus exercising certain of the user's muscles. This machine can be used in connection with a variety of different weight resistance mechanism, such as stack weights, free weights, and alternative weight resistance devices.

There are many other examples of leg exercise machines. U.S. Pat. No. 4,149,714 to Lambert, Jr. discloses a seated weight lifting leg press exercise machine having a moving push plate and a stationary seat. U.S. Pat. No. 4,828,254 to Maag discloses a crank and slider/four-bar variable resistance carriage-type leg press machine having a stationary push plate and a moving seat. U.S. Pat. No. 5,106,080 to Jones discloses a leg press exercise machine having a stationary seat and two moving push plates, one for each leg. U.S. Pat. No. 5,366,432 to Habing et al. discloses a leg press having a stationary seat and a moving push plate. U.S. Pat. No. 5,484,365 to Jones et al. discloses a leg press exercise machine having a stationary seat and a moving push plate. U.S. Pat. No. 5,554,086 to Habing et al. discloses a leg press exercise apparatus having a stationary push plate and a moving seat. U.S. Pat. No. 5,554,090 to Jones discloses a calf exercise machine having a stationary seat and a moving push plate. U.S. Pat. No. 5,616,107 to Simonson discloses a method and apparatus for leg press exercise with counterbalance having a stationary seat and a moving push plate. U.S. Pat. No. 5,795,270 to Woods et al. discloses a semi-recumbent arm and leg press and aerobic exercise apparatus having a stationary seat and a moving push plate.

There are many examples of chest exercise machines. U.S. Pat. No. 5,554,089 to Jones discloses a military press exercise machine having a stationary seat and moving actuating grips. U.S. Pat. No. 5,643,152 to Simonson discloses a chest press exercise machine and method of exercising having a stationary seat and moving actuator grips. U.S. Pat. No. 5,997,447 to Giannelli et al. discloses a chest press apparatus for exercising regions of the upper body having a stationary seat and moving actuator grips.

There are many examples of back exercise machines. U.S. Pat. No. 5,135,449 to Jones discloses a rowing exercise machine having a stationary seat and moving actuating grips. U.S. Pat. No. 5,620,402 to Simonson discloses a rear deltoid and rowing exercise machine and method of exercising having a stationary seat and moving actuator grips.

There are other machines for exercising other parts of the torso, such as the abdominal muscles, or combinations of muscles. U.S. Pat. No. 5,125,881 to Jones discloses a rear shoulder exercise machine having a stationary bench and moving actuating pads. U.S. Pat. No. 5,554,084 to Jones discloses an abdominal/hip flex exercise machine having a stationary seat and moving actuator pads. U.S. Pat. No. 6,010,437 to Jones discloses a standing push/pull exercise machine having no user support and moving actuator grips.

The previously described art comprises a general cross-section of the exercise and physical therapy equipment and machine art as it is today. As can be seen, individual apparatuses either use weight plates, weight stacks, free weights, user body weight, tensile resistance, or air resistance, or a combination of weight stacks or free weights with the user's body weight. Thus it can be seen that a moment arm weight resistance mechanism and a weight training machine comprising a moment arm weight resistance mechanism would be useful, novel and not obvious, and a significant improvement over the prior art. Such a mechanism can be used as the basic operative mechanism on a wide variety of weight training equipment and machines. It is to such a moment arm weight resistance mechanism and weight training equipment and machines that the current invention is directed.

BRIEF SUMMARY OF THE INVENTION

Briefly, the invention is a weight training machine for allowing at least two of a user's muscle groups, such as, for example but not limited to, shoulders deltoids, shoulders trapezius, back lattisimus dorsi, back rhomboidious, back spina erectile, arm triceps, arm biceps, arms forearms, legs quadriceps, legs hamstrings, legs calfs, abdominals, gluteus maximus, to push or pull simultaneously in a synchronized and unified fashion, having at least one common counter or weight resistance mechanism, a first actuating means operatively connected to the at least one common counter or weight resistance mechanism for allowing actuation of the at least one common counter or weight resistance mechanism by one of the user's muscle groups, and a second actuating means operatively connected to the at least one common counter or weight resistance mechanism for allowing actuation of the at least one common counter or weight resistance mechanism by another of the user's muscle groups, wherein actuation of both the first actuating means and the second actuation means simultaneously acts upon and or resists against the at least one common counter or resistance weight or mechanism.

One embodiment of the present invention is an exercise machine and a drive or actuation mechanism with a lever and fulcrum configuration. The fulcrum has an attached handle, arm, lever or platform means, bearings for operatively cooperating with an axle and/or the lever, and attachment means for additional actuating member or members being operatively connected to the axle. The lever has a means for contact with the user and a weight means for providing a counterweight to the weight of the user, as well as attachment means for operatively connecting with the fulcrum and/or axle. The actuating member or members are attached to the fulcrum, preferably pivotally, and comprise linkages to the axle and/or lever so as to be able to transfer force from the user to the lever. Another embodiment is a weight training machine having a moment arm weight resistance mechanism for creating a weight resistance or weight load. Another embodiment is a weight training machine having a weight stack weight resistance mechanism for creating a weight resistance or weight load. Another embodiment is a weight training machine using weight plates as the weight resistance mechanism for creating a weight resistance or weight load.

A specific embodiment of the present invention is an exercise machine for an inverted squat exercise. In the typical or common squat exercise, the user while in a standing position places weight or resistance on their shoulders and upper back. This is typically with a bar loaded with weights or with a machine that has padded arms connected to a resistance device. The user then lowers the weight until they are in some degree of a squatted position. The user then lifts the weight or resistance by returning to a standing position. Squat exercises primarily are for exercising the gluteus maximus and leg muscles. The present invention is an assisted inverted squat exercise device in that it allows the user to use their lower body muscles to assist in pressing against resistance in a mostly downward motion while simultaneously pressing against the same common resistance in a mostly forward motion with the user's upper body. Therefore the user is ultimately using most of their entire skeletal musculature to move the resistance. If the amount of resistance is less than the user's body weight, the user can use their upper body to pull against the common resistance to assist their lower body in returning to the standing position.

The invention generally comprises a lever and fulcrum configuration. The fulcrum comprises a support base or means, bearings for operatively cooperating with an axle and/or the lever, and attachment means for handles, the handles being operatively connected to the axle. The lever comprises a gluteus maximus pad (a glute pad) for the user to press down upon and a weight means for providing a counterweight to the weight of the user, as well as attachment means for operatively connecting with the fulcrum and/or axle. The handles are attached to the fulcrum, preferably pivotally, and comprise linkages to the axle and/or lever so as to be able to transfer force from the user to the lever.

In operation, the user sits or leans on the seat means, also referred to as the glute pad, and grasps the handles, and conducts squat exercises. By manipulating the handles, the user can keep the glute pad pressed against or proximal to the user's gluteus maximus muscles, thus allowing the user to use his or her upper body strength to assist in both squatting down and rising up from the squat. Counterweights can be placed on the lever, typically on an end of the lever opposite from the glute pad, to provide weighted assistance to the user for returning to the standing position after the user has applied force to the glute pad to get into the squatting position. Springs, pistons or the like can be substituted for the counterweights. Thus, the user can use both upper body strength and/or counterweights to assist in the squat exercise regimen. Thus, the user can use both the entire upper body and the glutes and leg muscles to raise the counterweight when the user pushes down with the glute pad and pushes out with the handles. Then if the counter weight is less than the user's body weight, the user can use his or her upper body strength to assist the user in returning to the standing position. Generally, at the beginning of the exercise the user is leaning against or touching the glute pad; however, the user is standing and supporting his or her own body weight.

Each of the components is or can be adjustable so as to provide a comfortable and appropriate exercise regimen.

These features, and other features and advantages of the present invention will become more apparent to those of ordinary skill in the art when the following detailed description of the preferred embodiments is read in conjunction with the appended figures.

More general embodiments of the present invention include various weight resistance mechanisms, including a moment arm weight resistance mechanism, conventional weight plates as the weight resistance mechanism, and conventional weight stacks as the weight resistance mechanism, to generate weight resistance for weight training equipment and machines. A first embodiment of the moment arm weight resistance mechanism comprises a cam, a moment arm, an actuating means, an adjustable weight, a weight adjusting drive, a pivot point about which the moment arm pivots, and a weight adjusting motor for moving the weight along the moment arm. A second embodiment of the moment arm weight resistance mechanism comprises a moment arm, an actuating means, an adjustable weight, a weight adjusting drive, a pivot point about which the moment arm pivots, and a weight adjusting motor for moving the weight along the moment arm. A third embodiment of the moment arm weight resistance mechanism comprises a linkage, such as a pivoting bar linkage, a moment arm, an actuating means, an adjustable weight, a weight adjusting drive, a pivot point about which the moment arm pivots, and a weight adjusting motor for moving the weight along the moment arm. A fourth embodiment of the moment arm weight resistance mechanism comprises a moment arm, an actuating means, a direct connection between the moment arm and an actuating means, an adjustable weight, a weight adjusting drive, a pivot point about which the moment arm pivots, and a weight adjusting motor for moving the weight along the moment arm. The moment arm is pivotally secured about the pivot point, about which the moment is created, and extends generally normal to the pivot axis of the pivot point. Thus, the moment arm acts as a cantilever extending from the pivot point, and the moment arm can rotate about the pivot axis of the pivot point. The moment creates a weight resistance that can be utilized in weight training machines as an alternative.

In one embodiment of the moment arm, the moment arm is a generally hollow, elongated, box-like structure containing the weight and the weight adjusting drive. The weight adjusting motor also can be within the moment arm, but also can be located outside of the box-like structure with the weight adjusting drive extending from the weight adjusting motor through a hole in an end of, and into the interior of, the box-like structure of the moment arm. In another embodiment of the moment arm, the moment arm is a generally solid, elongated structure supporting the weight and the weight adjusting drive. The weight adjusting motor also can be supported on, by or proximal to the solid structure. The moment arm can be secured to the moment arm pivot rod by any known or suitable means. The pivot rod is an attachment means for pivotally and operatively attaching the moment arm to a weight training machine. The weight adjusting drive cooperates with the weight such that when the weight adjusting drive is activated, the weight will move relatively along the weight adjusting drive and the moment arm, thus adjusting the level of weight resistance.

The moment arm weight resistance mechanism can be pivotally attached to the weight training machine such that when activated, the moment arm can pivot or swing upwards and downwards without any or undue hindrance by any components of the weight training machine. The pivot rod can be pivotally mounted on the frame of the weight training machine. A cable or other linkage can be attached to an actuating device, such as a hand grip or leg pad, and can travel through or about the frame via pulleys, ultimately to the moment arm weight resistance mechanism. The user sits or stands on, or otherwise operates, the weight training machine in the known manner, with the user's hand or legs contacting the actuating means. When the user actuates the actuating device or means, such as by pulling down on a hand grip or bar, by moving a hand bar or leg bar, or by using his or her legs to move a leg pad, the cable is pulled or the linkage is acted on. By moving the actuating device or means, the user causes the upward and downward pivoting of the moment arm, and obtains a weight resistance workout.

In an embodiment of the invention, the cable cooperates with the cam proximal to the pivot point of the moment arm, and when the cable is pulled, the pulling has the ultimate result of pulling upwards on the cam, thus rotating the cam. As the cam is attached to the moment arm, the moment arm also is rotated upwards, causing the moment about the pivot point and the weight resistance against the cable. In another embodiment of the invention, the cable cooperates with an attachment means distal from the pivot point of the moment arm, and when the cable is pulled, the pulling has the ultimate result of pulling upwards on the moment arm on an end of the moment arm opposite the pivot point. As the cable is attached to the moment arm, the moment arm is rotated upwards, causing the moment about the pivot point and the weight resistance against the cable.

In another embodiment of the invention, a bar linkage cooperates with the moment arm proximal to the pivot point of the moment arm, and when the bar linkage is acted on, as the bar linkage is attached to the moment arm, the moment arm also is rotated upwards, causing the moment about the pivot point and the weight resistance against the bar linkage. In another embodiment of the invention, a bar linkage cooperates with the weight resistance mechanism, and when the bar linkage is acted on, as the bar linkage is attached to the weight resistance mechanism, weight is lifted, weight resistance against the bar linkage. In another embodiment of the invention, the actuating means is directly connected to the moment arm or other weight resistance means in a lever-type manner, such that when the actuating means is moved, due to the direct connection to the moment arm, the moment arm or other weight resistance means also moves.

In another embodiment of the invention, two actuating means, one for a first muscle group and one for a second muscle group, are connected to the moment arm or other weight resistance means in a lever-type manner, such that when the actuating means is moved, due to the direct connection to the moment arm or other weight resistance means, the moment arm or other weight resistance means also moves. In one embodiment, one of the first or second muscle groups can be an upper body muscle group and the other of the first or second muscle groups can be a lower body muscle group. In another embodiment of the invention, the cable cooperates with other types of weight resistance means, such as the weight plates or weight stacks, and when the cable is pulled, the pulling has the ultimate result of pulling upwards on the weight plates or weight stack, causing weight resistance against the cable. In another embodiment of the invention, the actuating means is directly connected to the weight plates or weight stack in a lever-type manner, such that when the actuating means is moved, due to the direct connection to the weight plates or weight stack, the weight plates or weights in the weight stack are lifted.

The degree of weight resistance of the weight resistance mechanism can be controlled by the user. For example, as the adjustable weight is adjusted along the moment arm relative to a pivot point of the moment arm, the weight resistance of the moment arm is increased or decreased. Weight plates and weight stacks are manipulated in a conventional manner, and the weight resistance means can be adjusted while the actuating means is in motion such that the user can adjust the weight while exercising.

These features, and other features and advantages of the present invention will become more apparent to those of ordinary skill in the art when the following detailed description of the preferred embodiments is read in conjunction with the appended figures in which like reference numerals designate like elements throughout the several views.

DETAILED DESCRIPTION OF PREFERRED EMBODIMENTS

Figure 1:
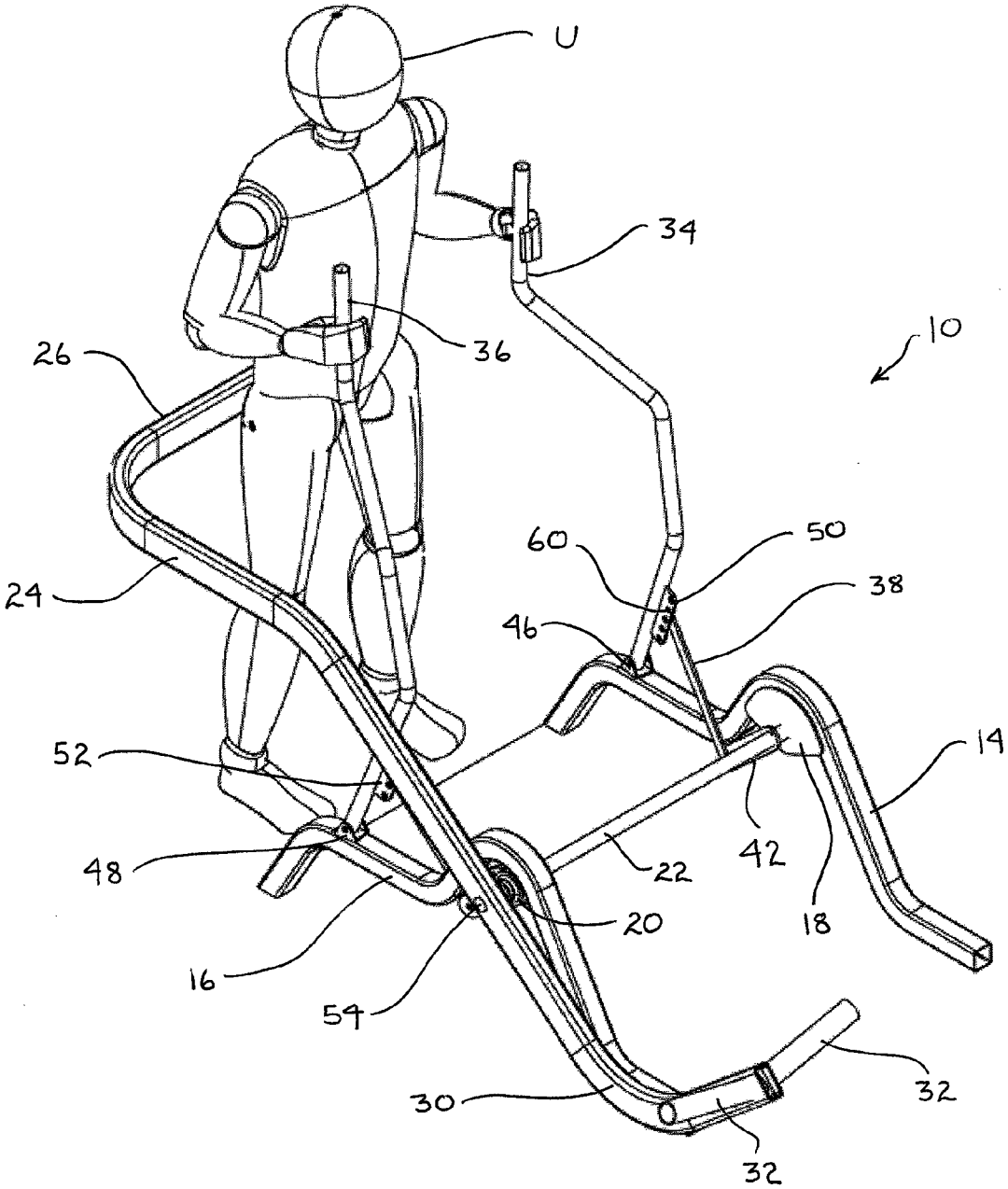
FIG. 1 is a schematic perspective view of an embodiment of the invention showing a user in the standing position.

Exemplary preferred embodiments are disclosed below in connection with the attached drawings. Throughout this specification, various terms will be used to describe various elements or sets of elements, features or sets of features, and devices or sets of devices. For example, the term weight training machine will be used to describe any weight training machine in which a user pulls, pushes, squeezes, twists, or otherwise moves or manipulates an actuating means or device to activate weight resistance. The term actuating means or actuating device will be used to describe any bar, handle, pad, platform, or other element that is operatively connected to the moment arm weight resistance mechanism. The term at rest and resting mode will be used to describe when the user is not engaging the moment arm weight resistance mechanism, or only minimally so. The term operating and operating mode will be used to describe when the user is engaging the moment arm weight resistance mechanism. The term pull, when referring to the user operating the actuating means or device, will be used to describe any motion or movement by a user on the actuating means or device to activate weight resistance, including but not limited to pulling, pushing, squeezing, twisting, and rotating.

FIGS. 1 through 9 illustrate a first embodiment of the invention. The device 10 comprises a fulcrum 12 comprising base legs 14, 16, bearings 18, 20, and axle 22. Base legs 14, 16 can be structurally connected to each other with connecting bars (not shown in the schematic figures, but see FIGS. 24 through 32). The device 10 additionally comprises a lever 24 comprising seat arm 26, glute pad 28, counterweight arm 30 and weight supports 32. The device 10 further comprises handles 34, 36 comprising connecting linkages 38, 40, 42, 44. Handles 34, 36 can be attached to fulcrum 12 via connectors such as pivotal connectors 46, 48. Adjustment means 50, 52 can be included such that handles 34, 36 can be adjusted to the comfort of the user U. Additional adjustment means (not shown) can be included for adjusting glute pad 28 and lever also for the comfort of user U.

Base legs 14, 16 can be any shape so long as they act as a fulcrum and can support either axle 22 or an equivalent means for operatively supporting lever 24. A simple suitable shape is an inverted U or V. As shown, base legs 14, 16 have a more specialized shape for providing support to the device 10 and for providing surfaces and structures for operatively attaching lever 24 and handles 34, 36 to base legs 14, 16. Bearings 18, 20 are attached to base legs 14, 16 at suitable locations, which are generally towards the middle of base legs 14, 16. Axle 22 extends between bearings 18, 20 and one connecting end 54 of axle 22 can extend though one of the bearings 20. Axle 22 is rotatable within bearings.

Lever 24 can be any shape so long as it provides locations for glute pad 28 and counterweight means, which can be counterweights 56, springs 58, or the like. A simple suitable shape is a straight bar. As shown, lever 24 has a more specialized shape for providing seat arm 26 extending behind user U for supporting glute pad 28, and for providing counterweight arm 30 for supporting weight supports 32 and counterweights 56. Lever 24 can be connected to connecting end 54 of axle 22, preferably rigidly such that lever 24 and axle 22 move together. In alternate embodiments, axle 22 can be rigidly connected to base legs 14, 16 without bearings 18, and lever 24 can be rotatably connected to axle 22 via a separate bearing. Lever 24 rotates with axle 22 relative to fulcrum 12 with glute pad 28 moving upwards and downwards and weight supports 32 moving downwards and upwards, respectively.

Handles 34, 36 can be any shape so long as they provide a suitable hand grip for user U, are operatively connected to axle 22 and/or lever 24, and can transfer force from user U to lever 24. A simple suitable shape is a straight rod. As shown, handles 34, 36 have a more specialized shape for providing suitable clearance for the knees of the user U and ease of entry and exit to the device 10. Handles 34, 36 are pivotally connected to base legs 14, 16 via pivotal connectors 46, 48 such that handles 34, 36 can be rotated forwards and backwards relative to user U. Handles 34, 36 also are connected to axle 22 via connecting linkages 38, 40, 42, 44 such that when, for example, handles 34, 36 are pulled by the user U towards the user U connecting linkages 38, 40, 42, 44 cause axle 22 to rotate in a direction that causes lever 24 to rotate such that glute pad 28 moves upwards. Thus, when the user U and the lever 24 are in the squatting position, by pulling on handles 34, 36 user U can provide upper body strength assistance in standing up from the squatting position.

FIG. 1 is a schematic perspective view of an embodiment of the invention showing a user in the standing position. As can be seen, the user U is standing with his or her gluteus maximus proximal to glute pad 28 and his or her hands grasping handles 34, 36.

Figure 2:
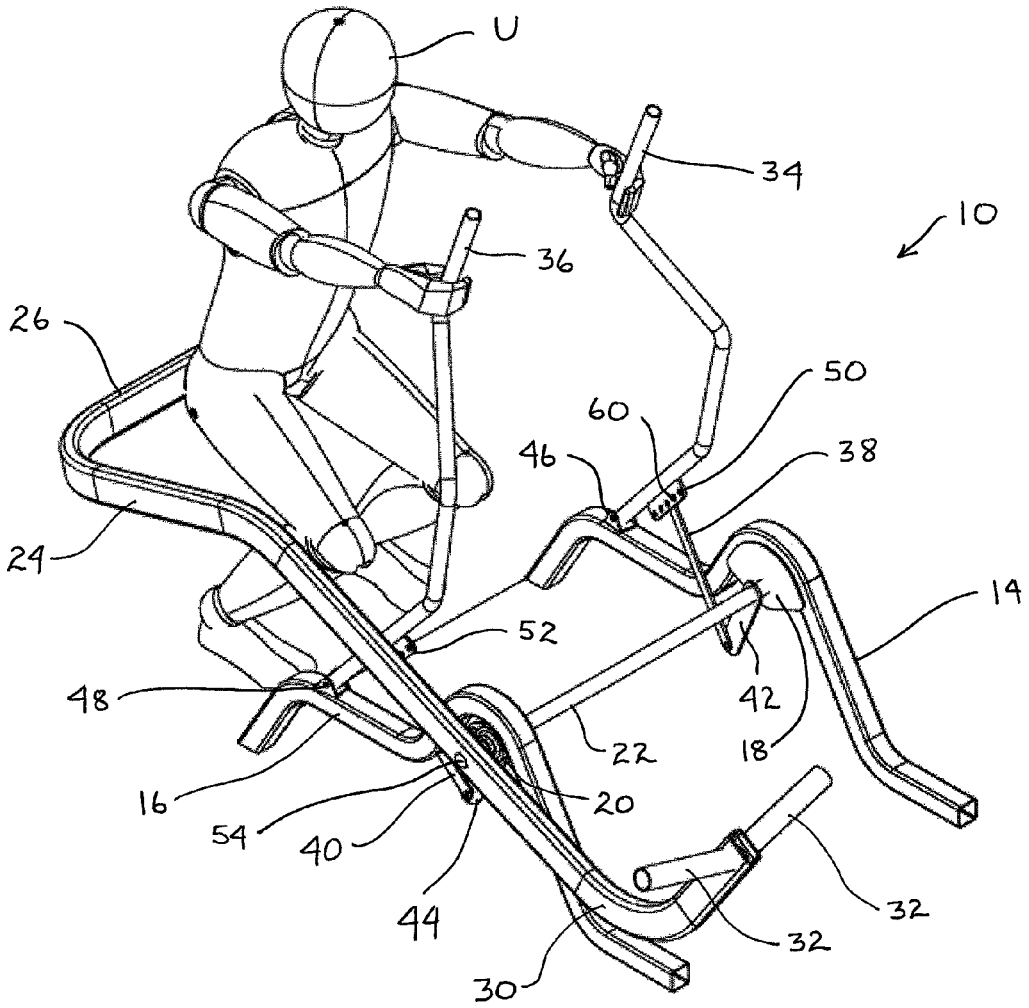
FIG. 2 is a schematic perspective view of an embodiment of the invention showing a user in the squatting position.

FIG. 2 is a schematic perspective view of an embodiment of the invention showing a user in the squatting position. From the position in FIG. 1, the user U has squatted by bending his or her knees, forcing glute pad 28 downwards, which in turn has pivoted lever 24 downwards causing axle 22 to rotate. The rotation of axle 22, through linkages 38, 40, 42, 44, causes handles 34, 36 to rotate forwards away from user U. User U can apply a pulling force to handles 34, 36 while squatting to assist or brake the squatting movement. Handles 34 and 36 are pressed in a forward arcing motion simultaneously with glute pad 28 being forced downward so that the two forces worked together to raise the counterweight. When moving to the standing position from the squatting position, user U stands while, optionally, simultaneously pulling on handles 34, 36 to assist the standing movement. Pulling on handles 34, 36 causes the rotation of axle 22, through linkages 38, 40, 42, 44, which causes lever 24 to rotate upwards. Counterweights 56 and/or the weight of the lever 24 on the opposite side of fulcrum 12 from user U and counterweight arm 30 also can provide an assist in the standing movement and cause glute pad 28 to move upwards.

Figure 3:
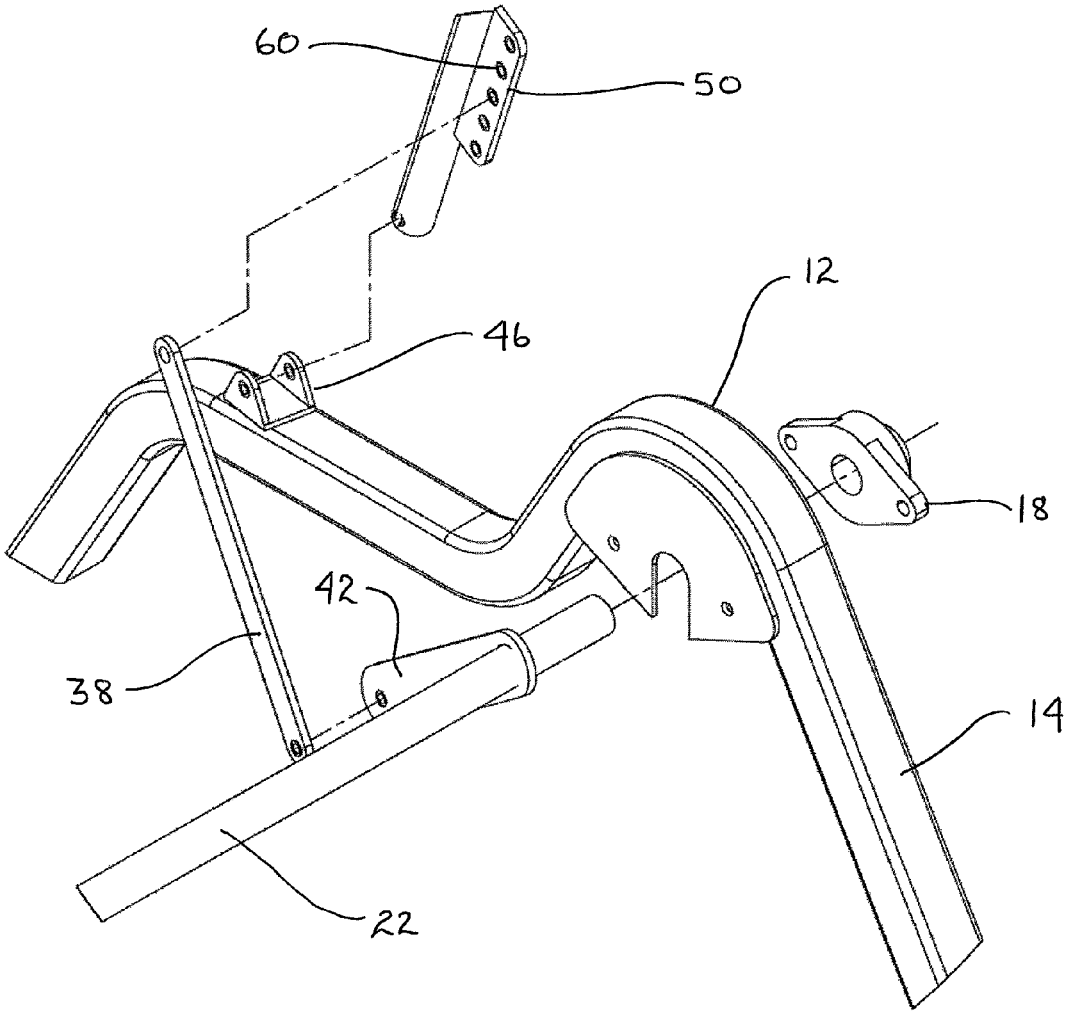
FIG. 3 is an exploded diagram of operating linkages of an embodiment of the invention.

FIG. 3 is an exploded diagram of exemplary bearings 18, 20, operating linkages 38, 40, 42, 44, and optional adjustment means 50, 52 of an embodiment of the device 10. As can be seen, bearing 18 is mounted in a crook or bend of base leg 14 and pivotal connector 46 is mounted on a suitable surface of base leg 14. Axle 22 is journaled into bearing 18. Linkage 42 in this embodiment is a part of axle 22. Linkage 38 is rotatably secured on one end to linkage 42 and rotatably secured on another end to adjustment means 50. Adjustment means 50, if present, is secured to handle 34. Adjustment means 50 can comprise adjusting holes 60 and/or pop pins so that handle 34 can be moved relative to user U to a position most comfortable to user U. Handle 34 is pivotally connected to pivotal connector 46. A mirror image configuration exists for handle 36 and base leg 16 with operating linkages 40, 44, bearing 20, pivotal connector 48, and adjustment means 52

Figure 4:
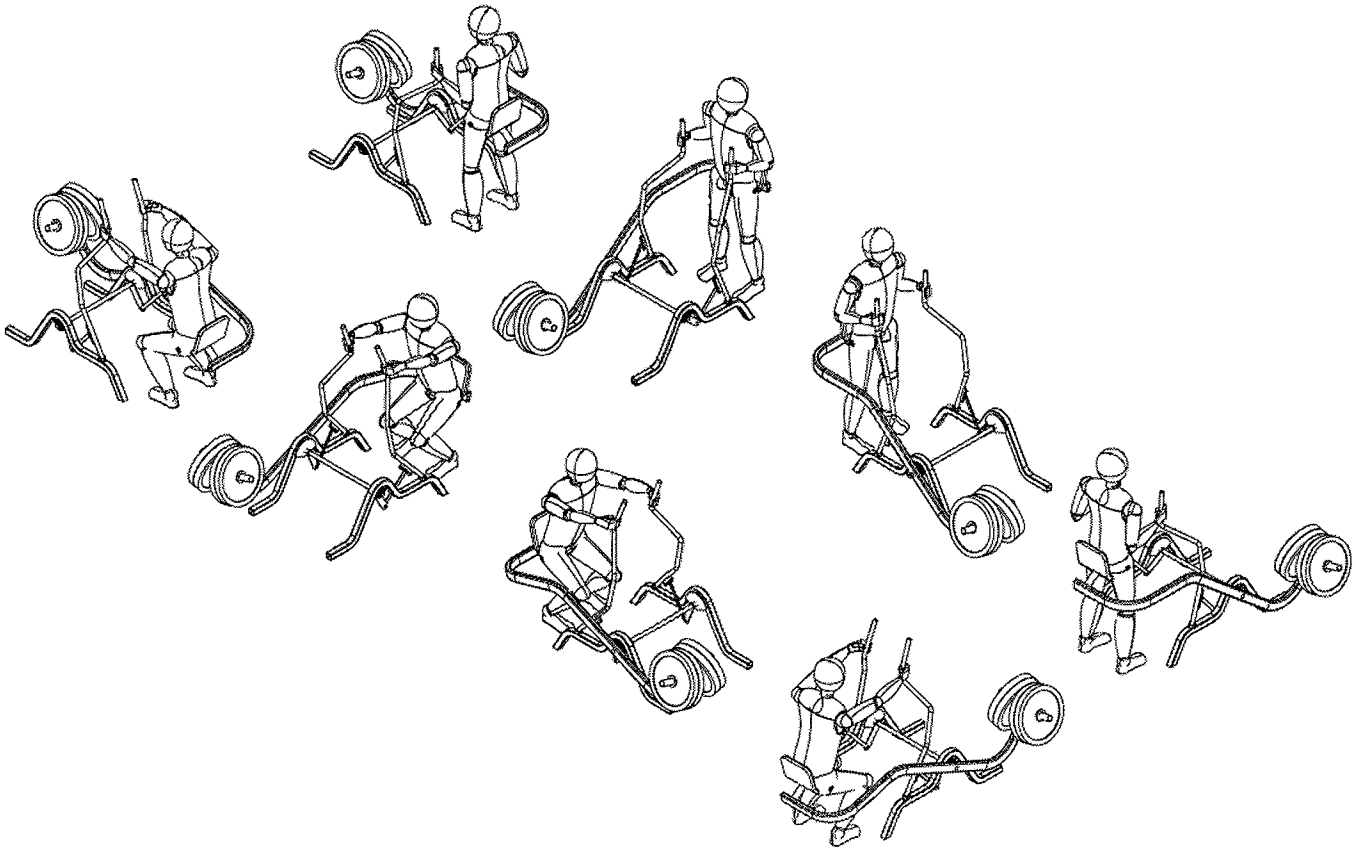
FIG. 4 is a series of perspective schematics of an embodiment of the invention from different angles 90 degrees apart in both the standing and squatting positions.

FIG. 4 is a series of perspective schematics of an embodiment of the invention from different angles 90 degrees apart in both the standing and squatting positions. FIG. 4 illustrates the use and positioning of a number of counterweights 56.

Figure 5:
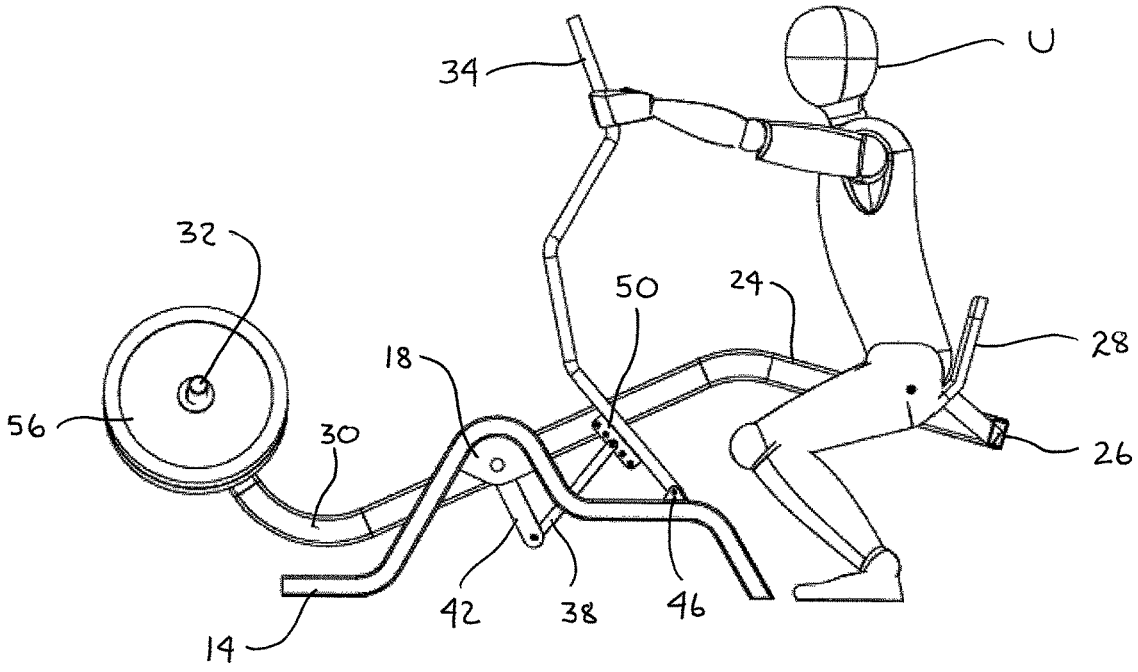
FIG. 5 is a schematic side view of an embodiment of the invention showing a user in the squatting position.
Figure 6:
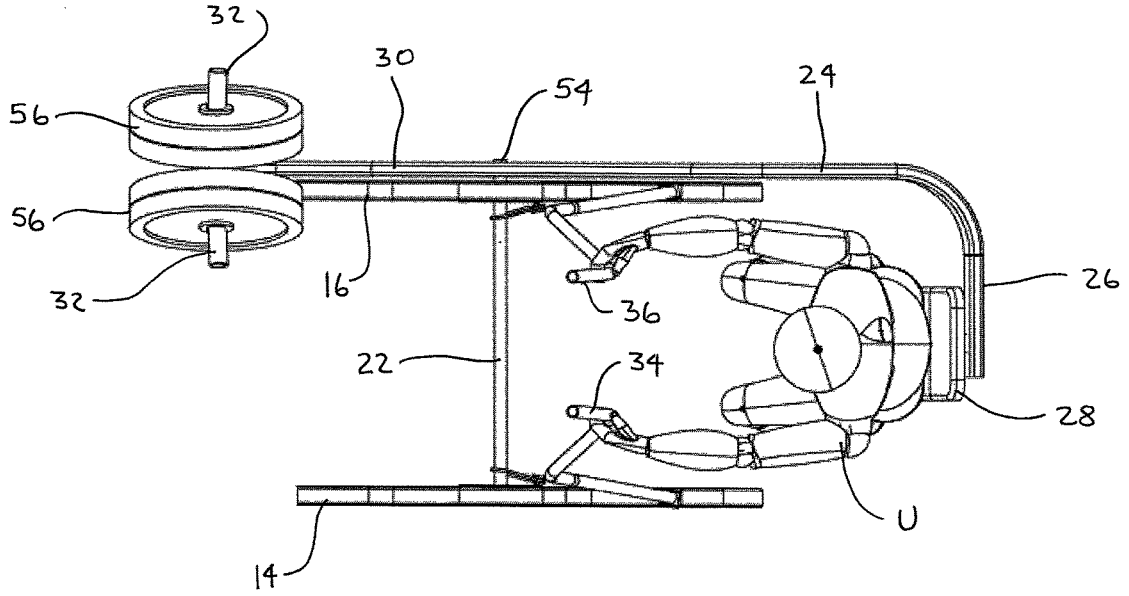
FIG. 6 is a schematic top view of an embodiment of the invention showing a user in the squatting position.

FIG. 5 is a schematic side view of an embodiment of the invention showing a user in the squatting position. FIG. 6 is a schematic top view of an embodiment of the invention showing a user in the squatting position. As can be seen, user U is squatting, glute pad 28 is in a relative down position, handles 34, 36 are in a relative forward position, and counterweights 56 are in a relative up position.

Figure 7:
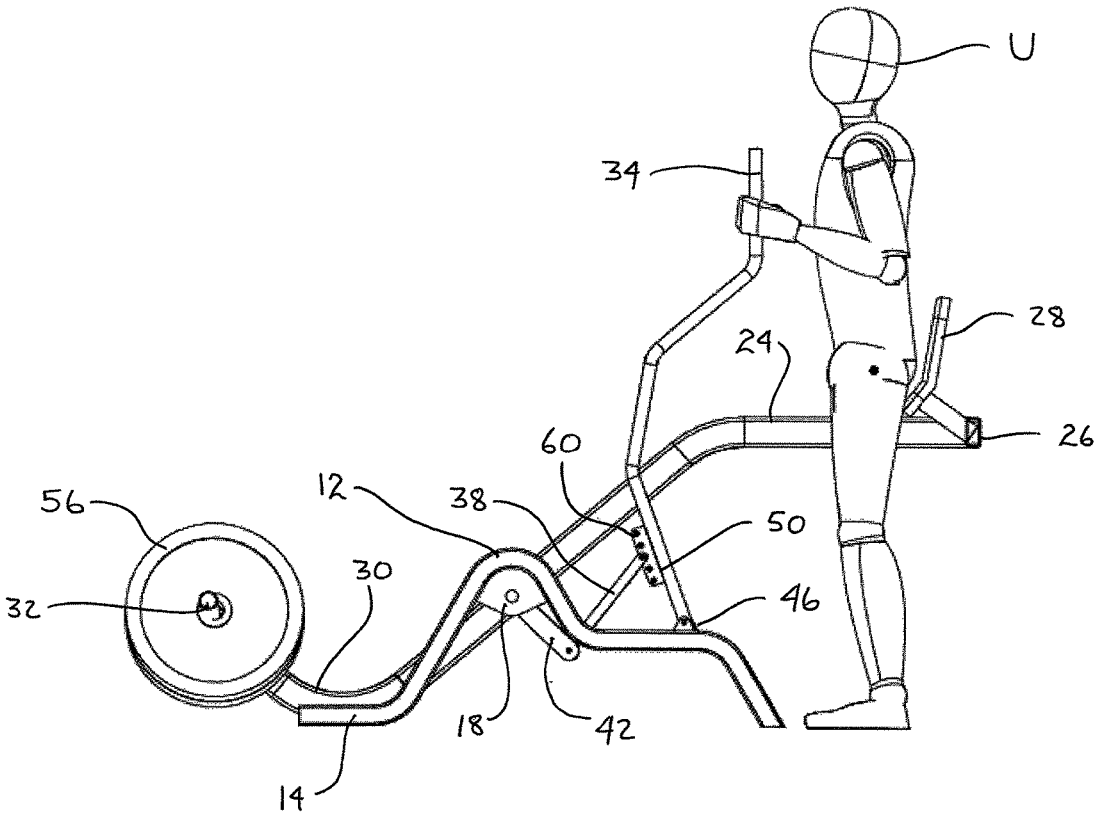
FIG. 7 is a schematic side view of an embodiment of the invention showing a user in the standing position.
Figure 8:
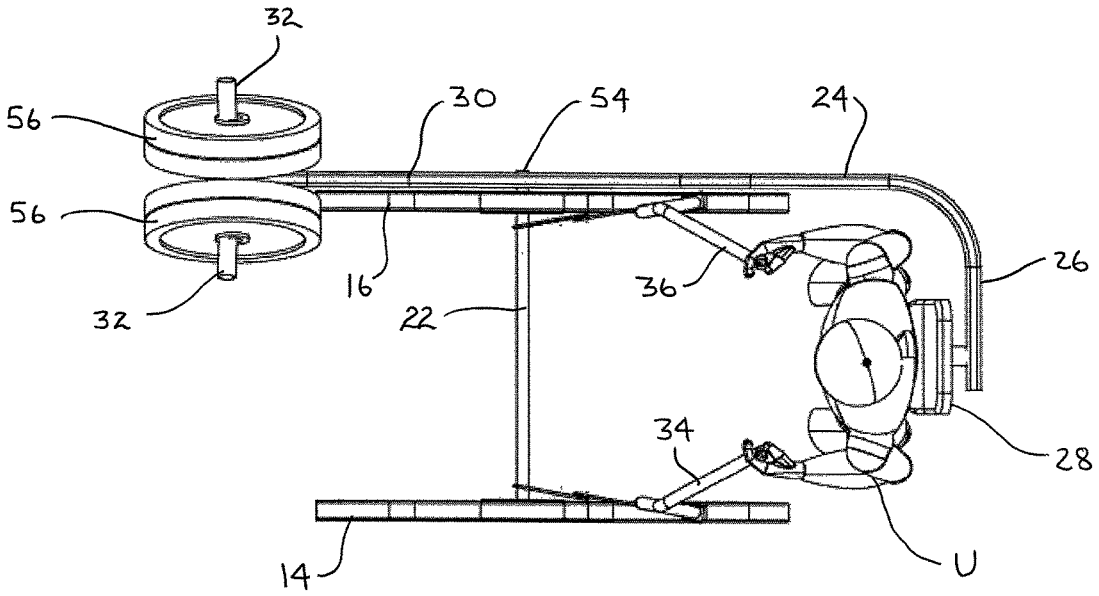
FIG. 8 is a schematic top view of an embodiment of the invention showing a user in the standing position.

FIG. 7 is a schematic side view of an embodiment of the invention showing a user in the standing position. FIG. 8 is a schematic top view of an embodiment of the invention showing a user in the standing position. As can be seen, user U is standing, glute pad 28 is in a relative up position, handles 34, 36 are in a relative rearward position, and counterweights 56 are in a relative down position.

Figure 9:
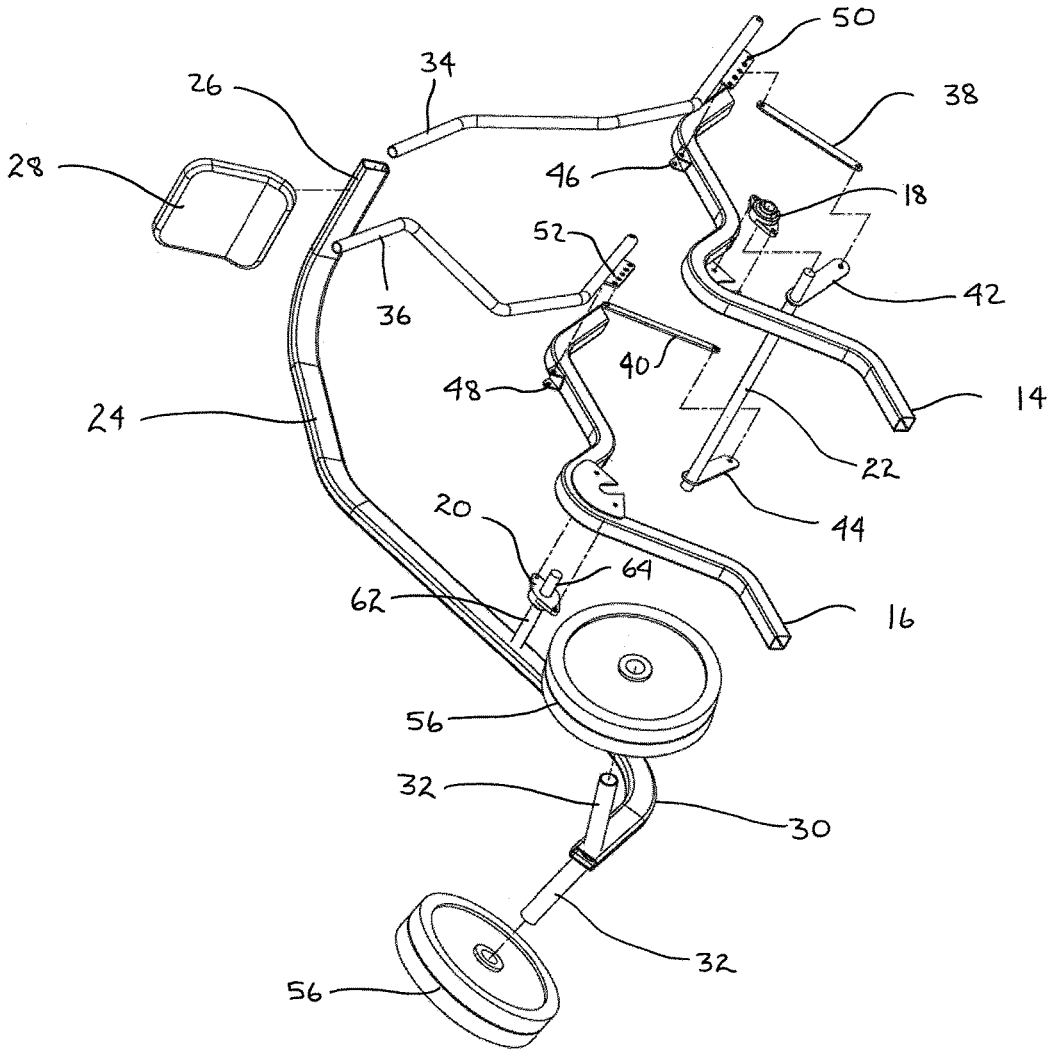
FIG. 9 is an exploded diagram of an embodiment of the invention showing the various operating components.

FIG. 9 is an exploded diagram of an embodiment of the device 10 showing the various operating components and their constructional relationship to each other.

FIGS. 10 through 13 illustrate a first alternate embodiment of the invention without an axle 22, with only one bearing 20 for lever 24, with only one set of linkages 40, 44, and with only one adjustment means 52. In this embodiment, lever 24 comprises journal 62 that is journaled into bearing 20 and comprises connector 64 that operatively cooperates with linkages 40, 44. Handles 34, 36 also preferably has a connecting bar 66 to cause handles 34, 36 to move together, as in this embodiment only handle 36 is operatively attached to lever 24. Connecting bar 66 also can provide greater lateral stability to handles 34, 36.

Figure 10:
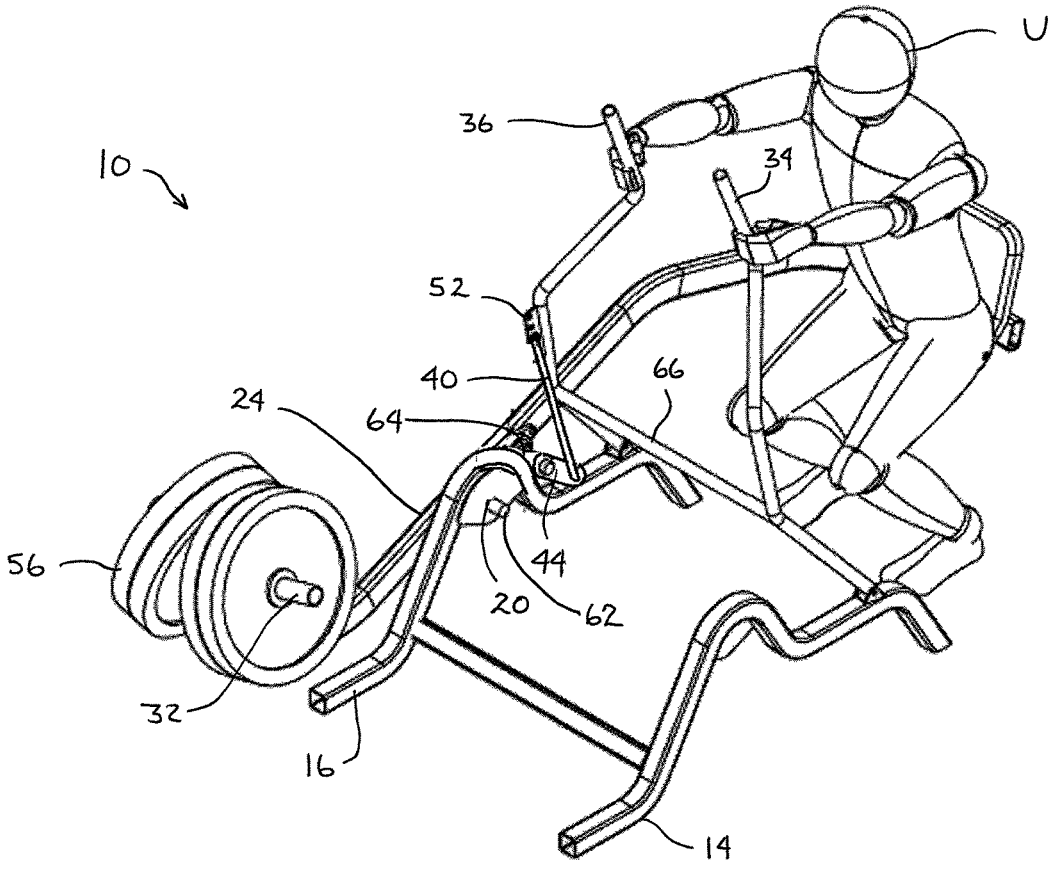
FIG. 10 is a first schematic perspective view of a first alternate embodiment of the invention showing a user in the squatting position.
Figure 11:
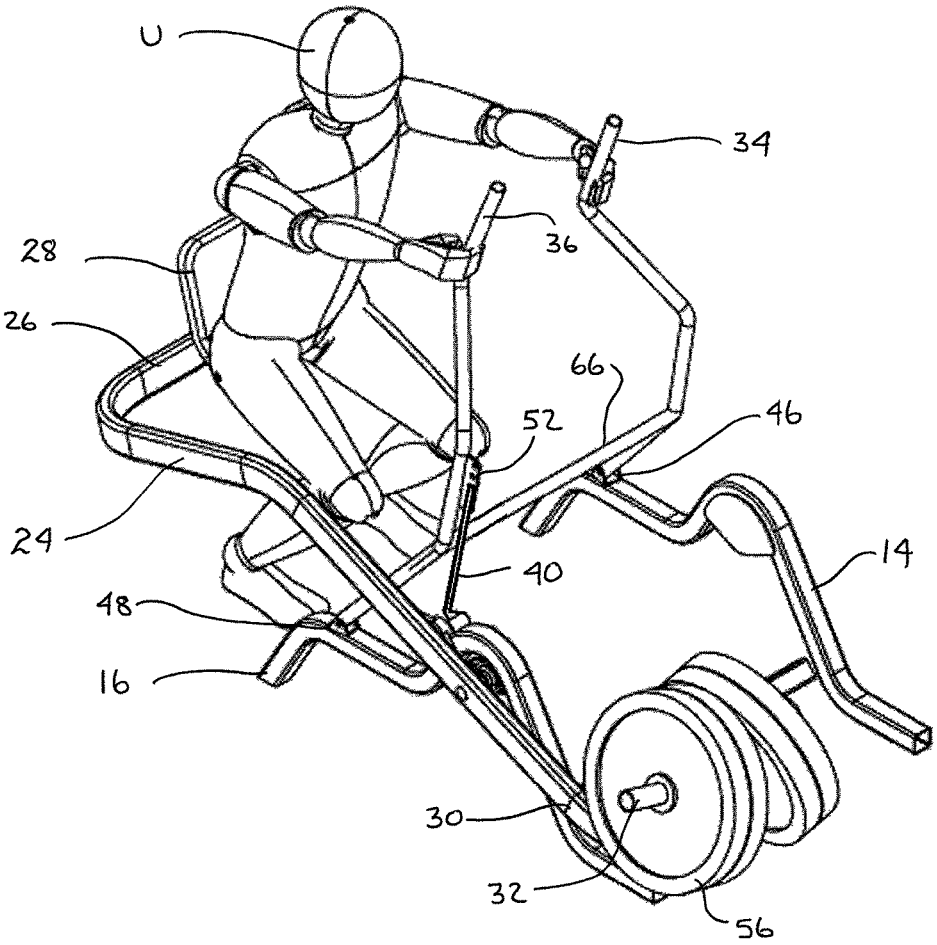
FIG. 11 is a second schematic perspective view of a first alternate embodiment of the invention showing a user in the squatting position.

FIG. 10 is a first schematic perspective view of a first alternate embodiment of the device 10 showing a user U in the squatting position. FIG. 11 is a second schematic perspective view of the first alternate embodiment of the device 10 showing a user U in the squatting position. In this embodiment, as user U squats causing glute pad 28 to move downwards and counterweights 56 to move upwards, connector 64, which preferably is rigidly connected to linkage 44, causes linkages 40, 44 to rotate in such a way to cause handles 34, 36 to rotate forwards, away from user U. User U can apply a pulling force to handles 34, 36 while squatting to assist or brake the squatting movement and to assist with returning to the standing position.

Figure 12:
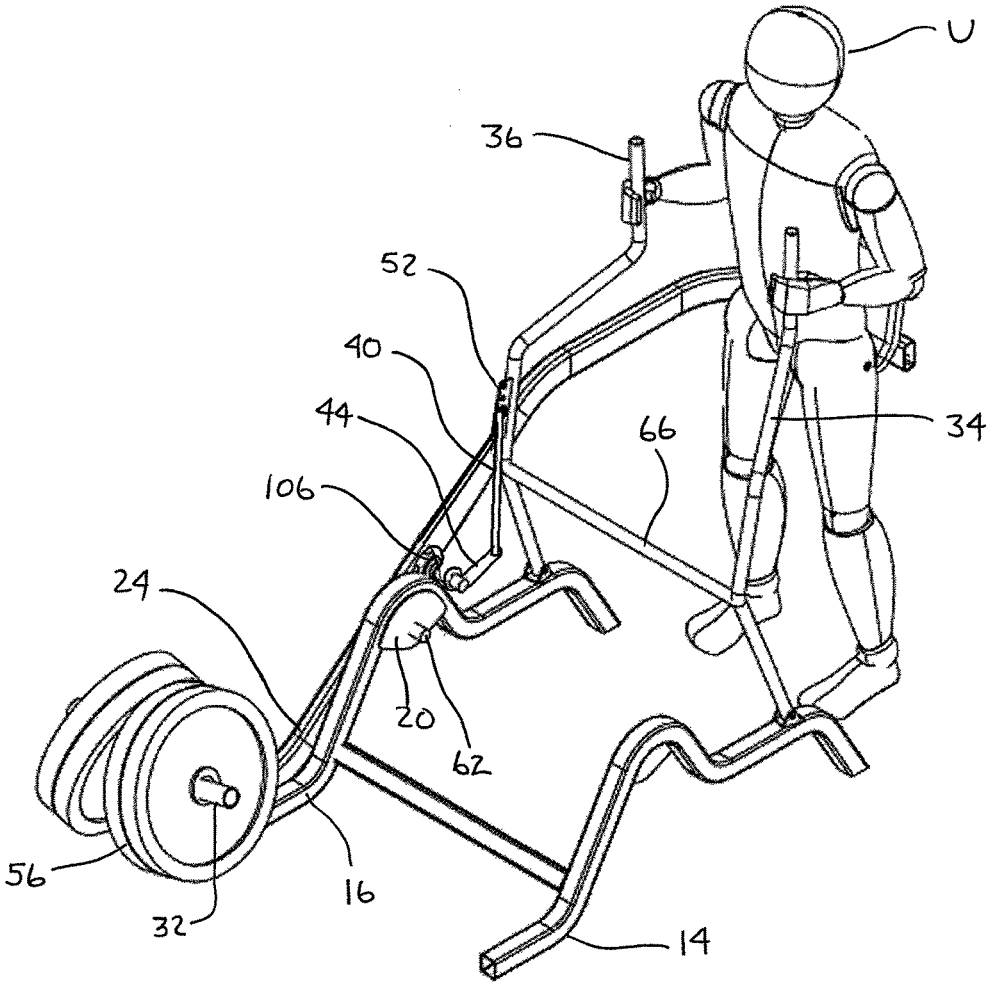
FIG. 12 is a first schematic perspective view of a first alternate embodiment of the invention showing a user in the standing position.
Figure 13:
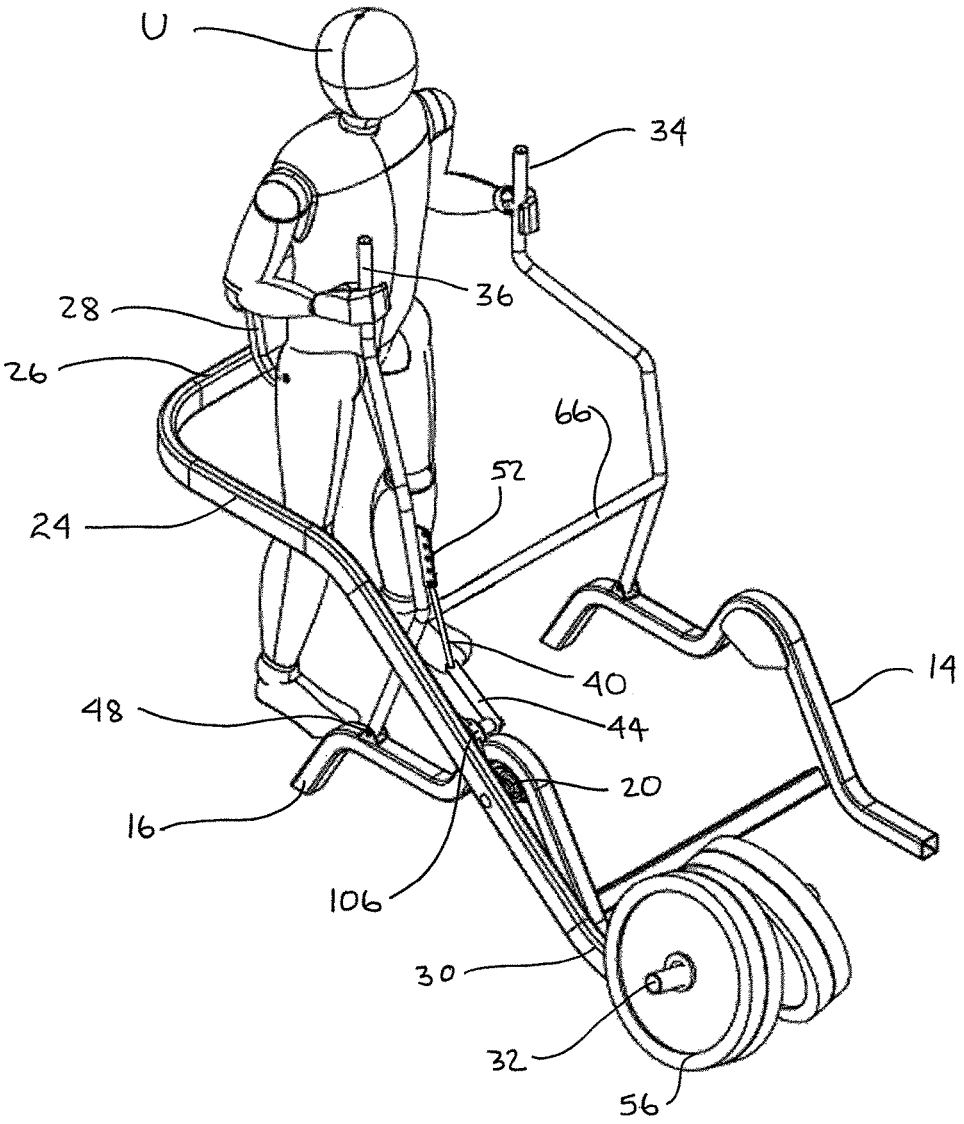
FIG. 13 is a second schematic perspective view of a first alternate embodiment of the invention showing a user in the standing position.

FIG. 12 is a first schematic perspective view of the first alternate embodiment of the device 10 showing a user U in the standing position. FIG. 13 is a second schematic perspective view of a first alternate embodiment of the device 10 showing a user U in the standing position. When moving to the standing position from the squatting position, user U stands while, optionally, simultaneously pulling on handles 34, 36 to assist the standing movement. Pulling on handles 34, 36, through linkages 40, 44, causes lever 24 to rotate upwards. Handle bearing 106 can be used to provide for better movement and manipulation of handles 34, 36. Counterweights 56 and/or the weight of the lever 24 on the opposite side of fulcrum 12 from user U and counterweight arm 30 also can provide an assist in the standing movement.

FIGS. 14 through 17 illustrate a second alternate embodiment of the device 10 that is generally similar to the embodiment of FIGS. 1 through 9. This second alternate embodiment comprises connecting bar 66 between handles 34, 36 and a second counterweight arm 68 and a second set of counterweights 70. Second counterweight arm 68 is attached to axle 22 and extends forward away from user U. In this embodiment, as axle 22 rotates, second counterweight arm 68 rotates upwards and downwards. Counterweight arm 30 and second counterweight arm 68 move in conjunction with each other in that both move upwards at the same time and both move downwards at the same time as user U engages in the squatting exercise regimen.

Figure 14:
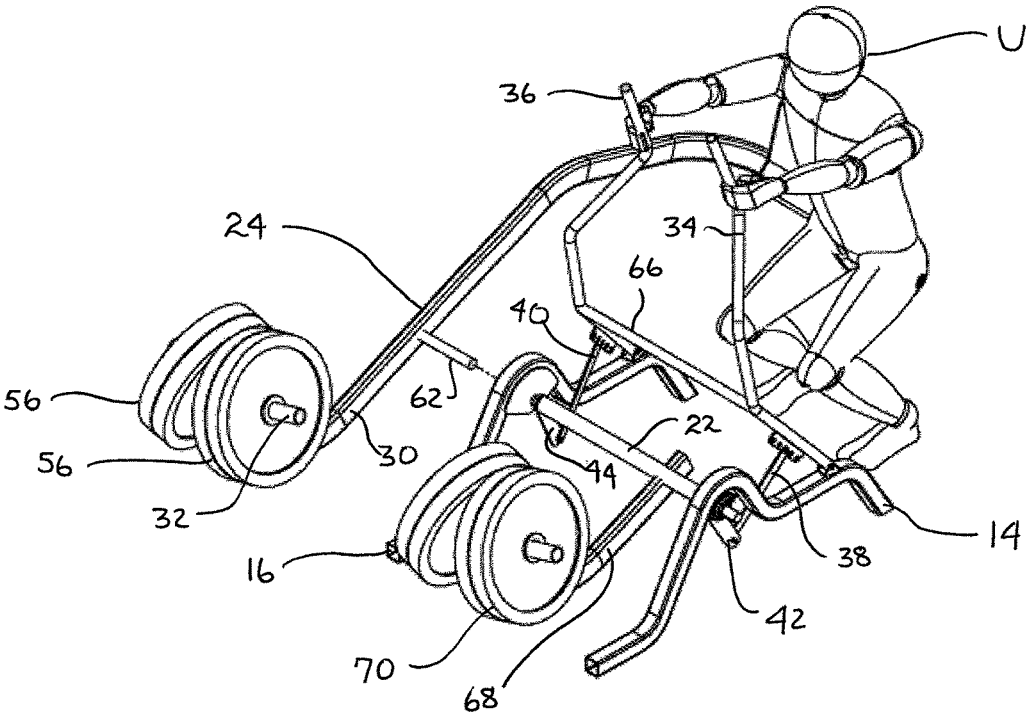
FIG. 14 is a first schematic perspective view of a second alternate embodiment of the invention showing a user in the squatting position.
Figure 15:
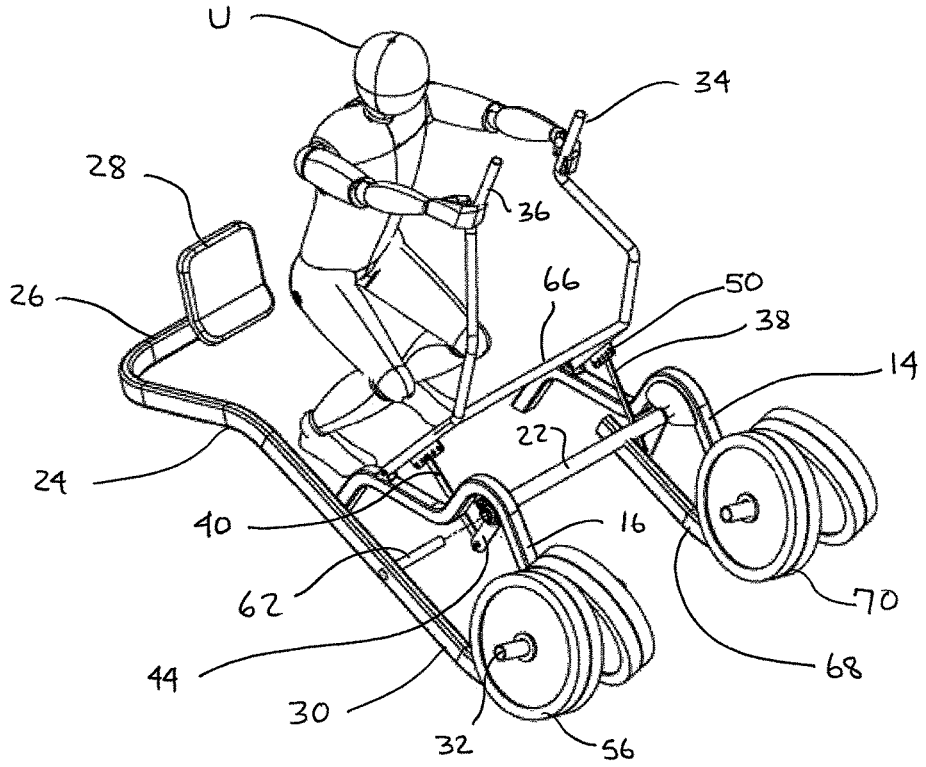
FIG. 15 is a second schematic perspective view of a second alternate embodiment of the invention showing a user in the squatting position.
Figure 16:
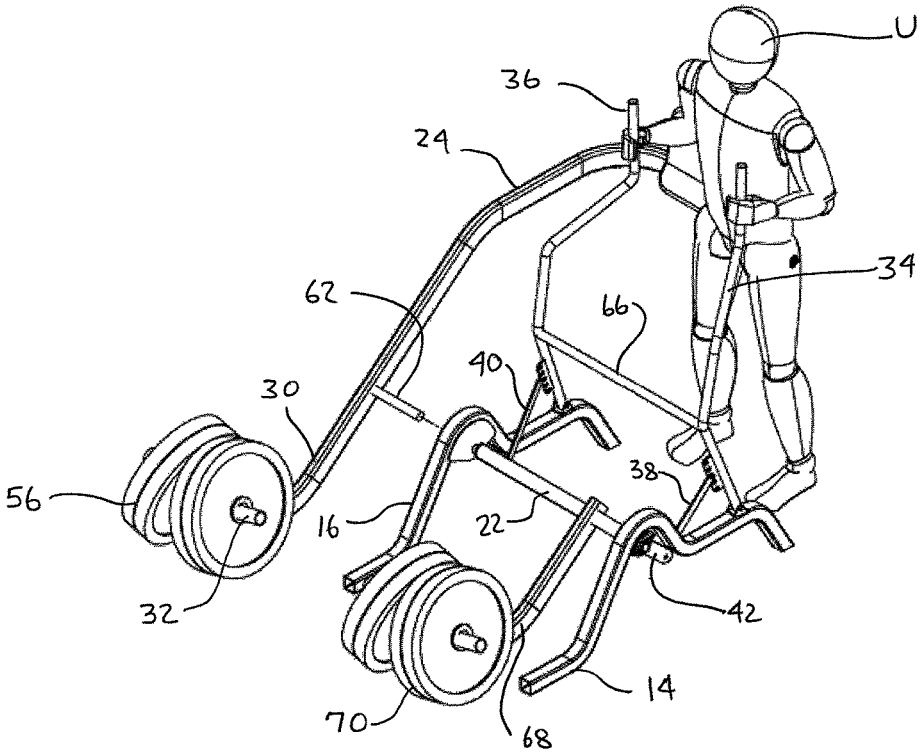
FIG. 16 is a first schematic perspective view of a second alternate embodiment of the invention showing a user in the standing position.
Figure 17:
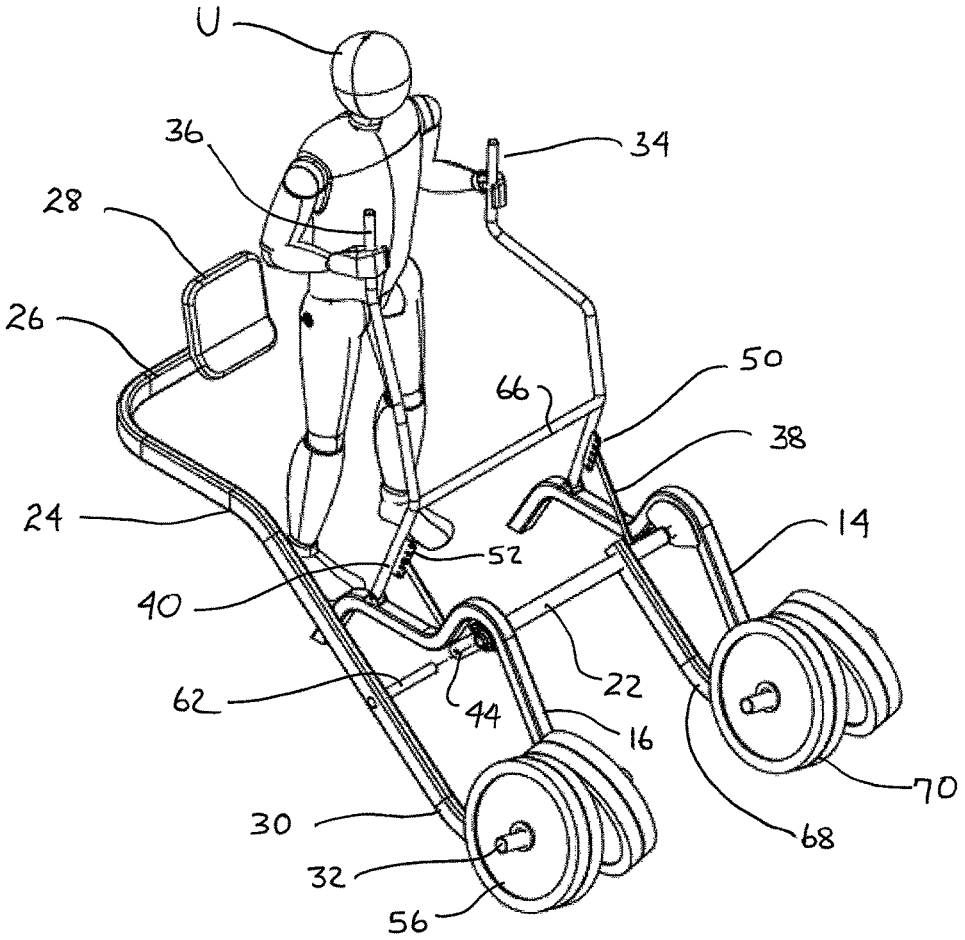
FIG. 17 is a second schematic perspective view of a second alternate embodiment of the invention showing a user in the standing position.

FIG. 14 is a first schematic perspective view of a second alternate embodiment of the device 10 showing a user U in the squatting position. FIG. 15 is a second schematic perspective view of a second alternate embodiment of the device 10 showing a user U in the squatting position. FIG. 16 is a first schematic perspective view of the second alternate embodiment of the device 10 showing a user U in the standing position. FIG. 17 is a second schematic perspective view of the second alternate embodiment of the device 10 showing a user U in the standing position. The operation of this embodiment of the device 10 is similar to that disclose in conjunction with FIGS. 1-9.

Figure 18:
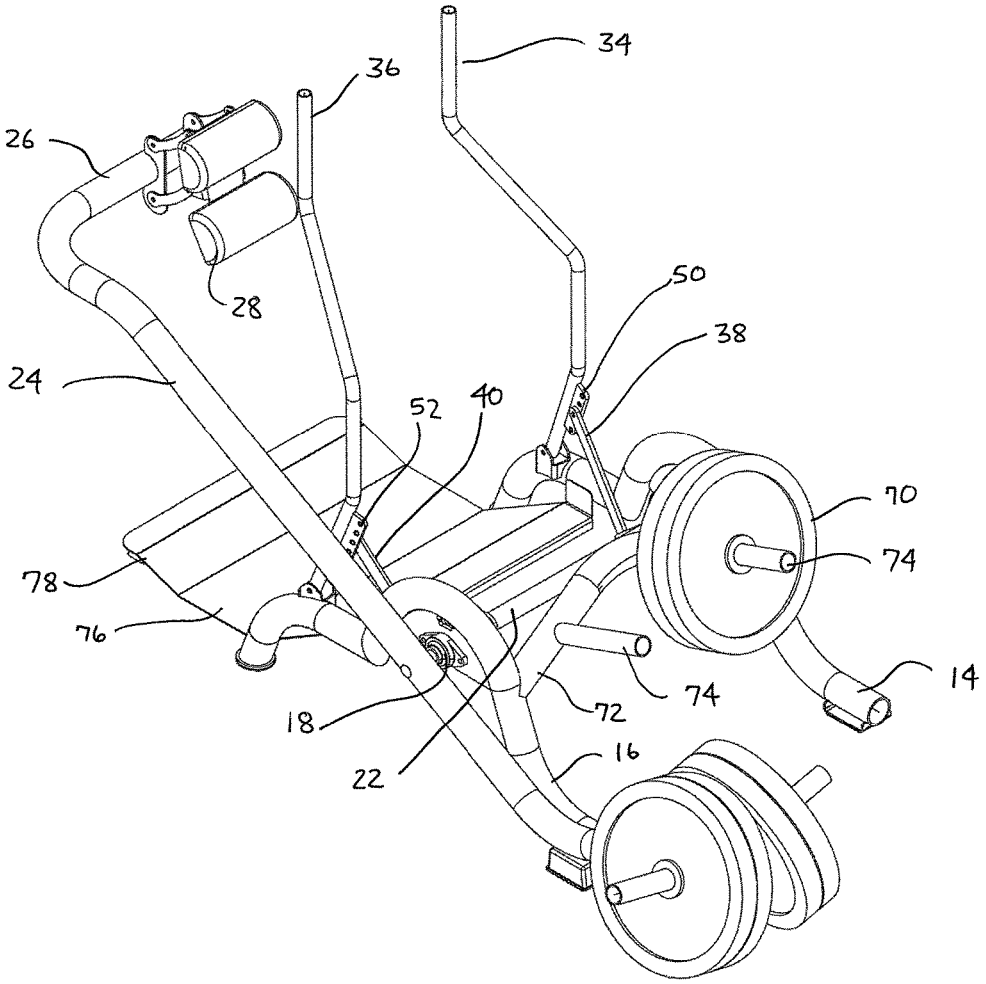
FIG. 18 is a schematic perspective view of a third alternate embodiment of the invention.
Figure 19:
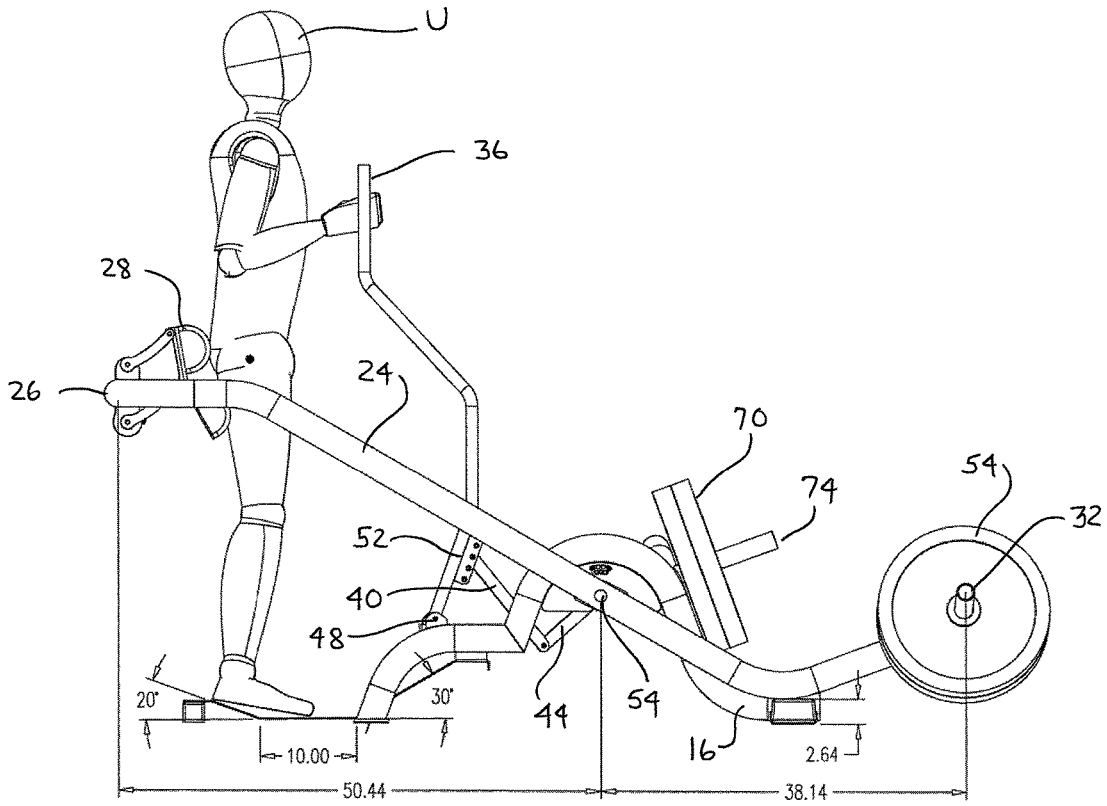
FIG. 19 is a schematic side view of a third alternate embodiment of the invention.

FIGS. 18 and 19 illustrate a third alternate embodiment of the device 10 that is generally similar to the embodiment of FIGS. 1 through 9. This third alternate embodiment comprises connecting storage bar 72 between base legs 14, 16 forward of axle 22. Connecting storage bar 72 comprises supports 74 for storing counterweights 56. Connecting storage bar 72 also provides for a stronger fulcrum 12 structure along with greater lateral stability. This third alternate embodiment further comprises base plate 76, attached to and between base legs 14, 16 rearward of axle 22 for user U to stand on. Base plate 76 provides at least two additional features. First, base plate 76 can comprise a heel rise 78, which can help to place the leg of user in a proper or better position for doing squat exercises, and to reduce stress on the Achilles Tendon. Second, base plate 76 can help prevent the device 10 from moving during the exercise regimen. FIG. 18 is a schematic perspective view of the third alternate embodiment of the device 10. FIG. 19 is a schematic side view of the third alternate embodiment of the device.

FIGS. 20 through 23 illustrate a fourth alternate embodiment of the device 10 that substitutes a cable lift mechanism 80 for a portion of lever 24, namely the portion extending rearward from axle 22 for supporting glute pad 28. In this embodiment, glute pad 28 is slidably supported on uprights 82, 84. As shown, uprights 82, 84 are rods having seat support 86 extending therebetween. Collars 86, 88 comprising bearings, low-friction materials or the like (not shown) can slide upwards and downwards on uprights 82, 84. Uprights 82, 84 are attached to an extension 90 of one or both base legs 14, 16.

Cable mechanism 80 comprises cable 92, cam or cable wind 94, and transfer pulleys 96, 98, 100, 102. Cable wind 94 is a generally circular pulley or spool like structure coaxial with and attached to axle 22 at or proximal to connecting end 54. Cable wind 94 can rotate along with axle 22 and when cable wind 94 rotates, cable 92 winds around cable wind 94. Lever 24, which now includes only that portion of lever 24 extending frontwards from axle 22 and comprises counterweight arm 30 for supporting weight supports 32 and counterweights 56, is attached to an outer surface of cable wind 94 such that when cable wind 94 rotates, lever 24 pivots upwards and downwards.

Transfer pulleys 96, 98, 100, 102 can be attached at various strategic places along base leg 16 and the extension 90 thereof and on upright 84. As shown in this embodiment, a first transfer pulley 96 is attached to base leg 16, a second transfer pulley 98 is attached to the extension 90 of base leg 16, and a third transfer pulley 100 and a fourth transfer pulley 102 are attached at or proximal to the top of upright 84. More or fewer transfer pulleys can be used as needed or desired to ensure that cable 92 efficiently and operatively connects cable wind 94 to glute pad 28.

Cable 92 extends from cable wind 94 to glute pad 28 via transfer pulleys 96, 98, 100, 102. As user U squats, glute pad 28 pulls on cable 92 causing cable wind 94 to rotate in a direction causing lever 24 to rotate such that counterweight arm 30 moves upwards. Concurrently, the rotation of cable wind 94 causes axle 22 to rotate in a direction causing handles 34, 36 to pivot forward, by action of linkages 38, 40, 42, 44, away from user U. User U can apply a pushing force to assist with moving counterweight arm 30 upwards or apply a pulling force to handles 34, 36 while squatting to assist or brake the squatting movement. When moving to the standing position from the squatting position, user U stands while, optionally, simultaneously pulling on handles 34, 36 to assist the standing movement. Pulling on handles 34, 36 causes the rotation of axle 22, through linkages 38, 40, 42, 44, which causes the rotation of cable wind 94, resulting in lever 24 rotating upwards. Counterweights 56 and/or the weight of the lever 24 on the opposite side of fulcrum 12 from user U and counterweight arm 30 also can provide an assist in the standing movement and cause glute pad 28 to move upwards.

Figure 20:
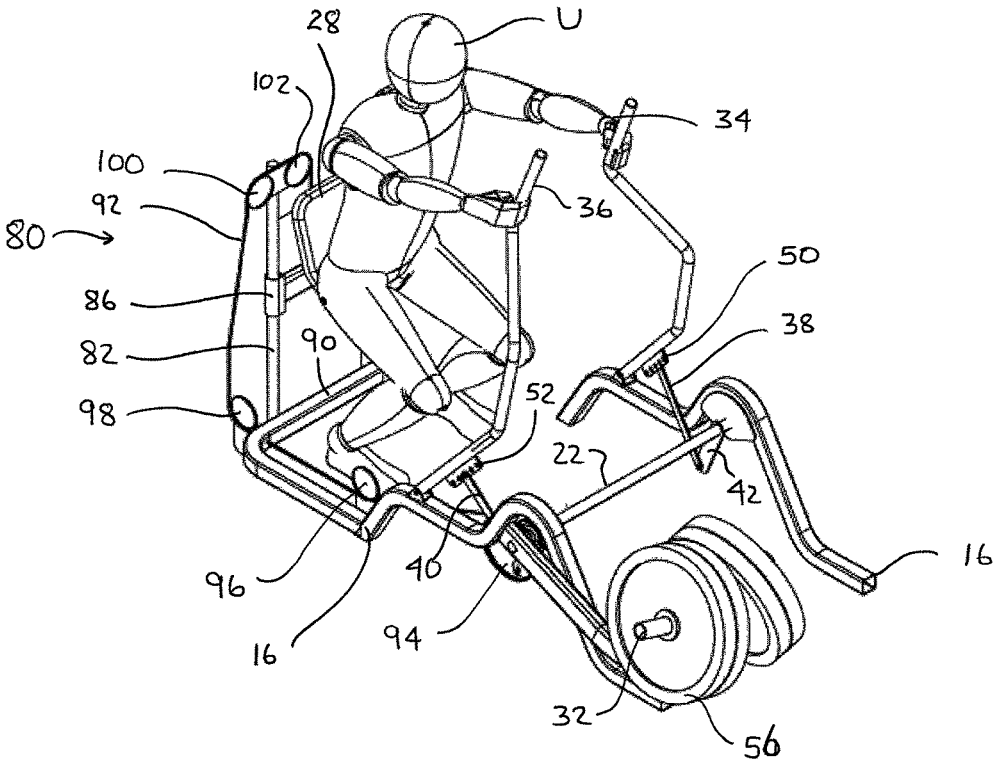
FIG. 20 is a first schematic perspective view of a fourth alternate embodiment of the invention showing a user in the squatting position.
Figure 21:
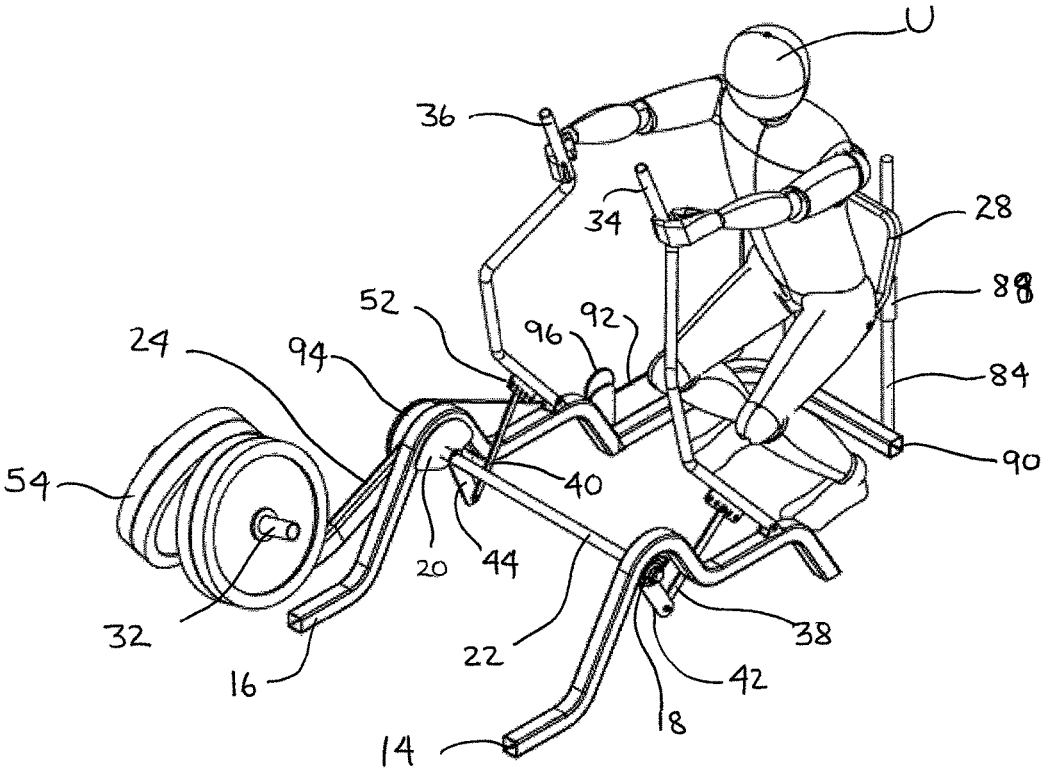
FIG. 21 is a second schematic perspective view of a fourth alternate embodiment of the invention showing a user in the squatting position.
Figure 22:
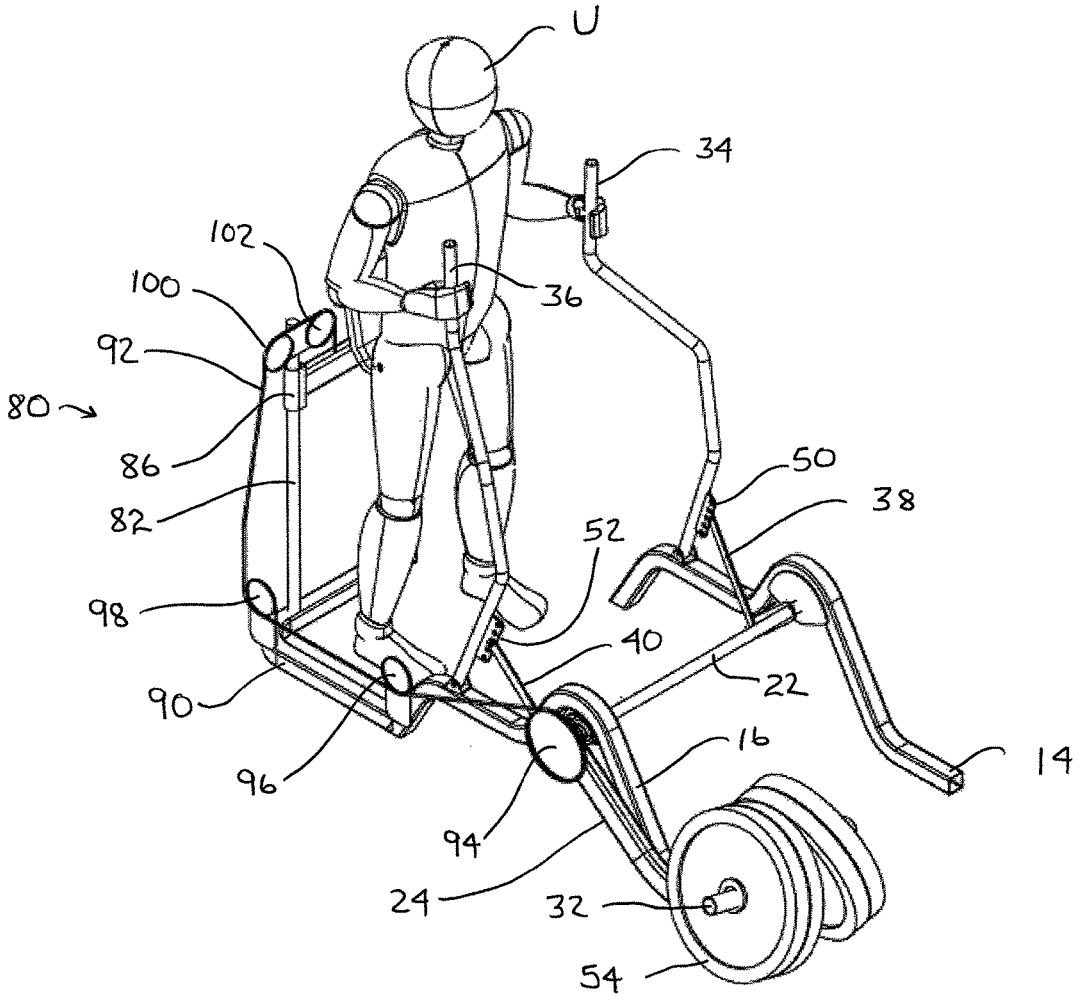
FIG. 22 is a first schematic perspective view of a fourth alternate embodiment of the invention showing a user in the standing position.
Figure 23:
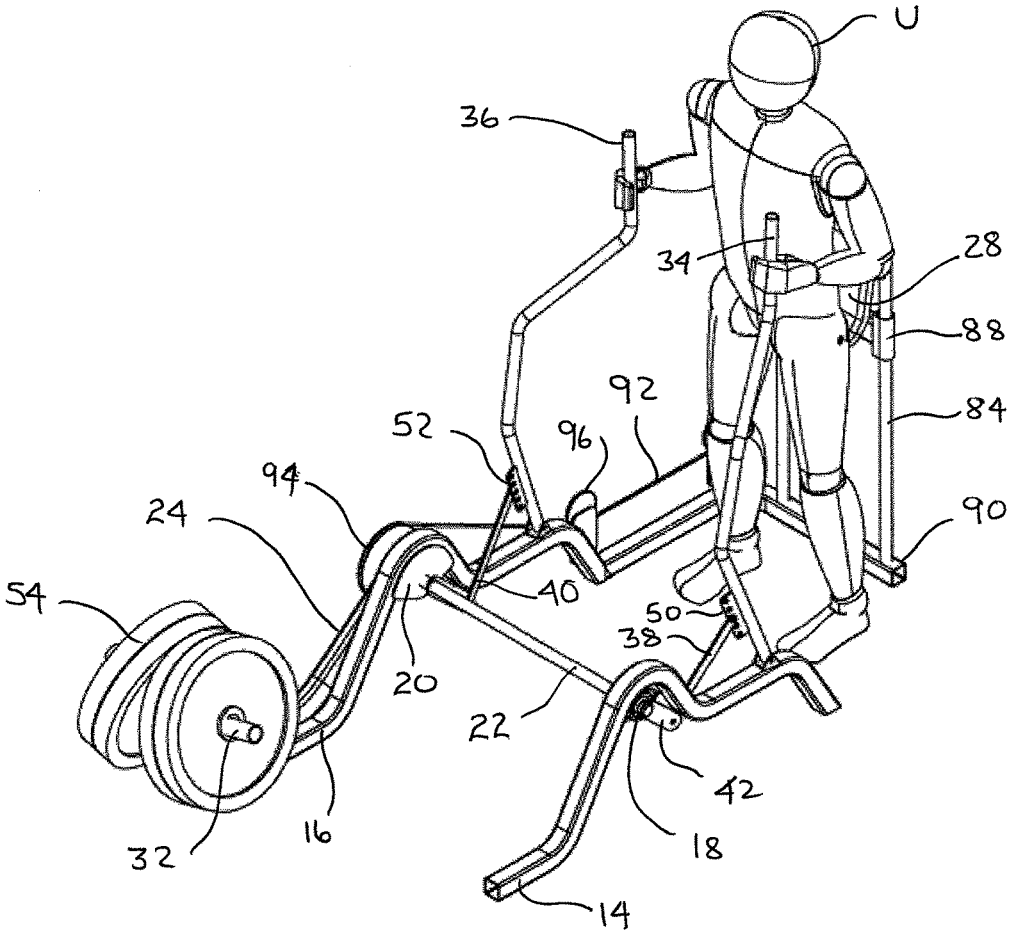
FIG. 23 is a second schematic perspective view of a fourth alternate embodiment of the invention showing a user in the standing position.

FIG. 20 is a first schematic perspective view of the fourth alternate embodiment of the device 10 showing a user U in the squatting position. FIG. 21 is a second schematic perspective view of the fourth alternate embodiment of the device 10 showing a user U in the squatting position. FIG. 22 is a first schematic perspective view of the fourth alternate embodiment of the device 10 showing a user U in the standing position. FIG. 23 is a second schematic perspective view of the fourth alternate embodiment of the device 10 showing a user U in the standing position. A comparison of these figures illustrates the motion of glute pad 28 and counterweight arm 30.

FIGS. 24 through 32 are photographs of an embodiment of the device 10. This embodiment is similar to the embodiment disclosed in conjunction with FIGS. 1 through 9, 18, and 19 with a connecting bar 72 between base legs 14, 16 and with base plate 76, but without counterweight 56 supports 74.

Figure 24:
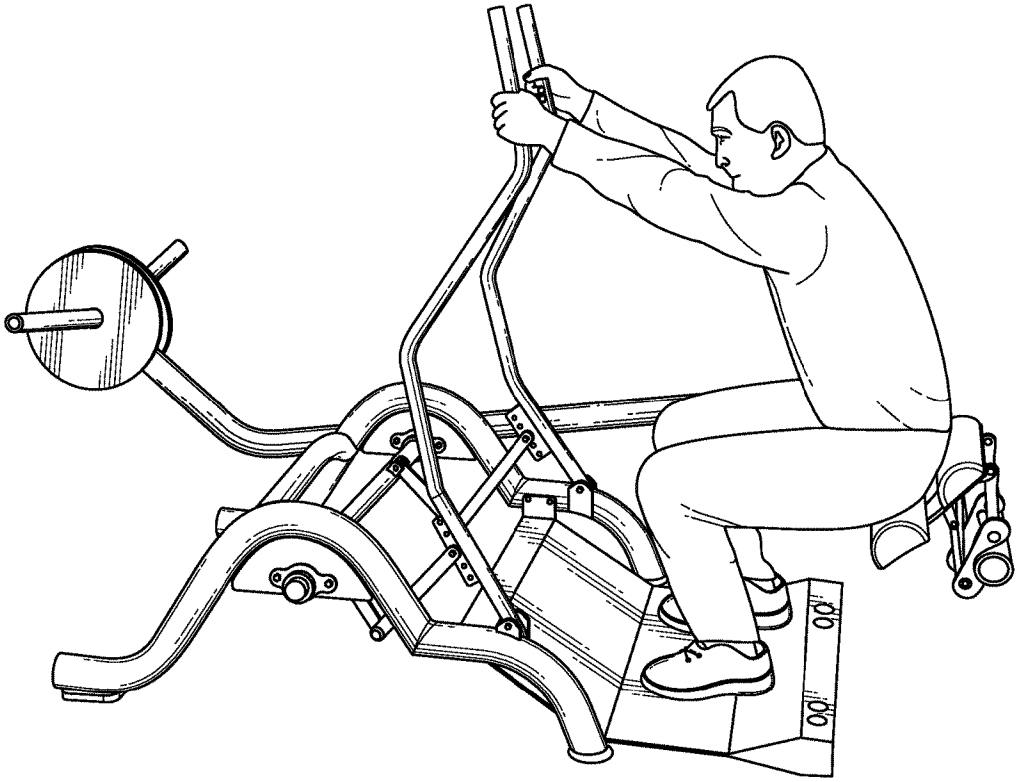
FIG. 24 is a photograph from the side showing an embodiment of the invention with a user in the squatting position.
Figure 25:
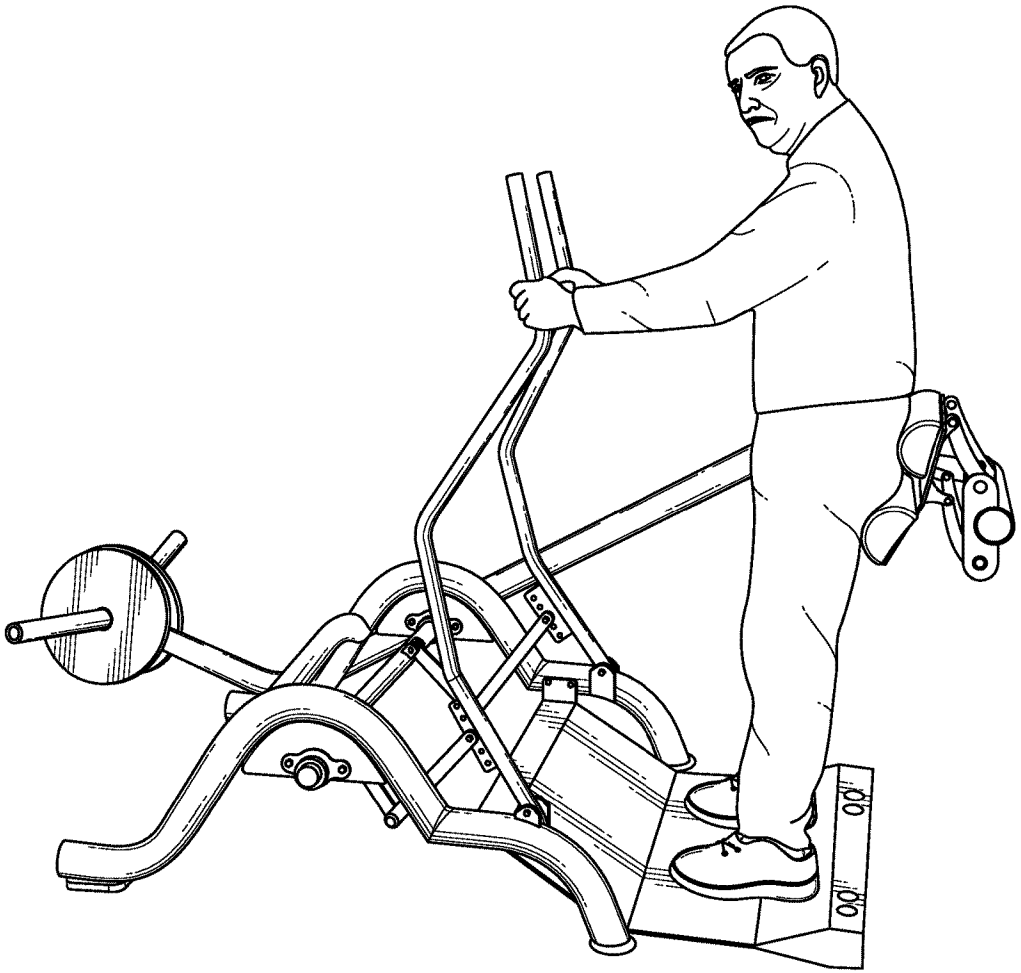
FIG. 25 is a first photograph from the side showing an embodiment of the invention with a user in the standing position.
Figure 26:
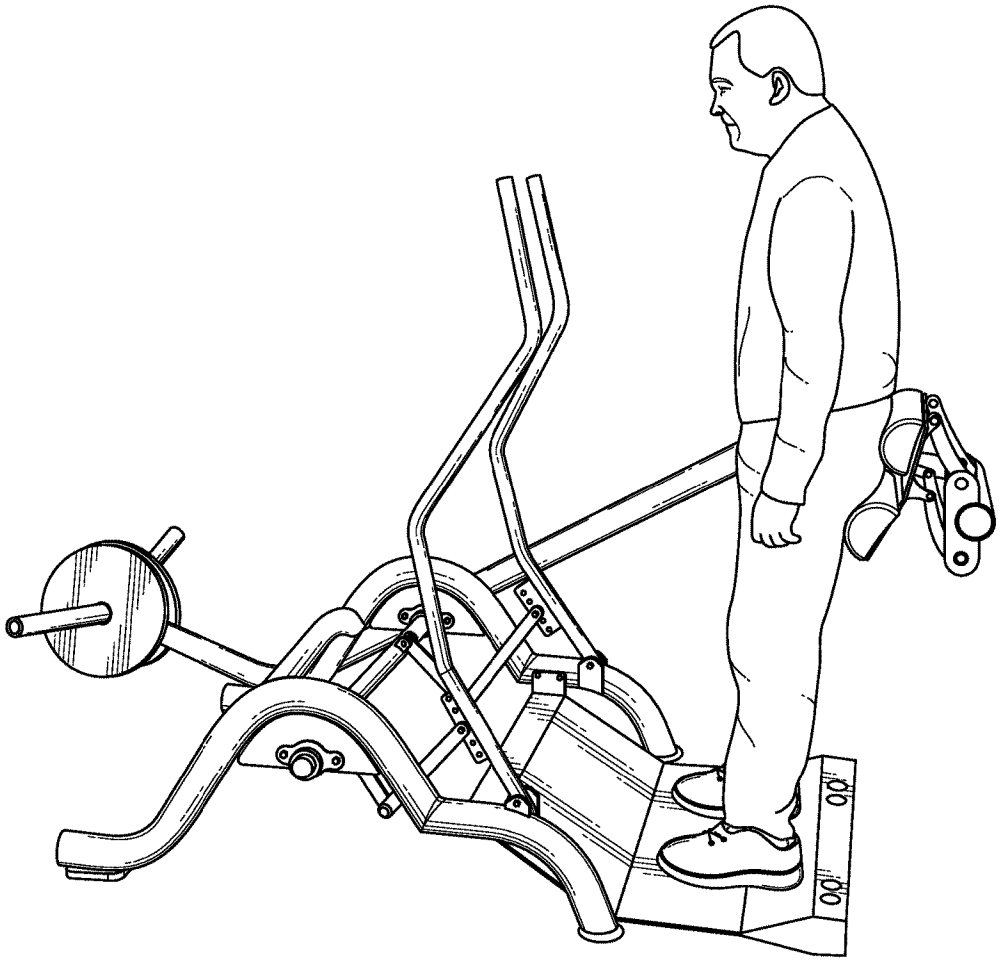
FIG. 26 is a second photograph from the side of an embodiment of the invention allowing the handles to be seen in more detail.
Figure 27:
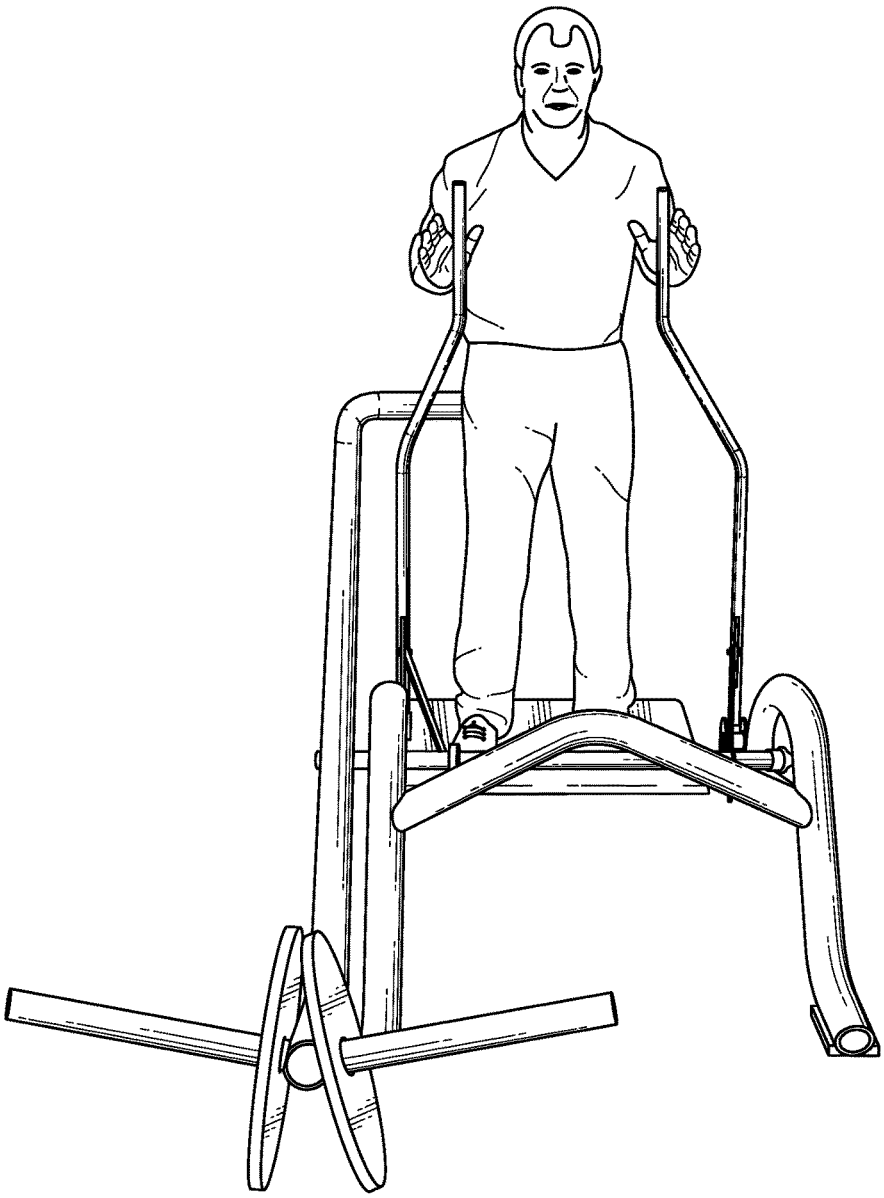
FIG. 27 is a photograph from the front showing of an embodiment the invention with a user in the standing position.
Figure 28:
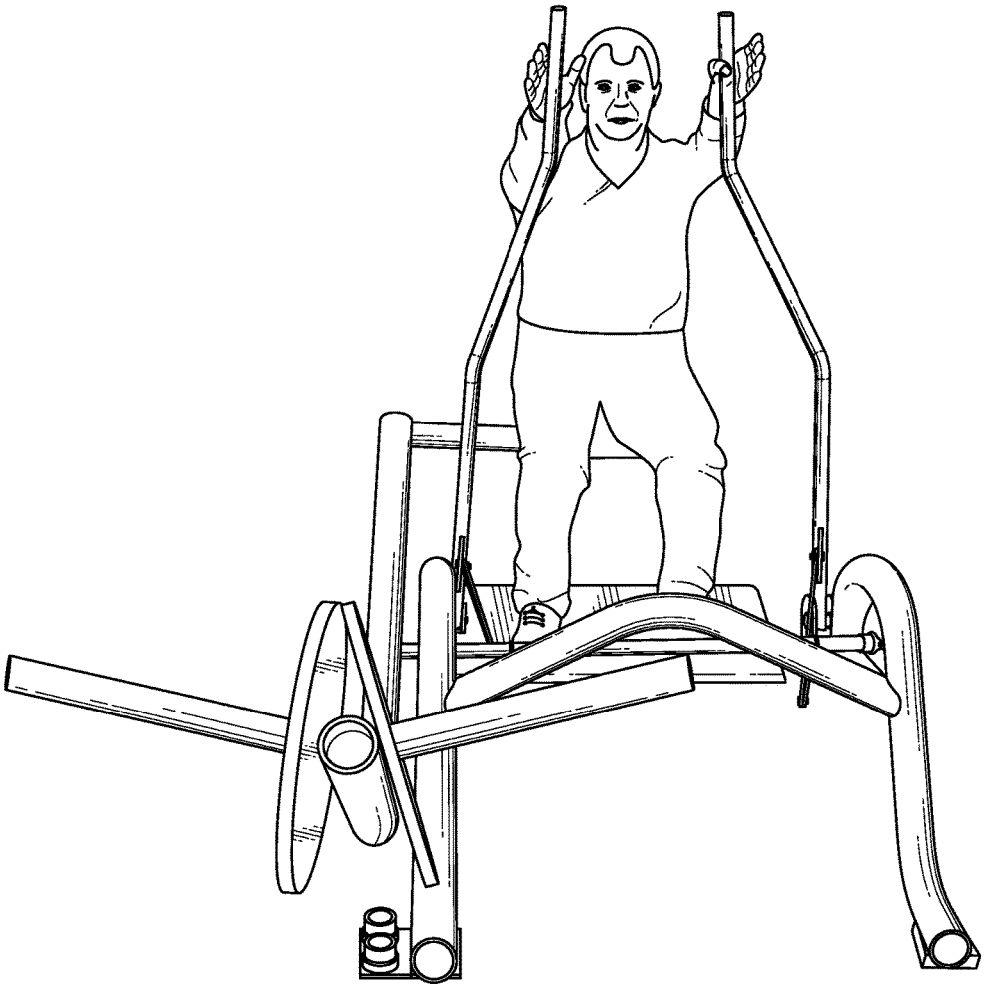
FIG. 28 is a photograph from the front showing of an embodiment the invention with a user in the squatting position.
Figure 29:
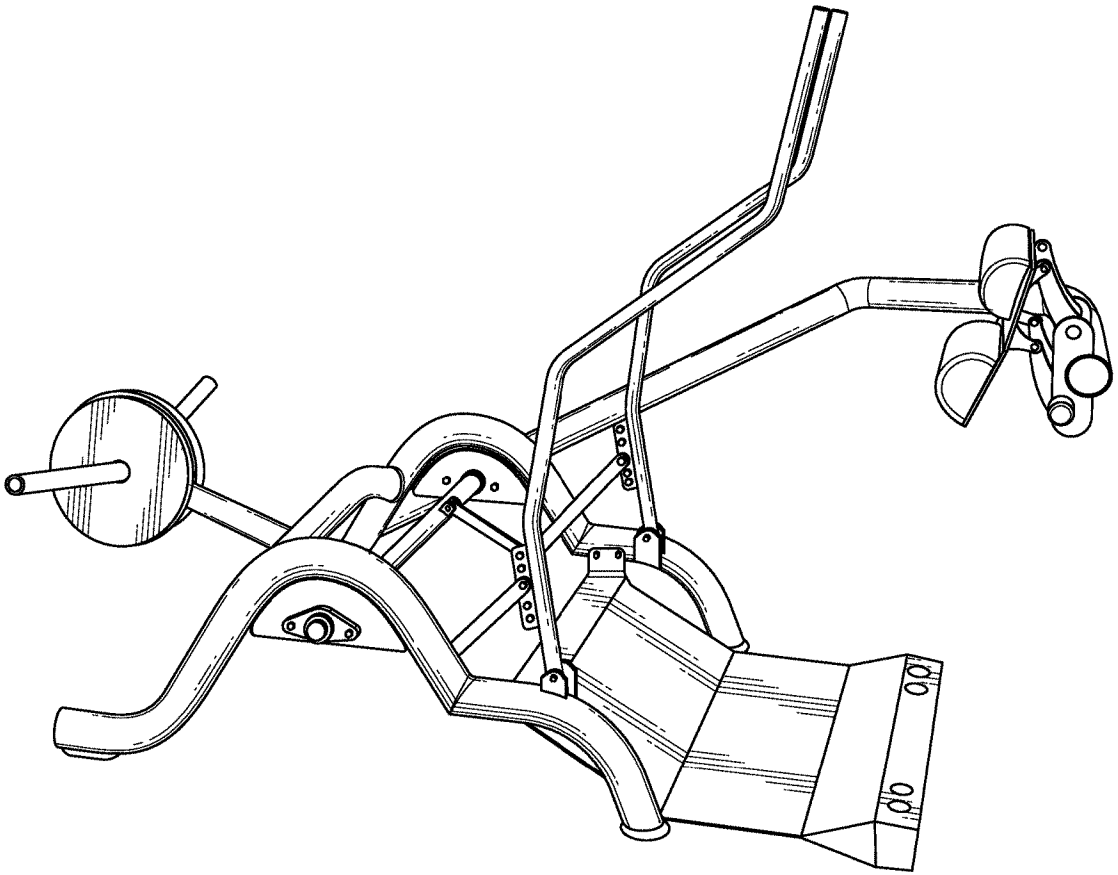
FIG. 29 is a first perspective photograph of an embodiment of the invention.
Figure 30:
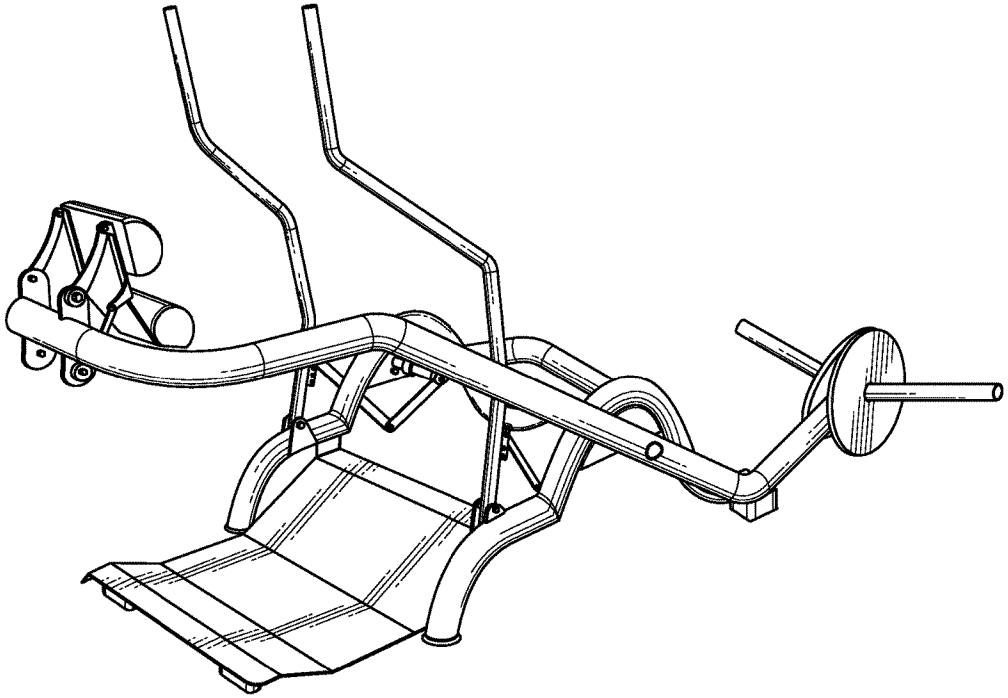
FIG. 30 is a second perspective photograph of an embodiment of the invention.
Figure 31:
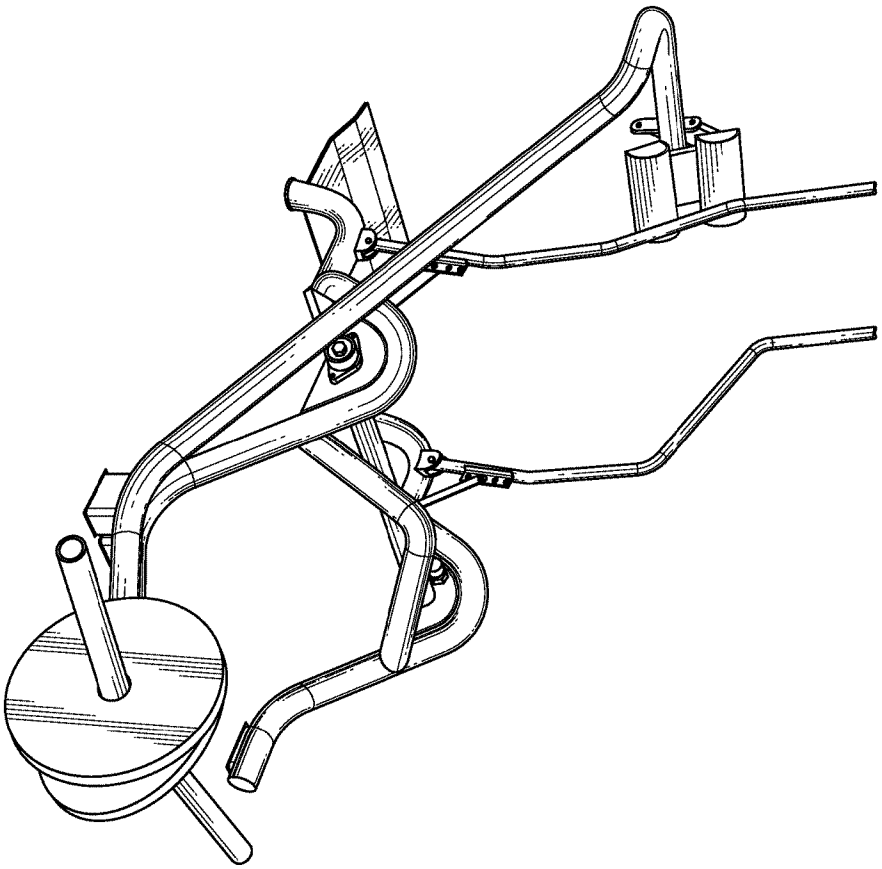
FIG. 31 is a third perspective photograph of an embodiment of the invention.
Figure 32:
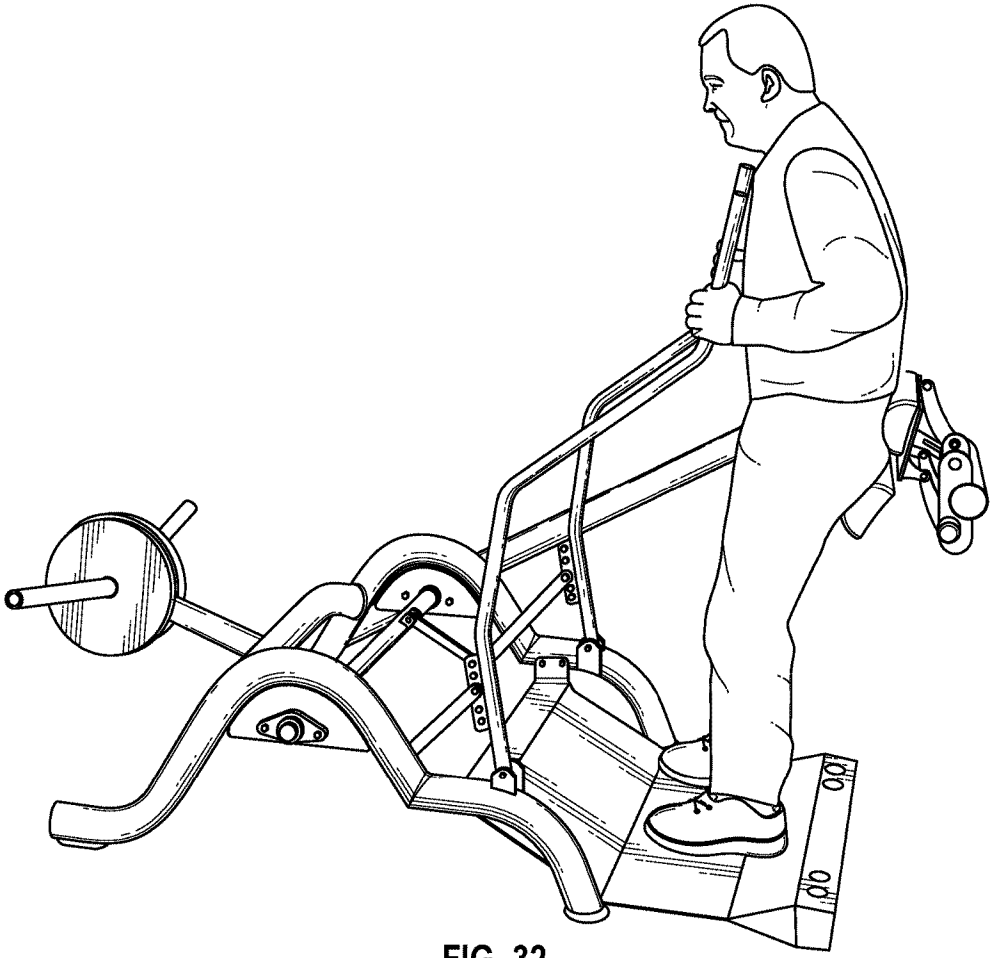
FIG. 32 is a fourth perspective photograph of an embodiment of the invention with a user in the standing position.

FIG. 24 is a photograph from the side showing a user U in the squatting position. FIG. 25 is a first photograph from the side showing a user U in the standing position. FIG. 26 is a second photograph from the side showing handles 34, 36 in more detail. FIG. 27 is a photograph from the front showing a user U in the standing position. FIG. 28 is a photograph from the front showing a user U in the squatting position. FIGS. 29 through 31 are perspective photographs of an embodiment of the invention. FIG. 32 is a perspective photograph showing a user U in the standing position.

Figure 33:
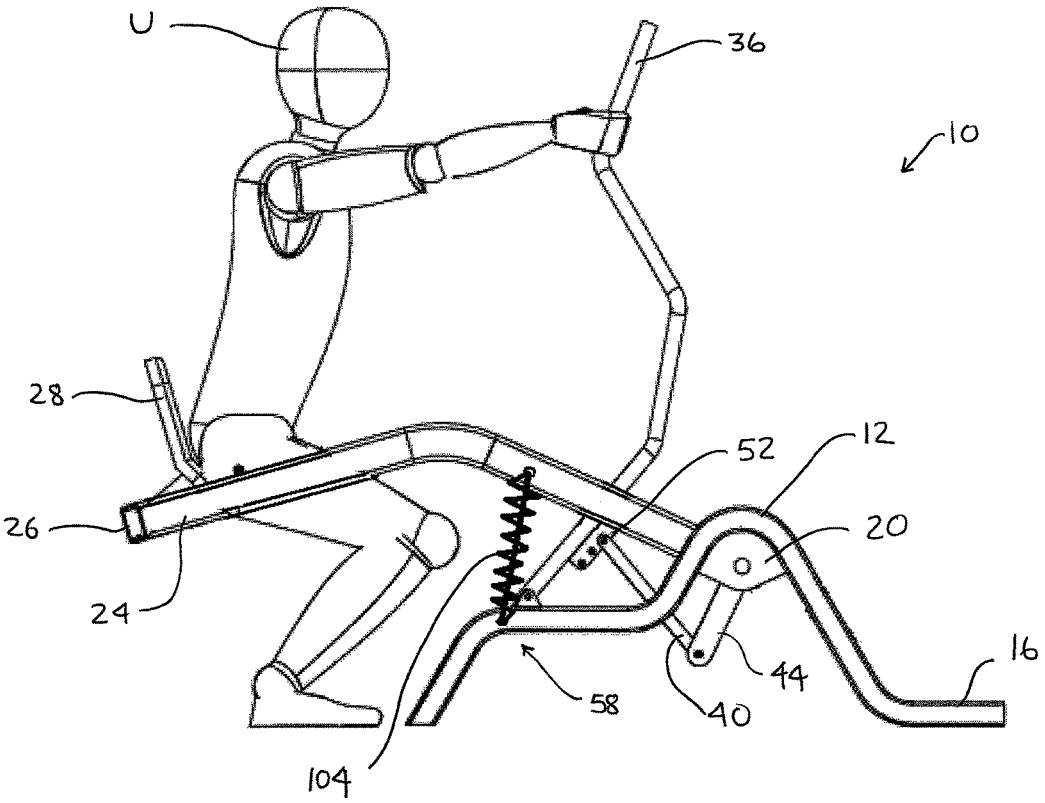
FIG. 33 is a schematic side view of a fifth embodiment of the invention showing a user in the squatting position.
Figure 34:
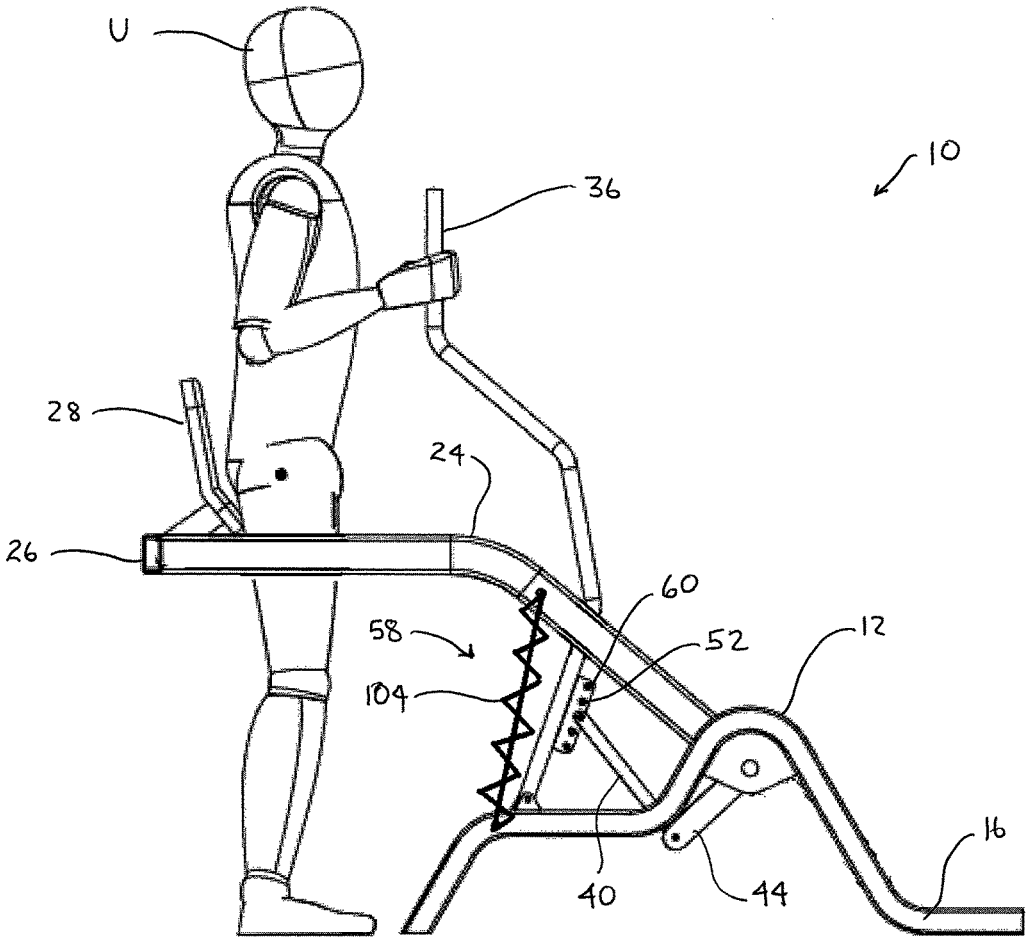
FIG. 34 is a schematic side view of a fifth embodiment of the invention showing a user in the standing position.

FIGS. 33 and 34 are schematic side views of a fifth alternate embodiment of the device 10 incorporating a spring 104 in place of counterweight 56. As can be seen, lever 24 can be shortened and need not extend opposite the fulcrum 12 from the user U. In this embodiment, additional support may be necessary to prevent the device 10 from tipping over due to all or a large portion of the weight of the user U and the lever 24 being on one side of the fulcrum 12. FIG. 33 shows a user U in the squatting position. In this embodiment, in place of counterweights 56, a spring 104, piston, or the like can be used. When squatting, spring 104 is in the compressed position. Such a spring 104, piston or the like can directly or operatively connect the lever 24 to the fulcrum 12, specifically as shown in this embodiment to base leg 16. This embodiment also can be more compact. FIG. 34 shows a user U in the standing position. When standing, spring 104 is in the uncompressed position and, while uncompressing, assists in moving lever 24 and thus glute pad 28 upwards. A piston, hydraulic, pneumatic, or otherwise, can be substituted for spring 104. Likewise, spring 104 or piston preferably is adjustable so as to mimic variable weights. Similar to other embodiments disclosed herein, handles 34, 36 can be used to assist the user U in compressing the spring by pushing and raising the glute pad 28 by pulling.

Figure 35:
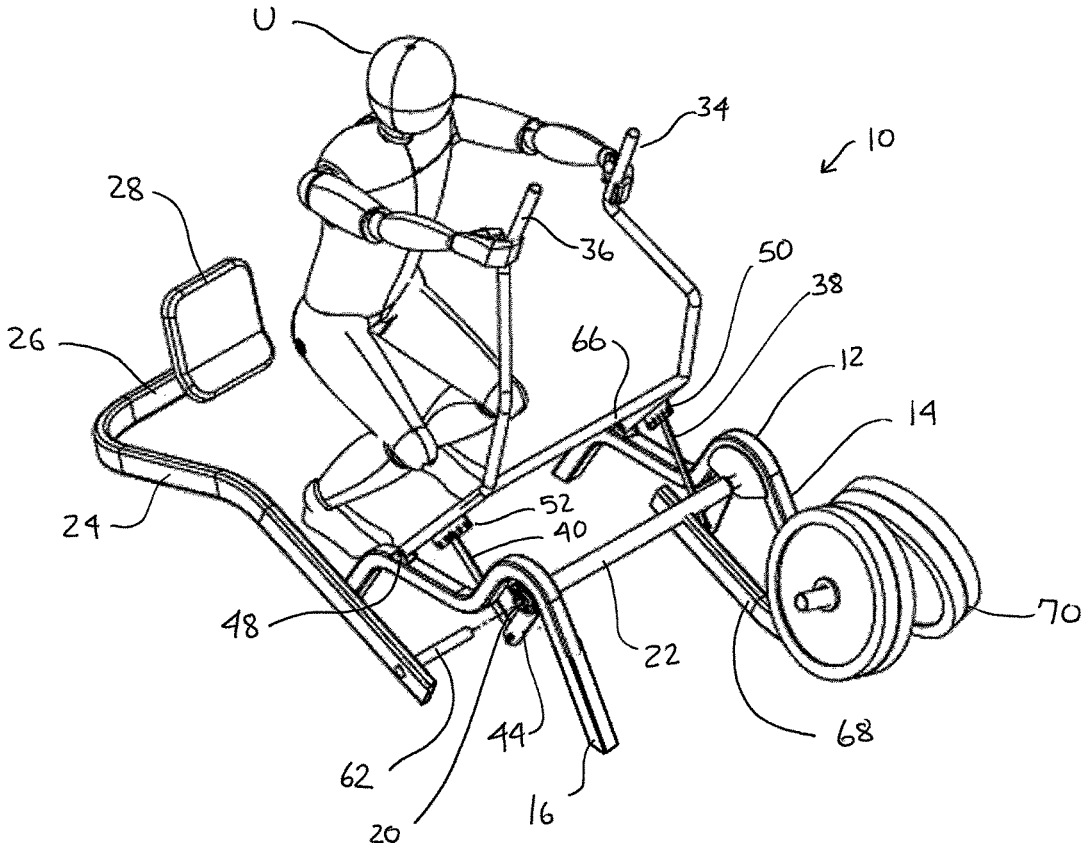
FIG. 35 is a schematic perspective view of a sixth alternate embodiment of the invention showing a user in the squatting position.
Figure 36:
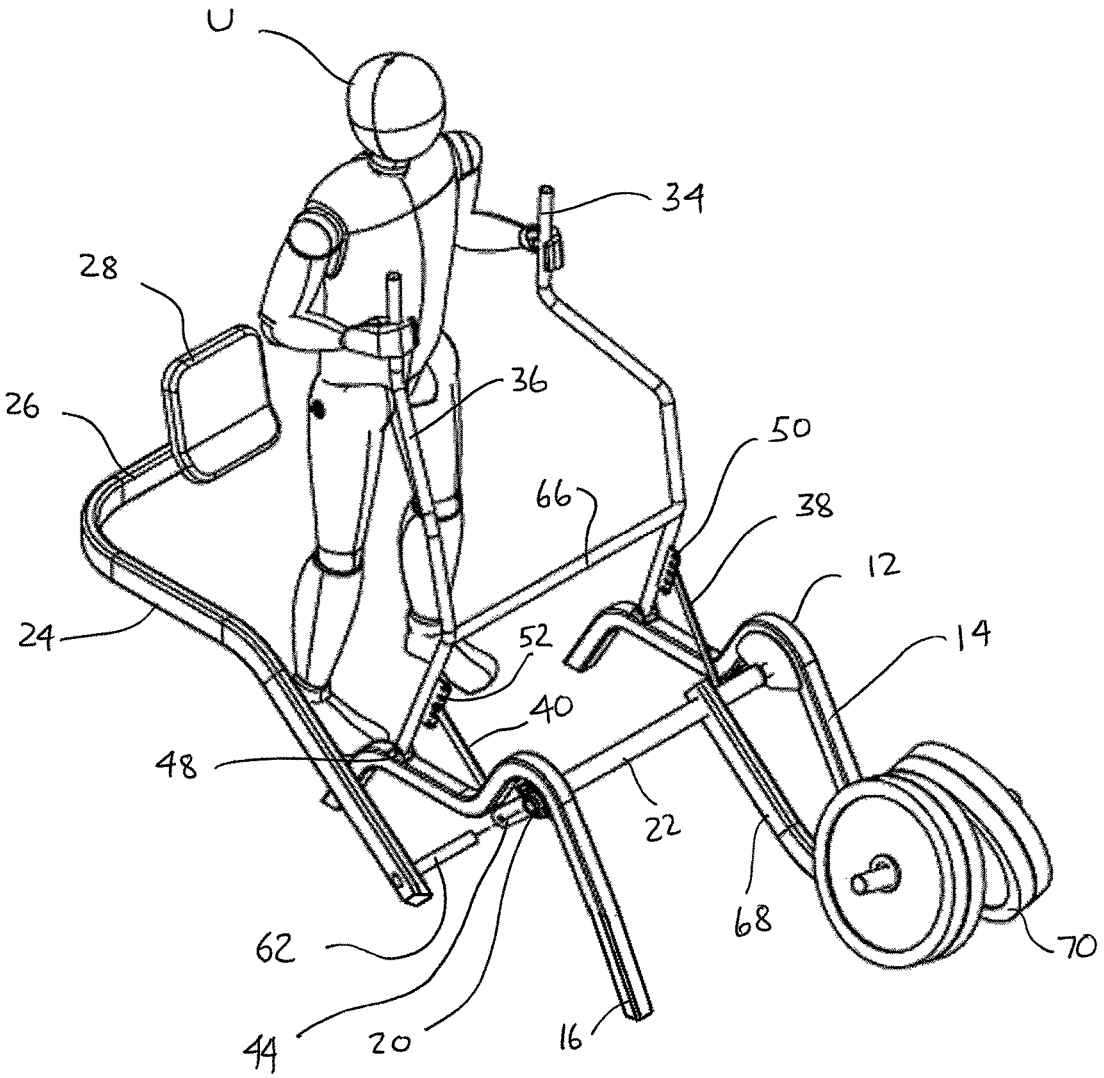
FIG. 36 is a schematic perspective view of a sixth alternate embodiment of the invention showing a user in the standing position.

FIG. 35 is a schematic perspective view of a sixth alternate embodiment of the device 10 showing a user U in the squatting position. FIG. 36 is a schematic perspective view of a sixth alternate embodiment of the device 10 showing a user U in the standing position. This embodiment is similar in structure and function as the device 10 shown in conjunction with FIGS. 14-17; however, in this sixth embodiment, lever 24 is shortened and does not extend frontwards from axle 22. This sixth alternate embodiment comprises connecting bar 66 between handles 34, 36 and a second counterweight arm 68 and a second set of counterweights 70. Further, in this sixth embodiment, counterweight arm 30 is eliminated, and only second counterweight arm 68 is present. Second counterweight arm 68 is attached to axle 22, extends forward away from user U, and as axle 22 rotates, second counterweight arm 68 rotates upwards and downwards as user U engages in the squatting exercise regimen.

FIG. 35 is a schematic perspective view of the sixth alternate embodiment of the device 10 showing a user U in the squatting position. FIG. 36 is a schematic perspective view of the sixth alternate embodiment of the device 10 showing a user U in the standing position. These embodiments employ weight plates as the weight resistance mechanism. The operation of this embodiment of the device 10 otherwise is similar to that disclose in conjunction with FIGS. 1-9.

Figure 37:
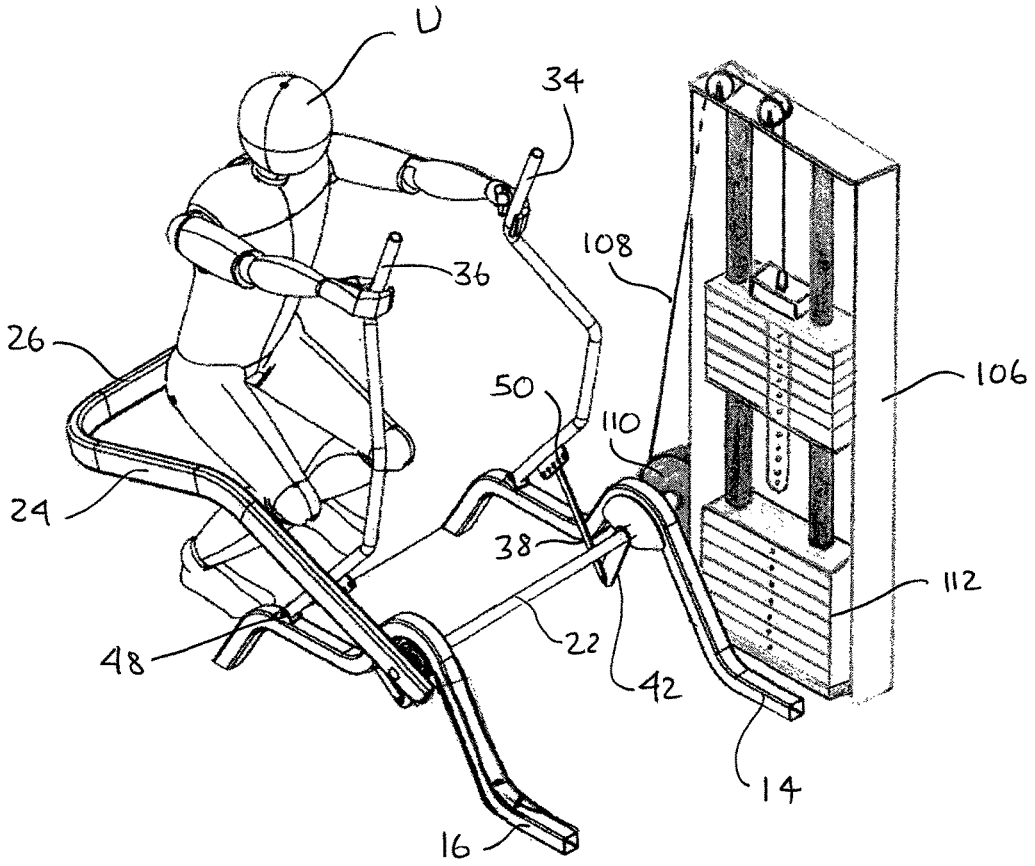
FIG. 37 is a schematic perspective view of a seventh alternate embodiment of the invention showing a user in the squatting position.
Figure 38:
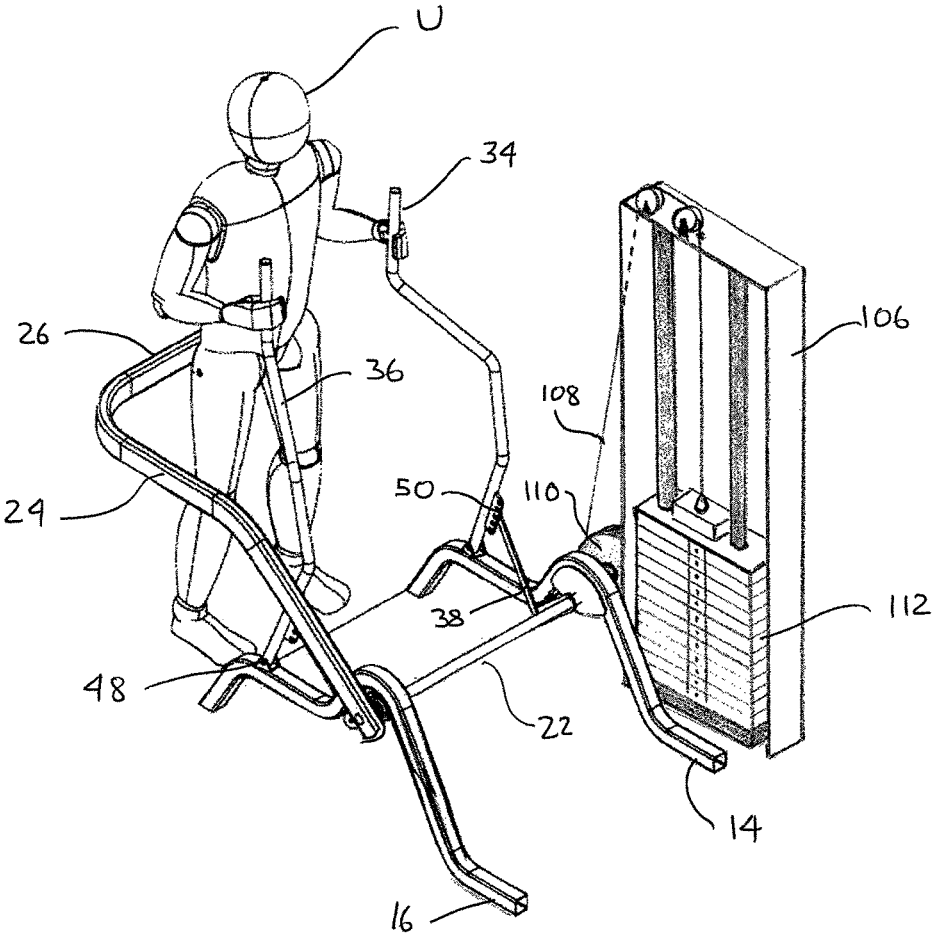
FIG. 38 is a schematic perspective view of a seventh alternate embodiment of the invention showing a user in the standing position.

FIG. 37 is a schematic perspective view of a seventh alternate embodiment of the device 10 showing a user U in the squatting position. FIG. 38 is a schematic perspective view of a seventh alternate embodiment of the device 10 showing a user U in the standing position. These embodiments employ a weight stack 106 as the weight resistance mechanism. Cable 108 connects weigh stack 106 to a cam 110. When handles 34, 36 are pushed, cam 110 rotates, winding cable 108 and thus lifting weights 112 in weight stack 106 and creating weight resistance against cable 108 in a conventional manner, which weight resistance is imparted to user U through handles 34, 36. The operation of this embodiment of the device 10 otherwise is similar to that disclose in conjunction with FIGS. 1-9.

Usage and Performance Characteristics:

The user U steps onto the squatting platform, namely base plate 76 in a standing position facing handles 34, 36. The user U then adjusts the glute pad 28 such that the glute pad 28 is in comfortable contact with the gluteus maximus muscles. The user U then grasps handles 34, 36 at a comfortable, approximately mid-chest, height.

To begin the exercise, the user U presses the handles 34, 36 in a forward arcing motion with their upper body while simultaneously pushing in a downward arcing motion with their gluteus maximus against the glute pad 28 thus performing a simultaneous pressing and squatting motion.

Thus, handles 34, 36 and glute pad 28 simultaneously impart a synchronized and unified common direction rotational force to the common resistance axle 22. The glute pad 28 is rigidly connected to the common resistance axle 22 via a rigid frame member, namely base legs 14, 16, and the handles 34, 36 are connected to the common resistance axle 22 via multi piece counter rotational linkages 38, 40, 42, 44. Therefore, both the glute pad 28 and handles 34, 36 impart a unified common direction rotational force against the common resistance axle 22.

If the common resistance axle 22 has resistance acting upon it that is less than the body weight of the user U when the user U is in the fully squatted and fully extended pressing position, the user U can then impart a pulling motion on the handles 34, 36 such that a vertical lifting force is imparted on the glute pad 28 to assist the user U back into the standing position.

If the common resistance axle 22 has resistance acting upon it that is equal to or greater than the body weight of the user U when the user U is in the fully squatted and fully extended pressing position, the counter resistance force acting upon the glute pad 28 and the handles 34, 36 will vertically lift the user U back to the standing position and return the handles 34, 36 to the starting and resting position without any assisted pulling from the user U on the handles 34, 36.

If the common resistance axle 22 has resistance acting upon it that is equal to or greater than the body weight of the user U when the user U is in the fully squatted and fully extended pressing position, the user U has the option of performing an additional type of exercise known as eccentric or negative resistance training. In this type of training the user U is resisting against the force of the counterweight 56 with their gluteus maximus and leg muscles against the glute pad 28 and their upper body against the handles 34, 36 to reduce and control the speed at which the resistive counterweight 56 is returning to the starting and resting position.

Drive or Actuating System:

The mechanisms disclosed also can be used as a drive or actuating system for a variety of exercise machines comprising means for allowing a user's upper body and lower body to work simultaneously in a synchronized and unified fashion. In these types of machines, either the upper or lower body may be pushing or pulling to cause the user to leverage their body such that a combination of muscle groups are working simultaneously against a common force or resistance mechanism. In these types of machines, the user may or may not be supported by a seat or support member. For example, as shown herein, the user is in either a standing position or is bracing his or her feet against a stationary member connected to the frame of the machine, or with the user's feet pressing against a portion of the frame of the machine. This structure can allow the user to brace his or her lower body to leverage themselves against the resistance. The system also can comprise a seat, but allow the user to place his or her feet on a stationary platform or the ground as well as standing and supporting their weight such that the user is leveraging his or her upper and lower body to act upon the common resistance.

Various alternatives are suitable for the present invention. For example, the counterweight can comprise weight stacks, springs, pistons, resistance mechanisms, brake-clutch mechanisms, moment arms, and etcetera. The pivoting linkages from the handles to the axle may comprise ball joint end rods such that the pressing and pulling motion can be converging and diverging, that is, when pressing the handles converge and when pulling the handles diverge. The device can have a pin for limiting the range of motion of the exercise. Such a pin can be located on the axle at the end proximal to the weight arm and can limit the distance the user can squat. The handles can be on a linear travel mechanism instead of a pivoting arm. With such an alternative, the user can combine the linear press motion with the arcing glute pads or combine it with the linear glute pad vertical movement.

Figure 39:
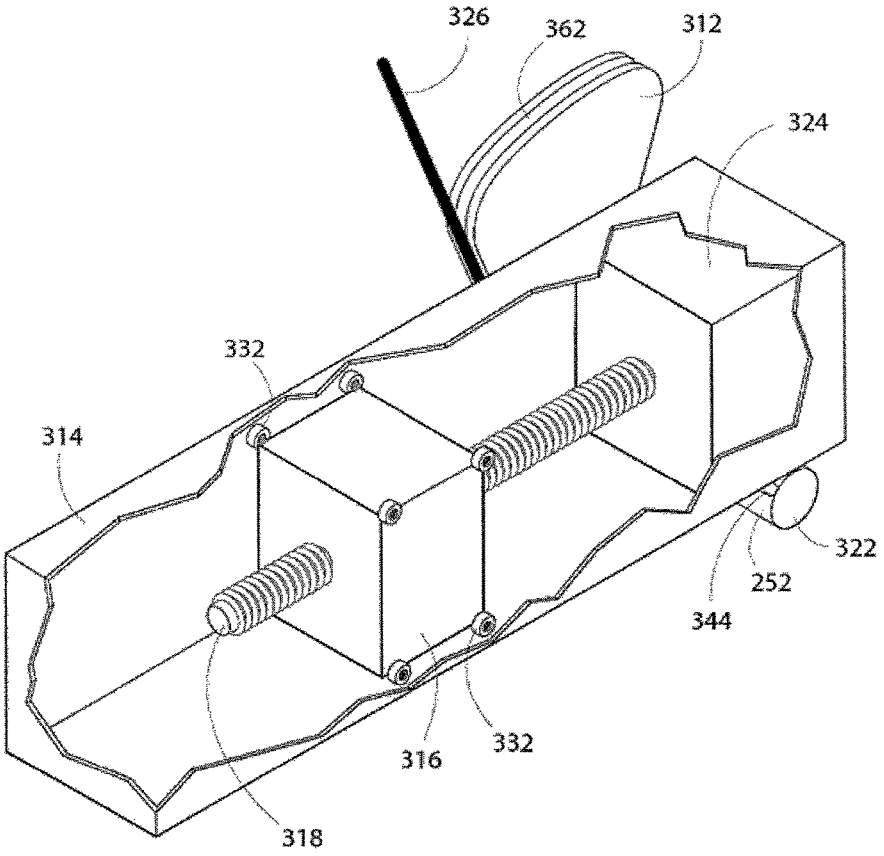
FIG. 39 is a sectional perspective view of an embodiment of the moment arm weight resistance mechanism of the invention.
Figure 40:
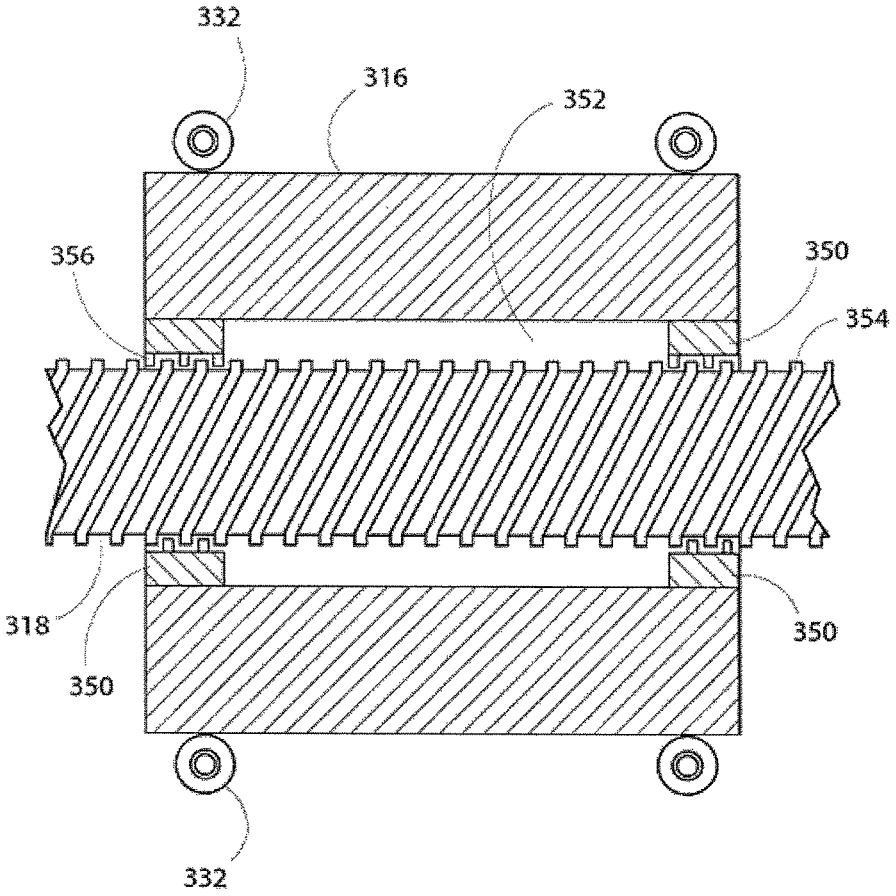
FIG. 40 is a sectional side view of a weight and weight adjusting drive that can be used with the invention.

FIGS. 39-63 represent additional general embodiments of the present invention. FIG. 39 is a sectional perspective view of an embodiment of a moment arm weight resistance mechanism that can be used in the invention showing basic working elements of the invention in a closed box configuration. FIG. 40 is a sectional side view of a weight and weight adjusting drive that can be used with the invention, corresponding with the weight and weight adjusting drive shown in FIG. 39.

Figure 41:
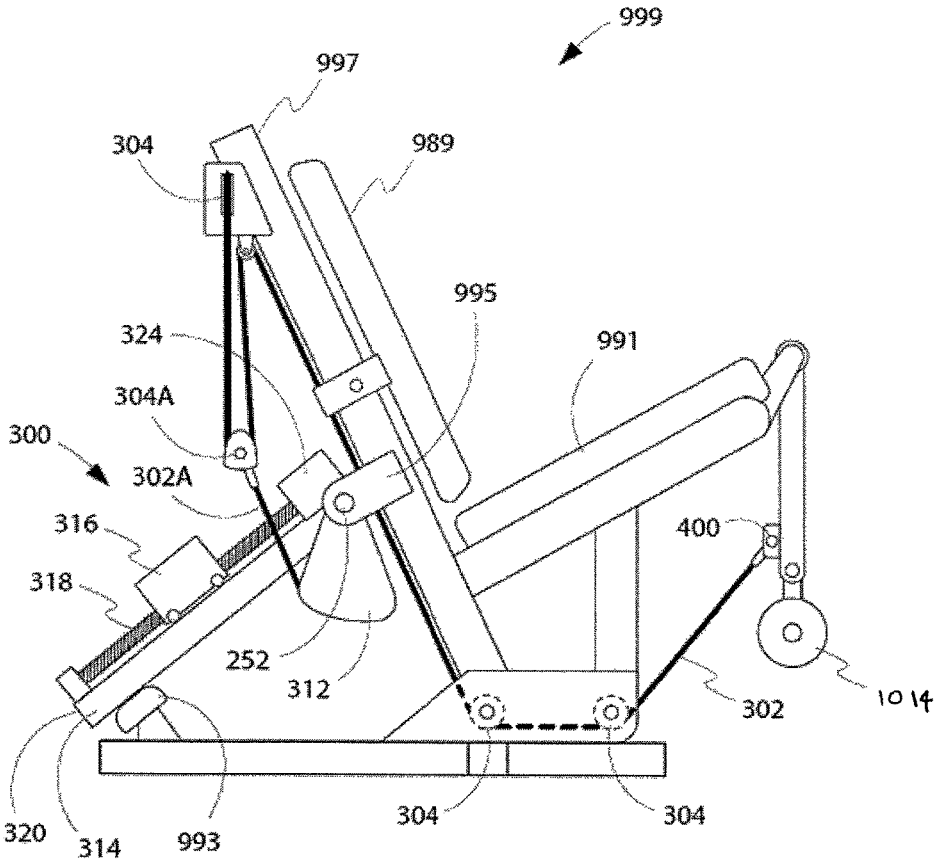
FIG. 41 is a side view of a single function weight training machine comprising an embodiment of the moment arm weight resistance mechanism of the present invention in the resting mode.
Figure 42:
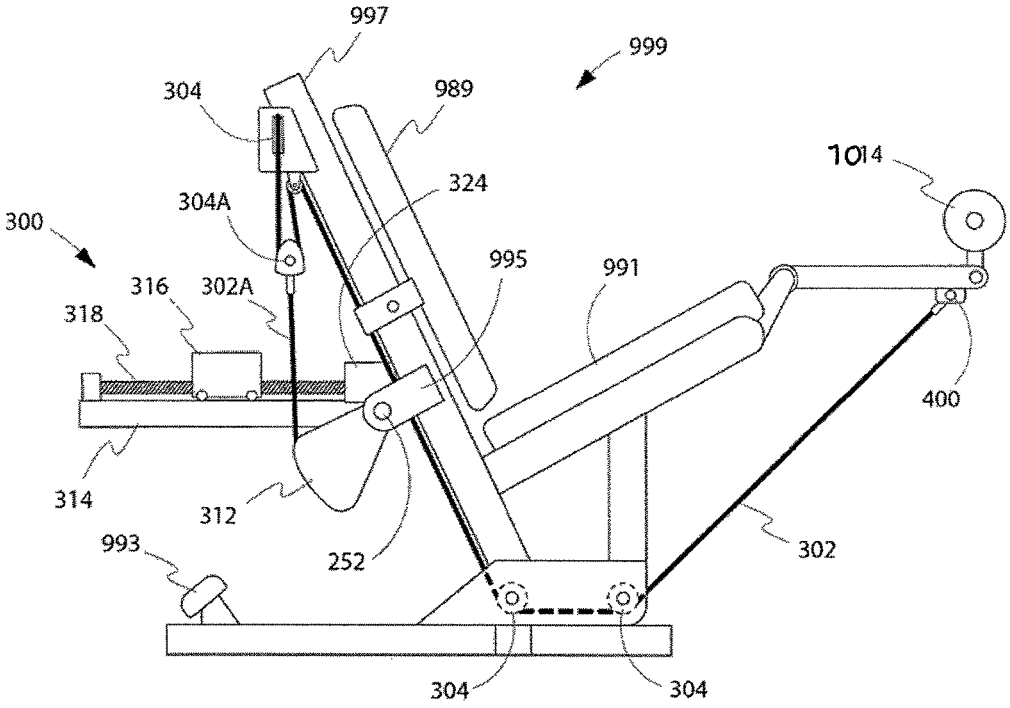
FIG. 42 is a side view of the weight training machine shown in FIG. 41 comprising an embodiment of the moment arm weight resistance mechanism of the present invention in the operating mode.
Figure 43:
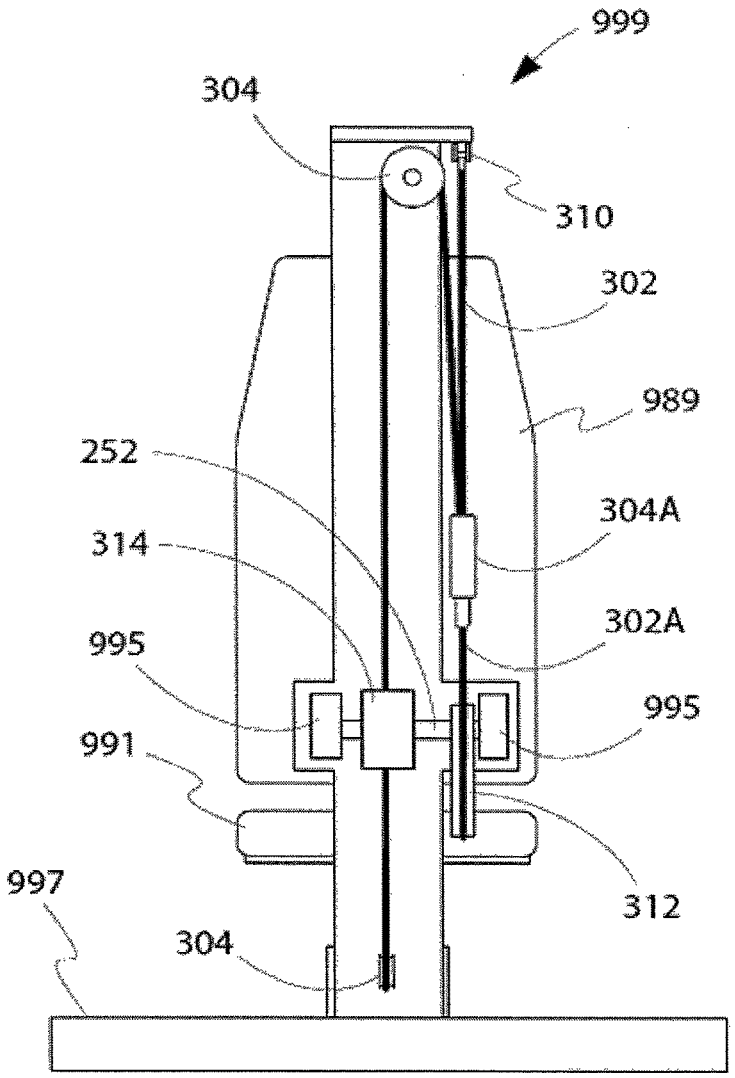
FIG. 43 is a rear view of the weight training machine shown in FIG. 41 comprising an embodiment of the moment arm weight resistance mechanism of the present invention.

FIG. 41 is a side view of an eighth representative weight training machine comprising an embodiment of a moment arm weight resistance mechanism in the resting mode, that is, with the user U at rest. This weight training machine is a leg extension quadriceps machine. FIG. 42 is a side view of the weight training machine shown in FIG. 41 comprising an embodiment of a moment arm weight resistance mechanism in the operating mode, that is, with the user lifting weight. FIG. 43 is a rear view of the weight training machine shown in FIG. 41 comprising an embodiment of the moment arm weight resistance mechanism.

Figure 44:
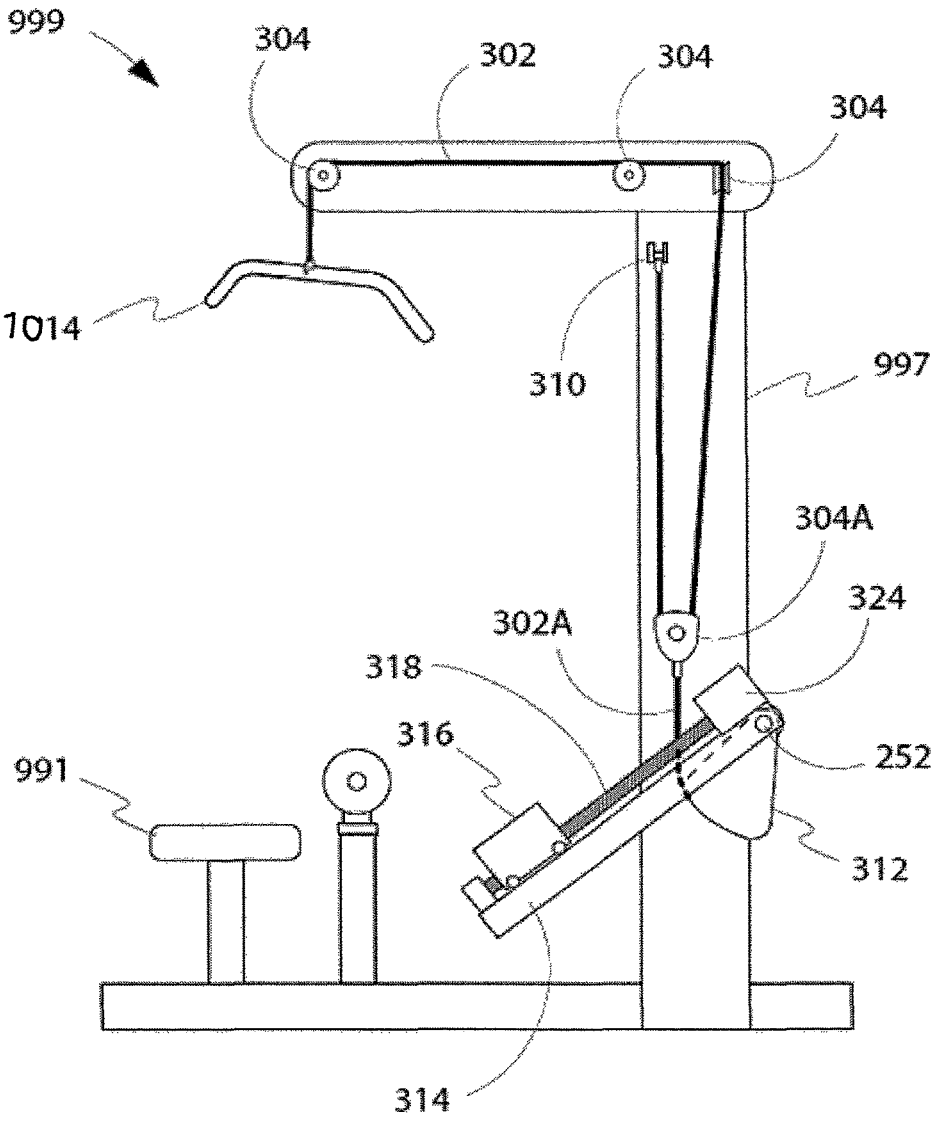
FIG. 44 is a side view of a single function weight training machine comprising an embodiment of the moment arm weight resistance mechanism of the present invention in the resting mode.
Figure 45:
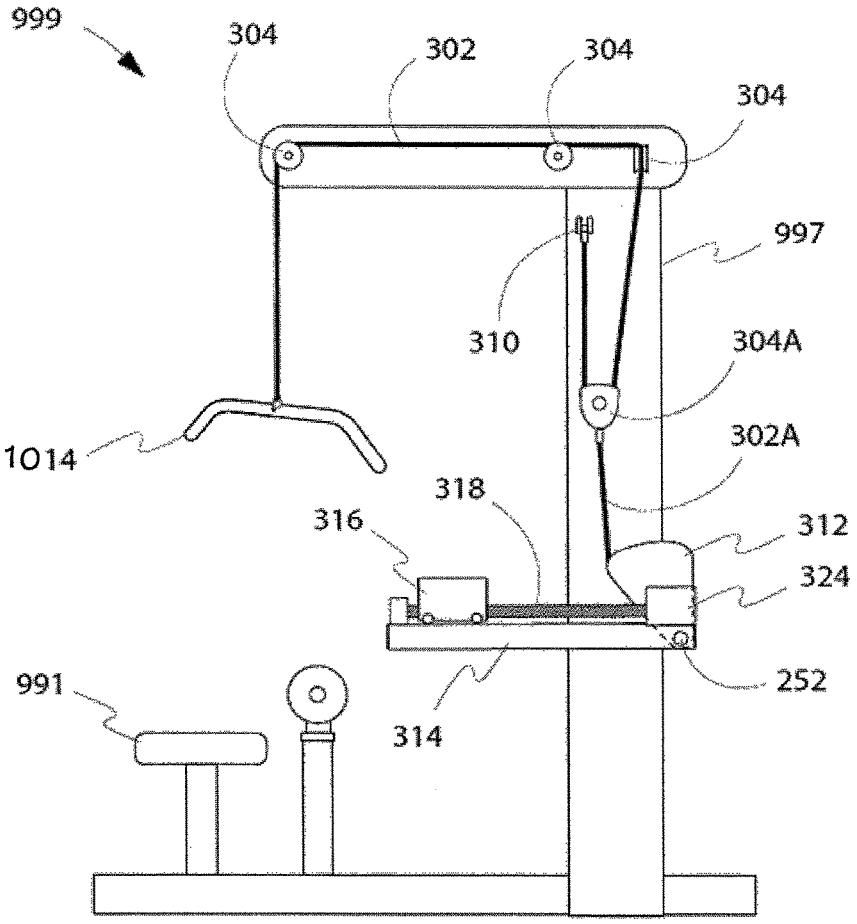
FIG. 45 is a side view of a weight training machine shown in FIG. 44 comprising an embodiment of the moment arm weight resistance mechanism of the present invention in the operating mode.

FIG. 44 is a side view of a ninth representative weight training machine comprising a moment arm weight resistance mechanism in the resting mode, that is, with the user U at rest. This machine is a latissimus dorsi pull-down machine. FIG. 45 is a side view of the weight training machine shown in FIG. 44 comprising a moment arm weight resistance mechanism in the operating mode, that is, with the user U lifting weight.

Figure 46:
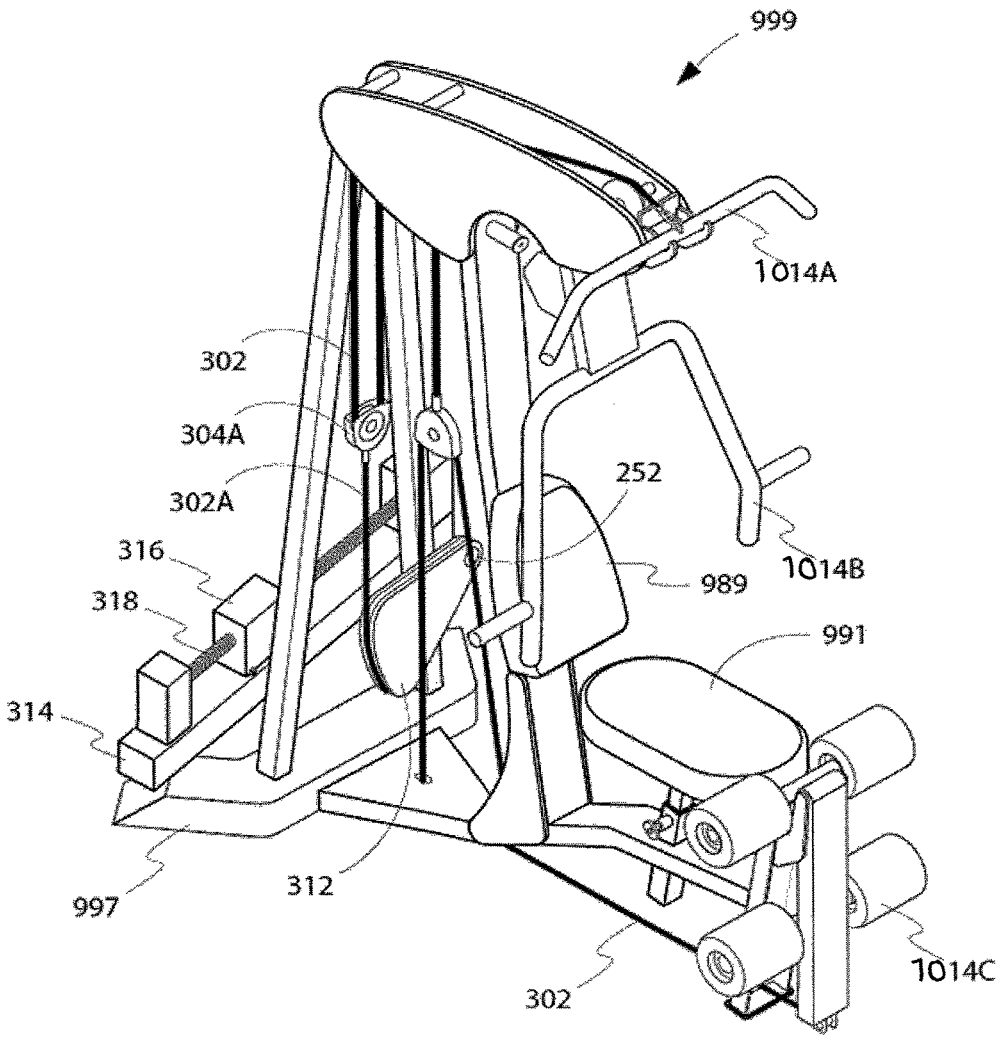
FIG. 46 is a perspective view of a multi-function weight training machine comprising an embodiment of the moment arm weight resistance mechanism of the present invention in the resting mode.
Figure 47:
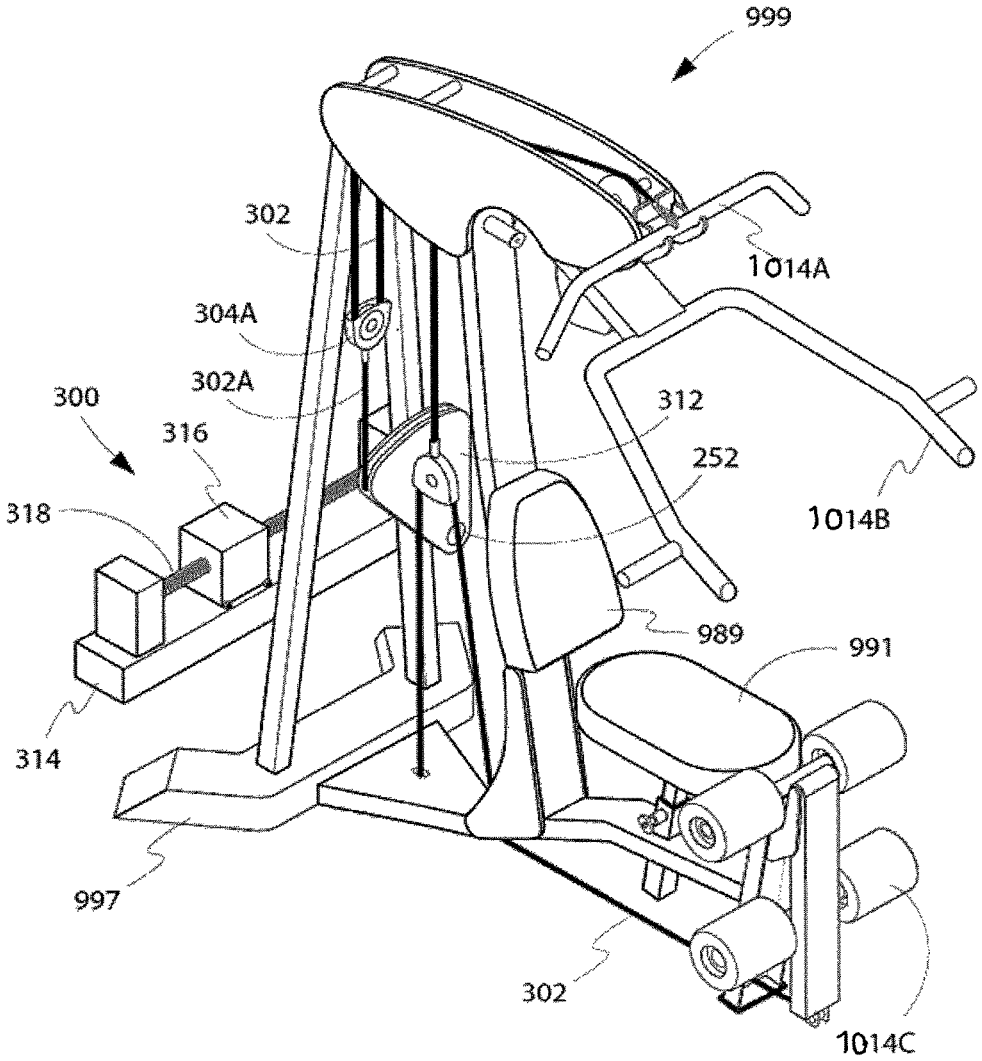
FIG. 47 is a perspective view of the weight training machine shown in FIG. 46 comprising an embodiment of the moment arm weight resistance mechanism of the present invention in the operating mode.
Figure 48:
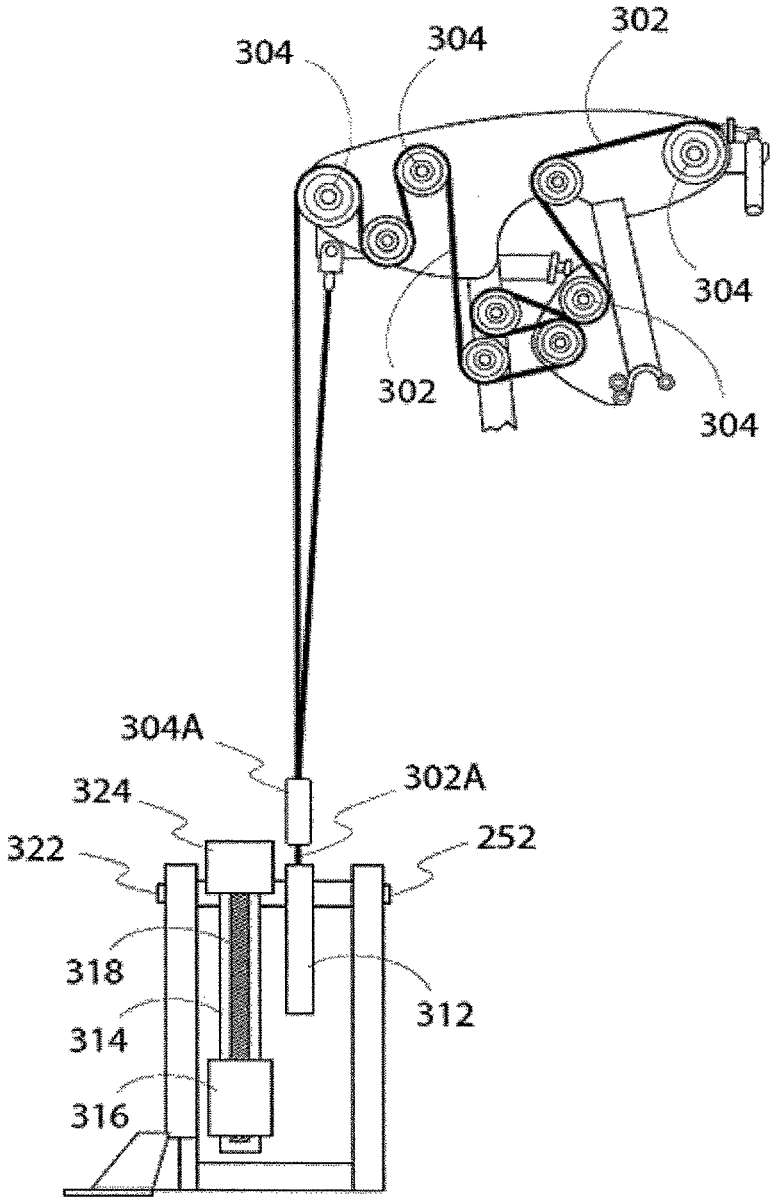
FIG. 48 is a side view of an embodiment of a cable and pulley configuration for a weight training machine comprising an embodiment of the moment arm weight resistance mechanism of the present invention.

FIG. 46 is a perspective view of a tenth representative weight training machine comprising a moment arm weight resistance mechanism in the resting mode, that is, with the user U at rest. This weight training machine is a multi-station or multi-function combination weight training machine for exercising all major muscle groups. FIG. 47 is a perspective view of the weight training machine shown in FIG. 46 comprising a moment arm weight resistance mechanism in the operating mode, that is with the user U lifting weight. FIG. 48 is a side view of an embodiment of a cable and pulley configuration for a combination weight training machine comprising a moment arm weight resistance mechanism.

Figure 49:
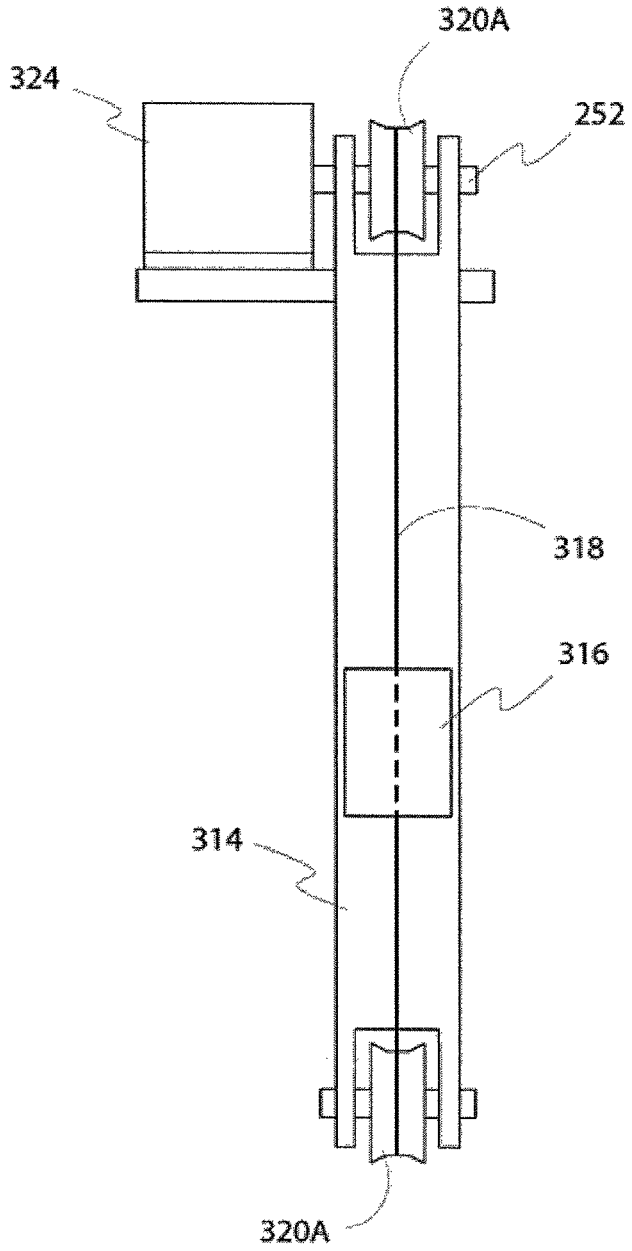
FIG. 49 is a top view of an alternate embodiment of the moment arm weight resistance mechanism of the invention.
Figure 50:
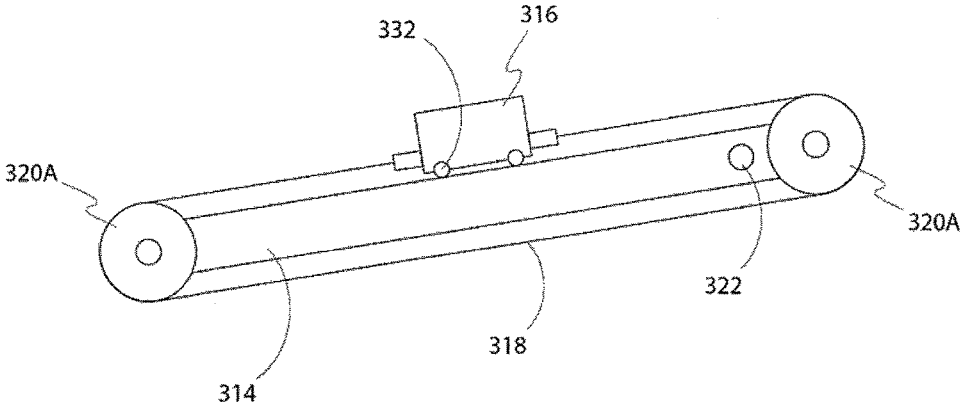
FIG. 50 is a side view of the alternate embodiment of the moment arm weight resistance mechanism shown in FIG. 49.
Figure 51:
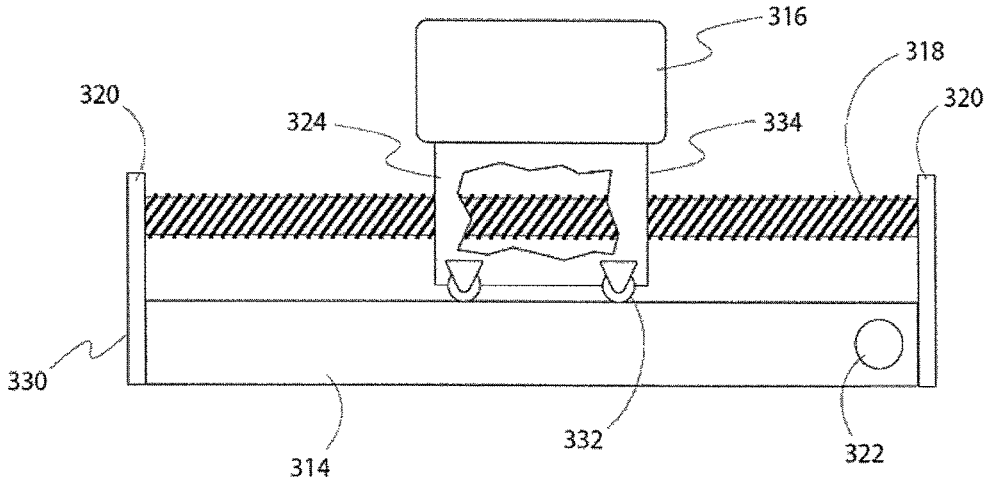
FIG. 51 is a side view of another alternate embodiment of the moment arm weight resistance mechanism of the invention.

FIG. 49 is a top view of an alternate embodiment of a moment arm weight resistance mechanism that can be used in the invention. FIG. 50 is a side view of the alternate embodiment of the moment arm weight resistance mechanism shown in FIG. 49. FIG. 51 is a side view of another alternate embodiment of the moment arm weight resistance mechanism that can be used in the invention.

Figure 52:
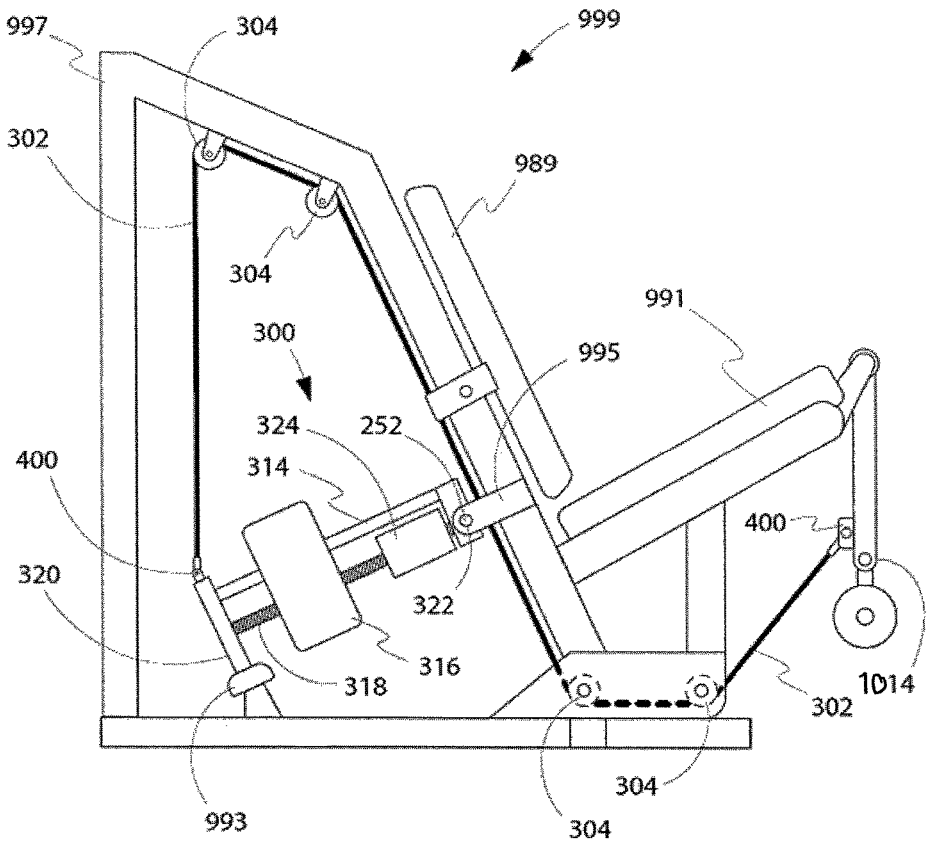
FIG. 52 is a side view of another weight training machine comprising an embodiment of the moment arm weight resistance mechanism of the present invention in the resting mode.
Figure 53:
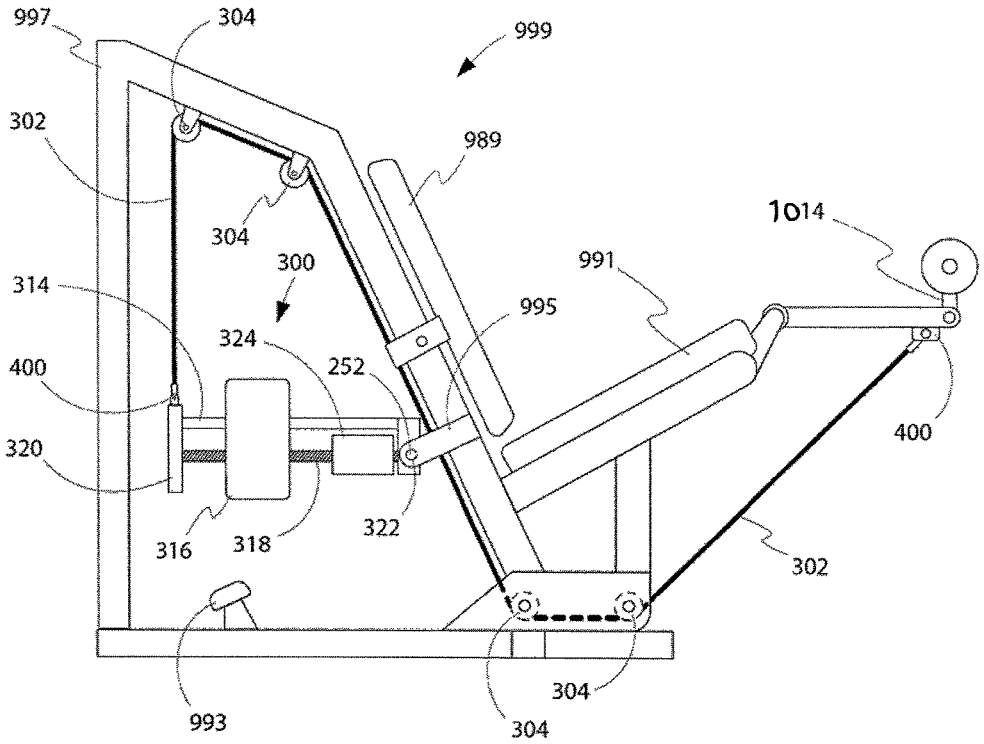
FIG. 53 is a side view of the weight training machine shown in FIG. 52 comprising an embodiment of the moment arm weight resistance mechanism of the present invention in the operating mode.

FIG. 52 is a side view of a eleventh representative embodiment of a weight training machine comprising a moment arm weight resistance mechanism in the resting mode, that is, with the user U at rest. This machine is a leg extension machine without a cam. FIG. 53 is a side view of the weight training machine shown in FIG. 52 comprising a moment arm weight resistance mechanism in the operating mode, that is, with the user U lifting weight.

Figure 54:
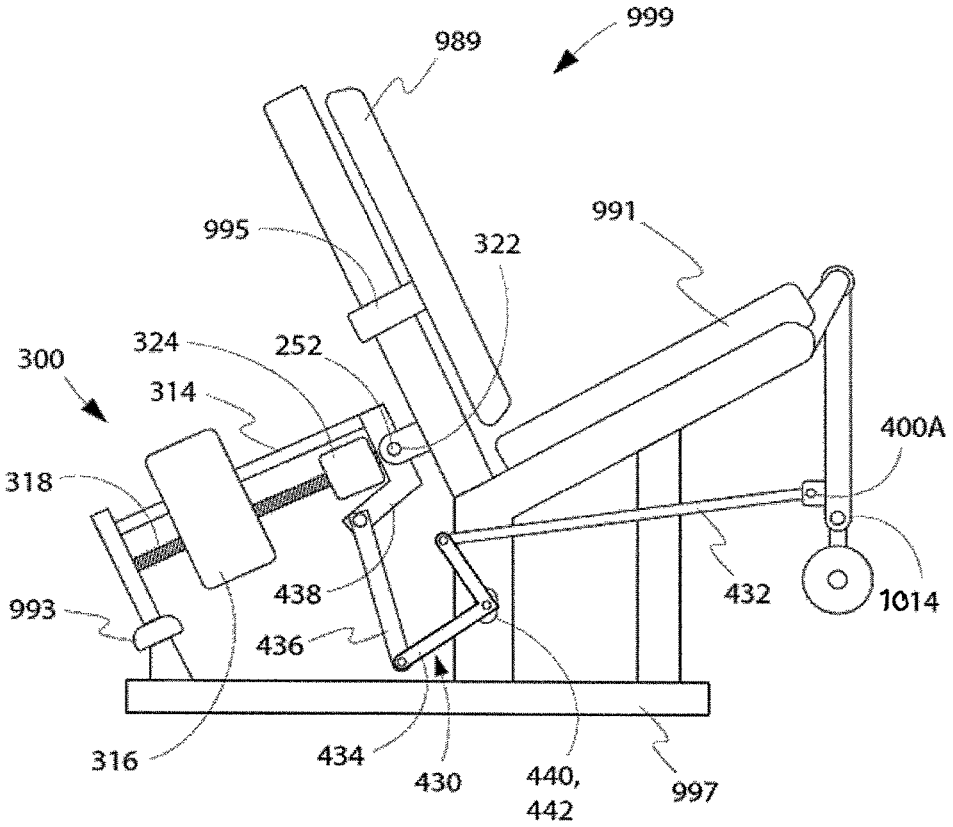
FIG. 54 is a side view of another weight training machine comprising an embodiment of the moment arm weight resistance mechanism of the present invention in the resting mode.
Figure 55:
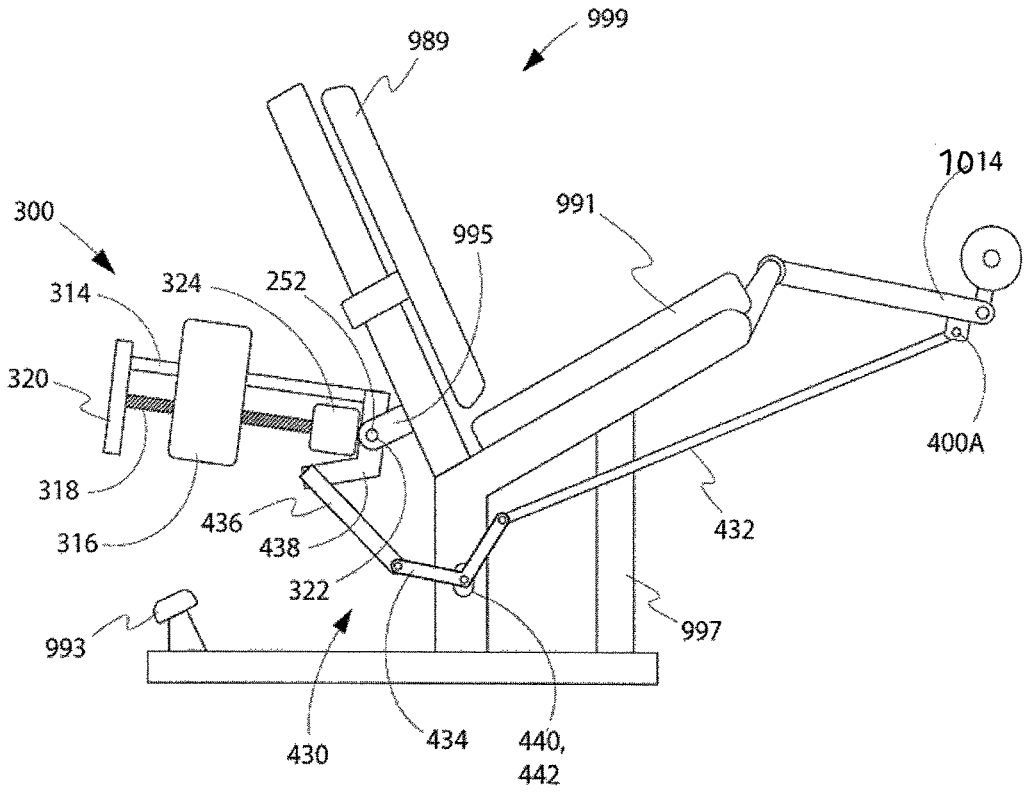
FIG. 55 is a side view of the weight training machine shown in FIG. 54 comprising an embodiment of the moment arm weight resistance mechanism of the present invention in the operating mode.

FIG. 54 is a side view of a twelfth representative embodiment of a weight training machine comprising a moment arm weight resistance mechanism in the resting mode, that is, with the user U at rest. This machine is a leg extension machine with a bar linkage. FIG. 55 is a side view of the weight training machine shown in FIG. 54 comprising a moment arm weight resistance mechanism in the operating mode, that is, with the user U lifting weight.

Figure 56:
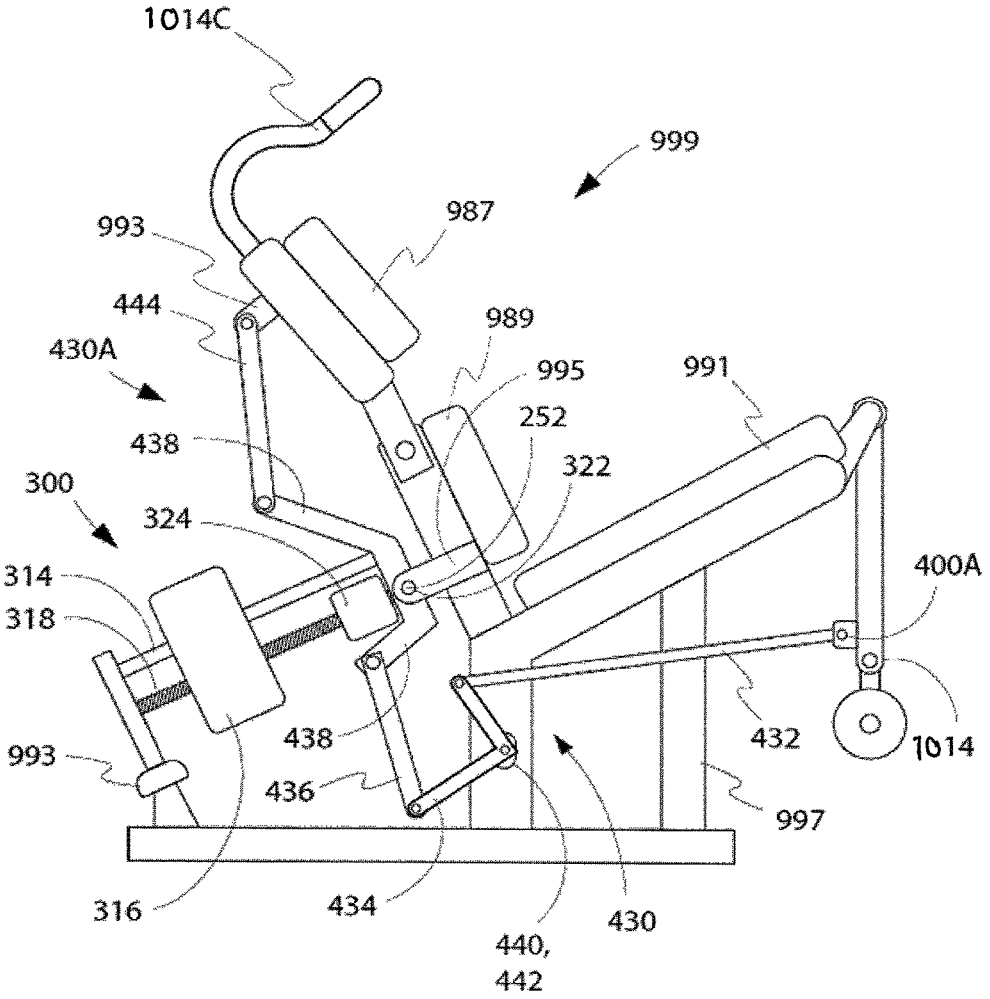
FIG. 56 is a side view of another weight training machine comprising an embodiment of the moment arm weight resistance mechanism of the present invention in the resting mode.
Figure 57:
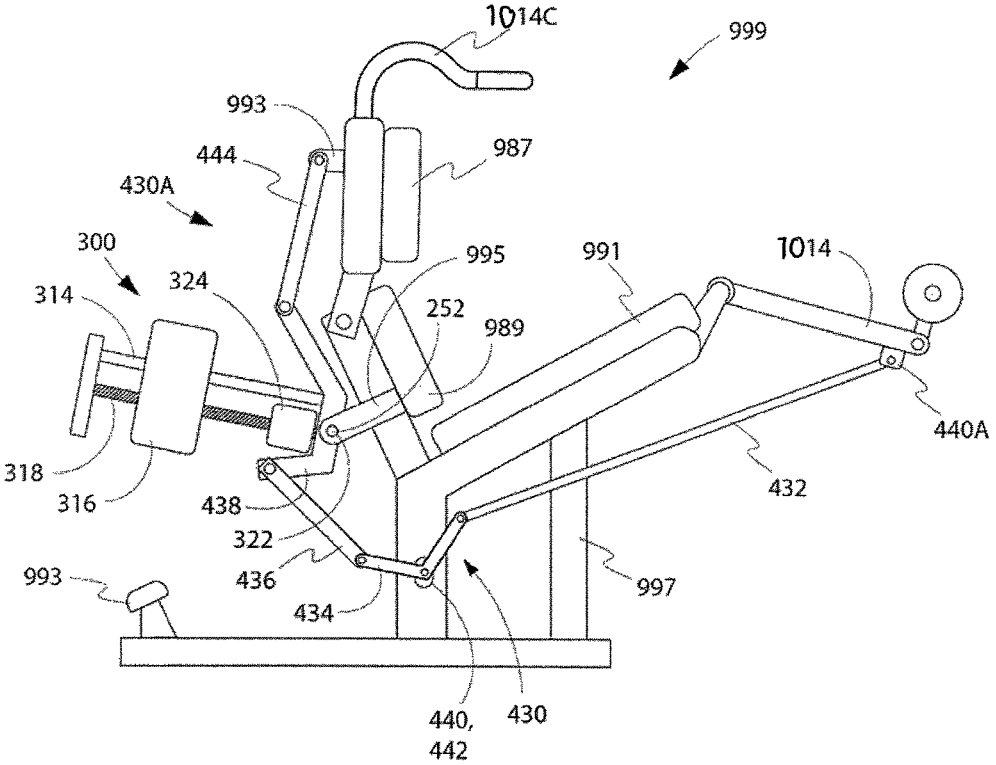
FIG. 57 is a side view of the weight training machine shown in FIG. 56 comprising an embodiment of the moment arm weight resistance mechanism of the present invention in the operating mode.

FIG. 56 is a side view of a thirteenth representative embodiment of a weight training machine comprising a moment arm weight resistance mechanism in the resting mode, that is, with the user U at rest. This machine is a combination leg extension and torso rotational crunch machine with a bar linkage. FIG. 57 is a side view of the weight training machine shown in FIG. 56 comprising a moment arm weight resistance mechanism in the operating mode, that is, with the user U lifting a weight.

Figure 58:
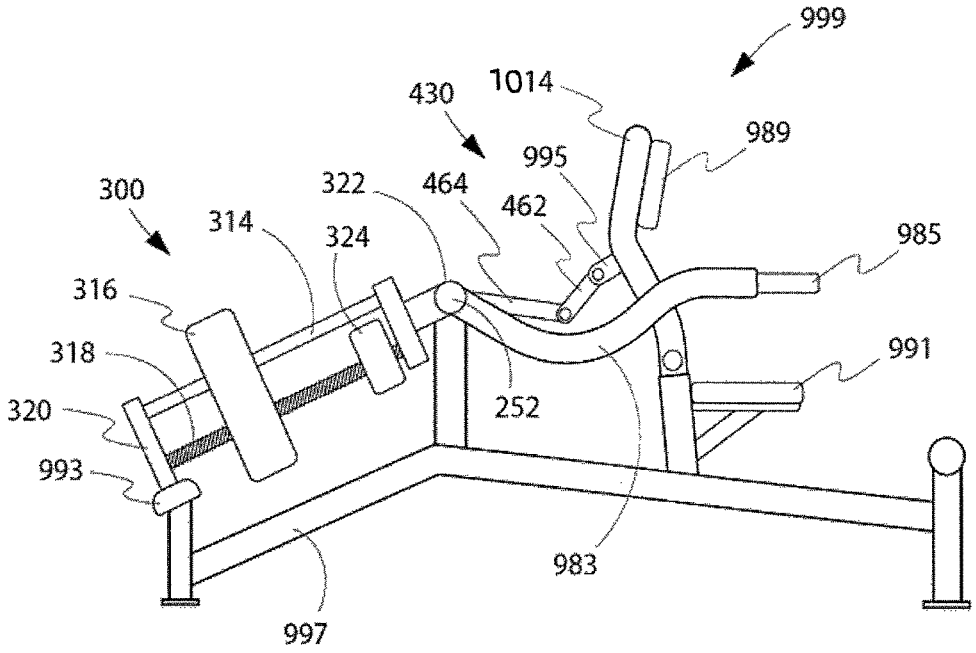
FIG. 58 is a side view of another weight training machine comprising additional embodiments of the moment arm weight resistance mechanism of the present invention in the resting mode.
Figure 59:
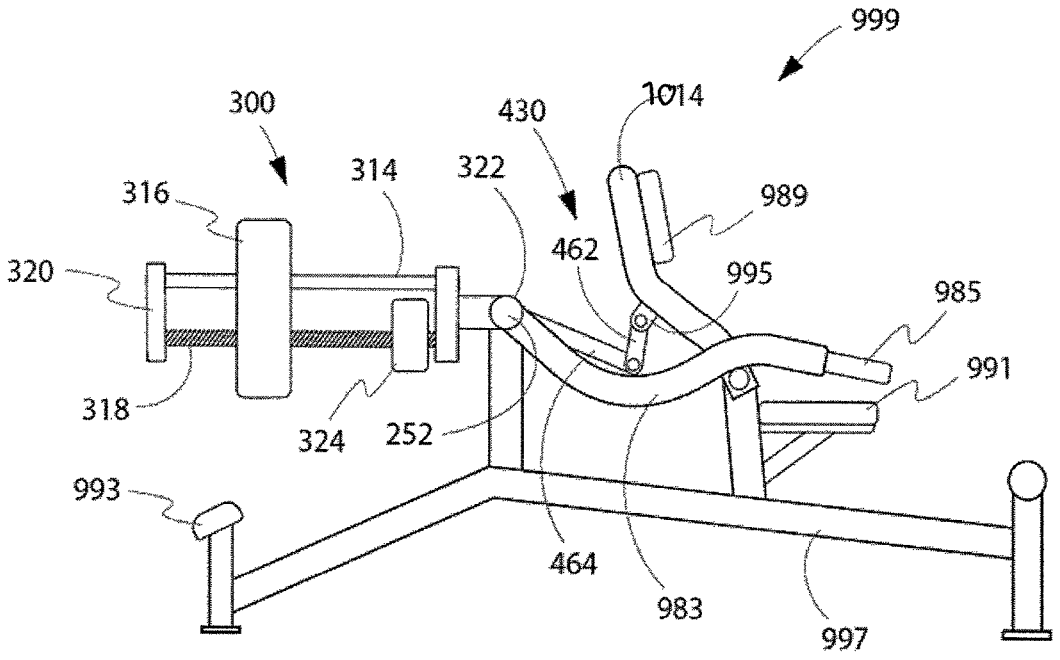
FIG. 59 is a side view of the weight training machine shown in FIG. 58 comprising additional embodiments of the moment arm weight resistance mechanism of the present invention in the operating mode.

FIG. 58 is a side view of a fourteenth representative embodiment of a weight training machine comprising additional embodiments of a moment arm weight resistance mechanism in the resting mode, that is, with the user U at rest. This machine is a combination lower back and triceps press machine with a bar linkage. FIG. 59 is a side view of the weight training machine shown in FIG. 58 comprising additional embodiments of the moment arm weight resistance mechanism in the operating mode, that is, with the user U lifting weight.

Figure 60:
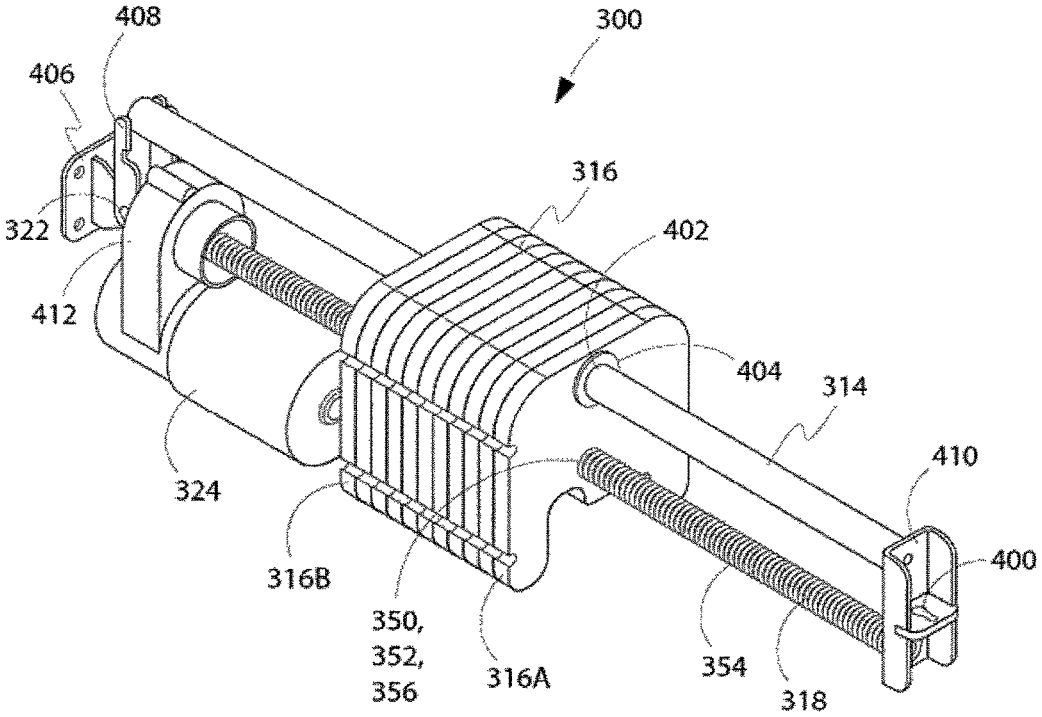
FIG. 60 is a first perspective view of an alternate embodiment of the moment arm weight resistance mechanism of the invention.
Figure 61:
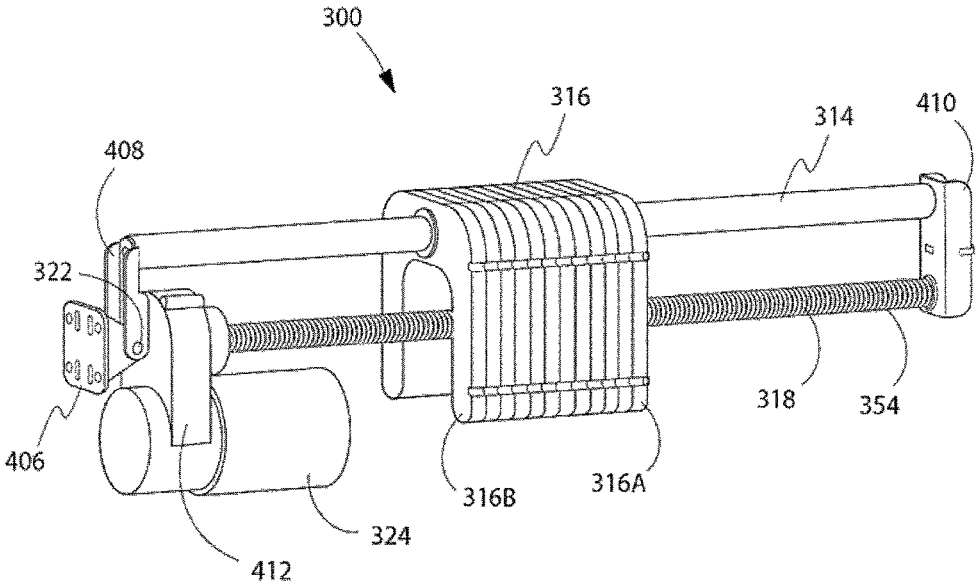
FIG. 61 is a second perspective view of the alternate embodiment of the moment arm weight resistance mechanism shown in FIG. 60.

FIG. 60 is a first perspective view of an alternate embodiment of a moment arm weight resistance mechanism that can be used in the invention. FIG. 61 is a second perspective view of the alternate embodiment of the moment arm weight resistance mechanism shown in FIG. 60. FIGS. 60 and 61 illustrate a generally solid, elongated structure supporting the weight and the weight adjusting drive.

Figure 62:
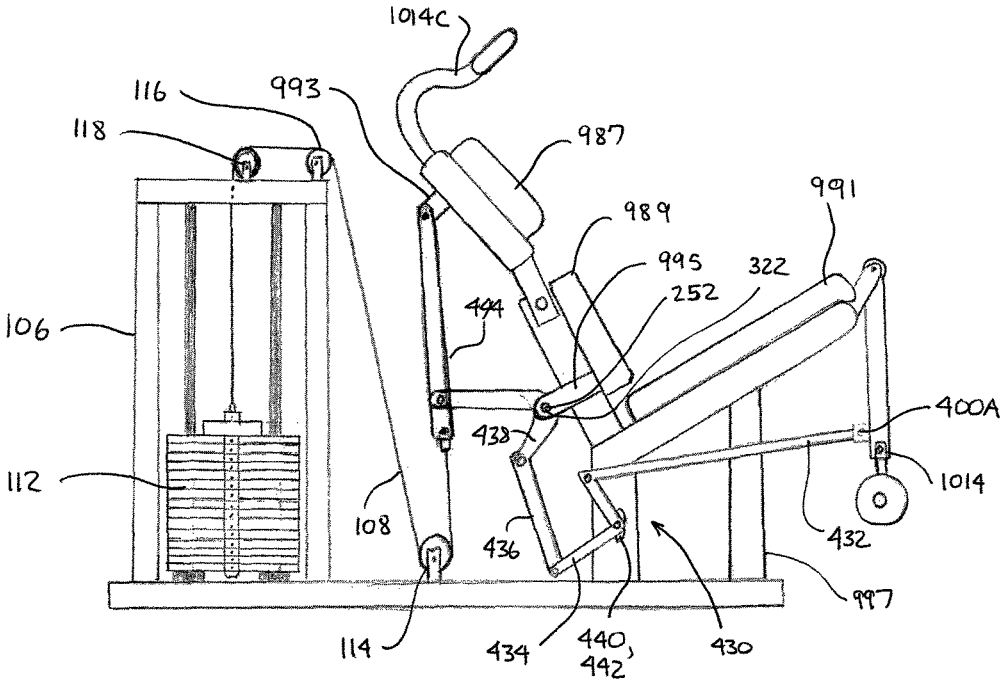
FIG. 62 is a side view of the weight training machine as shown in FIG. 56 comprising a weight stack weight resistance mechanism in the resting mode.
Figure 63:
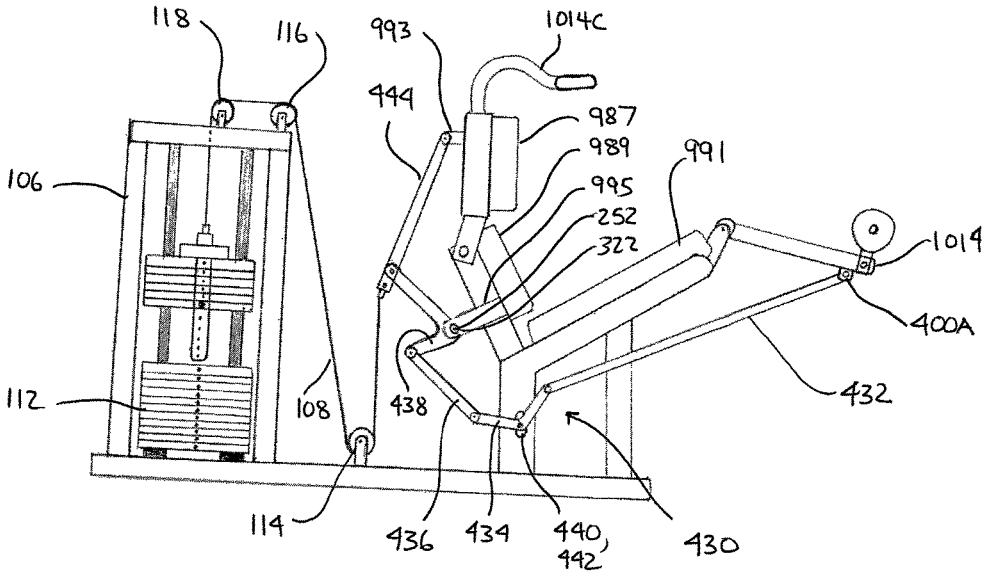
FIG. 63 is a side view of the weight training machine shown in FIG. 62 comprising a weight stack weight resistance mechanism in the operating mode.

FIGS. 62 and 63 are side views of the weight training machine as shown in FIG. 18 comprising a weight stack 106 weight resistance mechanism as an alternate embodiment. FIG. 62 is the machine in the resting mode and FIG. 63 is the machine in the operating mode.

FIG. 39 is a sectional perspective view of a representative embodiment of a moment arm weight resistance mechanism 300 showing basic working elements of the mechanism. This embodiment of moment arm weight resistance mechanism 300 comprises cam 312, moment arm 314, weight 316, weight adjusting drive 318, pivot point 322, and weight adjusting motor 324. Moment arm 314 is pivotally secured about pivot point 322, about which the moment is created, and extends generally normal to the pivot axis of pivot point 322. Thus, moment arm 314 acts as a cantilever extending from pivot point 322, and moment arm 314 can rotate about the pivot axis of pivot point 322. In this embodiment, moment arm 314 is a generally box-like structure in which weight 316 can roll and can be termed a closed arm embodiment.

FIG. 39 also illustrates that, in this embodiment, moment arm 314 is a generally hollow, elongated, box-like structure containing weight 316 and weight adjusting drive 318. Weight adjusting motor 324 also is shown within moment arm 314, but can be located outside of the box-like structure with weight adjusting drive 318 extending from weight adjusting motor 324 through a hole in an end of, and into the interior of, the box-like structure of moment arm 314. Moment arm 314 is illustratively shown as being welded onto moment arm pivot rod 252 by weldments 344, but moment arm 314 can be secured to moment arm pivot rod 252 by any known or suitable means. Pivot rod 252 is an attachment means for pivotally attaching moment arm 314 to a weight training machine 999. Weight 316 in this example comprises wheels 332 on both its top and bottom surfaces, which can provide for smoother and quieter rolling and less friction between weight 316 and the interior surfaces of moment arm 314. Alternatively, weight 316 can be provided with other devices and means for reducing friction, for quieting operation, and for increasing ease of movement.

FIG. 39 also illustrates an embodiment of cam 312. Generally, cam 312 is secured to moment arm 314 coaxially with the pivot axis of pivot point 322, and the rotation of cam 312 caused by the pulling of cam cable 326, as disclosed in more detail below, causes moment arm 314 to rotate about pivot point 322. The side of cam 312 that cooperates with cam cable 326 can have a groove 362 into which cam cable 326 can lie. Such a groove 362 can help direct and secure cam cable 326 during operation and can help prevent cam cable 326 from slipping off of cam 312.

FIG. 40 is a sectional side view of a weight 316 and weight adjusting drive 318 that can be used with the present invention. Weight 316 comprises an internal passage 352 extending therethrough from one side to an opposite side. In this embodiment, internal passage 352 is a smooth bore with no screw thread. The diameter of internal passage 352 is greater than the outer diameter of the screw thread 354 of weight adjusting drive 318 such that weight adjusting drive 318 can slide into and through internal passage 352. One or more threaded nuts 350 are inserted into internal passage 352 and secured by known means, such as, but not limited to, friction, adhesives, welding, soldering, clips, a flange that is part of the nut 350 itself and screwed into the weight 316, and the like. Weight adjusting drive 318, and particularly the screw thread 354 of weight adjusting drive 318 cooperates with the screw thread 356 of nut 350 such that when weight adjusting drive 318 is rotated, as disclosed herein, weight 316 will move relatively along weight adjusting drive 318.

FIGS. 41, 44 and 47 are views of representative weight training machines 999 focusing in on the operative relationship between the actuating means 1014 and the moment arm 314 in what is termed the resting mode. In this mode, the actuating means 1014 is in a resting position such that no or a minimal amount of weight or force is being transferred from moment arm 314 and weight 316 to main cable 302 to actuating means 1014. Although FIGS. 41, 44, and 47 show an open arm embodiment, this is for illustrative purposes only and to show the relative placement of the various elements of the invention.

FIGS. 42, 45, and 48 are views focusing in on the operative relationship between the actuating means 1014 and the moment arm 314 in what is termed the operating mode. In this mode, the actuating means 1014 is being moved in an operating manner by a user U, thus pulling on the main cable 302. Main cable 302 is pulled through pulleys 304 so as to direct or redirect main cable 302 from actuating means 1014 ultimately to moment arm weight resistance mechanism 300. As main cable 302 is pulled, this operates to rotate cam 312. Cam 312 is secured to pivot rod 252 coaxially with the pivot axis of pivot point 322, and the rotation of cam 312 caused by the pulling of main cable 302 or cam cable 326 causes moment arm 314, which also is secured to pivot rod 252, to rotate about pivot point 322. The rotation of moment arm 314 by the rotation of cam 312 causes moment arm 314 to rotate upwards into the operating position. Release of the actuating means 1014, has the opposite rotational effect.

In FIGS. 41-47, the configuration of main cable 302 and pulleys 304 from actuating means 1014 just prior to weight resistance mechanism 300 can be identical or similar to the configuration of cable and pulleys in known weight training machines, and the specific configuration of main cable 302 and pulleys 304 can be determined by those of ordinary skill in the art without undue experimentation for each type of weight training machine 999, such as those shown in FIGS. 44 and 47.

FIG. 41 is a side view of an eighth representative weight training machine 999 comprising an embodiment of a moment arm weight resistance mechanism 300 in the resting mode, that is, with the user U at rest. This weight training machine 999 is a leg extension quadriceps machine. Moment arm weight resistance mechanism 300 is pivotally attached to the back side of weight training machine 999 such that when activated, moment arm 314 can pivot or swing upwards and downwards without any or undue hindrance by any components of weight training machine 999. Pivot rod 252 is pivotally mounted on the frame 997 of weight training machine 999, such as on brackets 995. Brackets 995 can have bearings (not shown) to reduce friction and/or to better hold pivot rod 252. Stop 993 provides a place for moment arm 314 to rest or sit when not in use, and prevents moment arm 314 from traveling downward more than a suitable distance.

FIG. 41 illustrates an exemplary configuration of main cable 302 and pulleys 304 operatively connecting actuating device 1014 to moment arm weight resistance mechanism 300. Main cable 302 attaches to actuating device 1014, such as by bracket 993, and travels through or about frame 997 via pulleys 304, ultimately to moment arm weight resistance mechanism 300. Main cable 302 can travel through frame 997 for aesthetic and safety purposes. In the embodiment shown, pulley 304A is a class 2 movable pulley attached to a cam cable 302A, which is attached to cam 312. In this weight training machine 999, the moment arm weight resistance mechanism 300 is shown mounted pointed rearward.

FIG. 42 is a side view of the weight training machine 999 shown in FIG. 41 comprising an embodiment of the moment arm weight resistance mechanism 300 in the operating mode, that is, with the user U lifting weight. The user U sits on the seat 991 of weight training machine 999 in the known manner, with the user's legs contacting the actuating means 1014. Weight training machine 999 also has a backrest 989. When the user U actuates (moves, such as by lifting his or her lower legs so as to pivot) the actuating means 1014 upwards, main cable 302 is pulled with the ultimate result of pulling upwards on cam 312, thus rotating cam 312. As cam 312 is attached to moment arm 314, moment arm 314 also is rotated upwards, causing the moment about pivot point 322 and weight resistance against cable 302. By lifting and lowering actuating means 1014, the user U causes the upward and downward rotation of moment arm 314, and obtains a weight resistance workout.

FIG. 43 is a rear view of the weight training machine 999 shown in FIG. 41 comprising an embodiment of a moment arm weight resistance mechanism 300. This view better illustrates the structural relationship between moment arm 314, cam 312, pivot rod 252, and brackets 995. As this embodiment uses a class 2 movable pulley 304A, main cable 302 is anchored to frame 997 via anchor 310.

FIG. 44 is a side view of a ninth representative weight training machine 999 comprising an embodiment of a moment arm weight resistance mechanism 300 in the resting mode, that is, with the user U at rest. This weight training machine 999 is a latissimus dorsi pull-down machine. Similar to as disclosed in connection with FIG. 41, moment arm weight resistance mechanism 300 is pivotally attached to weight training machine 999 such that when activated, moment arm 314 can pivot or swing upwards and downwards without any or undue hindrance by any components of weight training machine 999. Pivot rod 252 is pivotally mounted on the frame 997 of weight training machine 999. In this weight training machine 999, the moment arm weight resistance mechanism 300 is shown mounted pointed frontward.

FIG. 45 is a side view of the weight training machine 999 shown in FIG. 44 comprising an embodiment of a moment arm weight resistance mechanism 300 in the operating mode, that is, with the user U lifting weight. Similar to as disclosed in connection with FIG. 42, the user U sits on the seat 991 of weight training machine 999 in the known manner, with the user gripping the actuating means 1014. When the user U actuates (moves) on the actuating means 1014, main cable 302 is pulled with the ultimate result of pulling upwards on cam 312, thus rotating cam 312. As cam 312 is attached to moment arm 314, moment arm 314 also is rotated upwards, causing the moment about pivot point 322 and weight resistance against cable 302. By pulling and releasing actuating means 1014, the user causes the upward and downward rotation of moment arm 314, and obtains a weight resistance workout.

FIG. 46 is a perspective view of a tenth representative weight training machine 999 comprising an embodiment of a moment arm weight resistance mechanism 300 in the resting mode, that is, with the user U at rest. This weight training machine 999 is a combination multi-station and multi-function combination weight training machine for exercising all major muscle groups. Similar to as disclosed in connection with FIG. 41, moment arm weight resistance mechanism 300 is pivotally attached to weight training machine 999 such that when activated, moment arm 314 can pivot or swing upwards and downwards without any or undue hindrance by any components of weight training machine 999. Pivot rod 252 is pivotally mounted on the frame 997 of weight training machine 999. In this weight training machine 999, the moment arm weight resistance mechanism 300 is shown mounted pointed sideward.

FIG. 47 is a perspective view of the weight training machine shown in FIG. 46 comprising an embodiment of a moment arm weight resistance mechanism in the operating mode, that is with the user U lifting weight. Similar to as disclosed in connection with FIG. 42, the user U sits on the seat 991 of weight training machine 999 in the known manner, with the user U gripping the actuating means 1014A, 1014B or with the user's legs contacting the actuating means 1014C. Weight training machine 999 also has a backrest 989. When the user U actuates (moves) the actuating means 1014A, 1014B, or when the user U lifts his or her legs so as to pivot the actuating means 1014C upwards, main cable 302 is pulled with the ultimate result of pulling upwards on cam 312, thus rotating cam 312. When the user U pulls down on the actuating means 1014, main cable 302 is pulled with the ultimate result of pulling upwards on cam 312, thus rotating cam 312. As cam 312 is attached to moment arm 314, moment arm 314 also is rotated upwards, causing the moment about pivot point 322 and weight resistance against cable 302. By pulling and releasing actuating means 1014, the user U causes the upward and downward rotation of moment arm 314, and obtains a weight resistance workout.

FIG. 48 is a side view of an embodiment of a cable 302 and pulley 304 configuration for a multi-function weight training machine 999 as shown in FIGS. 46 and 47, comprising an embodiment of a moment arm weight resistance mechanism 300. This configuration is known in the industry.

FIG. 49 is a top view of an alternate embodiment of a moment arm weight resistance mechanism 300. This embodiment of moment arm weight resistance mechanism 300 comprises cam 312, moment arm 314, weight 316, weight adjusting drive 318, weight adjusting means support 320, pivot point 322, and weight adjusting motor 324. Moment arm 314 is pivotally secured about pivot point 322 and extends generally normal to the pivot axis of pivot point 322. Thus, moment arm 314 acts as a cantilever extending from pivot point 322, and moment arm 314 can rotate about the pivot axis of pivot point 322. In this embodiment, moment arm 314 is a generally flat runway on which weight 316 can roll and can be termed an open arm embodiment.

FIG. 49 illustrates the weight adjusting motor 324 mounted to the side of the moment arm 314, such as on the moment arm pivot rod 252. Weight adjusting drive 318 is a cable, wire, chain, belt, or other flexible material extending around pulleys 320A, which act as the de facto weight adjusting drive supports. Weight 316 is attached to the wire of weight adjusting drive 318. Weight adjusting motor 324 turns one of the pulleys 320A, which causes the movement of the weight adjusting drive 318 about the pulleys 320A, thus moving the weight 316 along or relative to the moment arm 314 in either direction.

FIG. 50 is a side view of the alternate embodiment of the moment arm weight resistance mechanism 300 shown in FIG. 49.

FIG. 51 is a side view of another alternate embodiment of a moment arm mechanism 300 that can be used with the invention. This embodiment has the weight adjusting motor 324 located within a cart 334, and with weight 316 attached to the cart 334. Weight adjusting drive 318 again is a screw, but this time journaled between two weight adjusting drive supports 320 located on opposite ends of the moment arm 314. Weight adjusting motor 324 cooperates directly with weigh adjusting drive 318, such that when weight adjusting motor 324 is actuated, a threaded passage within weight adjusting motor 324 cooperates with the external screw thread of weight adjusting drive 318, and weight adjusting motor 324 moves along weight adjusting drive 318. Being in a cart 334 with wheels 332 allows weight adjusting motor 324 and attached weight 316 to move along or relative to moment arm 314.

FIG. 52 is a side view of another weight training machine 999 comprising an embodiment of a moment arm weight resistance mechanism 300 in the resting mode, that is, with the user U at rest. FIG. 52 is a leg extension machine 999 similar to that shown in FIG. 41, but with the cable 302 attached to a cable attachment means 400 rather than cooperating with a cam 312. This weight training machine 999 is a leg extension quadriceps machine. Moment arm weight resistance mechanism 300 is pivotally attached to the back side of weight training machine 999 such that when activated, weight resistance mechanism 300 and moment arm 314 can pivot or swing upwards and downwards without any or undue hindrance by any components of weight training machine 999. Pivot rod 252 is pivotally mounted on the frame 997 of weight training machine 999, such as on brackets 995. Brackets 995 can have bearings (not shown) to reduce friction and/or to better hold pivot rod 252. Stop 993 provides a place for weight resistance mechanism 300 to rest or sit when not in use, and prevents weight resistance mechanism 300 from traveling downward more than a suitable distance.

FIG. 52 illustrates an exemplary configuration of main cable 302 and pulleys 304 operatively connecting actuating device 14 to moment arm weight resistance mechanism 300. Main cable 302 attaches to actuating device 1014, such as by cable attachment means 400, and travels through or about frame 997 via pulleys 304, ultimately to moment arm weight resistance mechanism 300. Main cable 302 can travel through frame 997 for aesthetic and safety purposes. In the embodiment shown, cable 302 attaches to cable attachment means 400. In this weight training machine 999, the moment arm weight resistance mechanism 300 is shown mounted pointed rearward.

FIG. 53 is a side view of the weight training machine 999 shown in FIG. 52 comprising an embodiment of a moment arm weight resistance mechanism 300 in the operating mode, that is, when the user U is exercising on the weight training machine 999. The user U sits on the seat 991 of weight training machine 999 in the known manner, with the user's legs contacting the actuating means 1014. Weight training machine 999 also has a backrest 989. When the user U actuates (moves, such as by lifting his or her lower legs so as to pivot) the actuating means 1014 upwards, main cable 302 is pulled with the ultimate result of pulling upwards on cable attachment means 400, thus rotating weight resistance mechanism 300 upwards, causing the moment about pivot point 322 and weight resistance against cable 302. By lifting and lowering actuating means 1014, the user U causes the upward and downward rotation of weight resistance mechanism 300 and moment arm 314, and obtains a weight resistance workout.

FIG. 54 is a side view of another weight training machine 999 comprising an embodiment of a moment arm weight resistance mechanism 300 in the resting mode, that is, when the user U is at rest. FIG. 54 is a leg extension quadriceps machine 999 similar to that shown in FIG. 41, but with a bar linkage mechanism 430 rather than a cable 302 or a cam 312. Moment arm weight resistance mechanism 300 is pivotally attached to the back side of weight training machine 999 such that when activated, weight resistance mechanism 300 and moment arm 314 can pivot or swing upwards and downwards without any or undue hindrance by any components of weight training machine 999. Pivot rod 252 is pivotally mounted on the frame 997 of weight training machine 999, such as on brackets 995. Brackets 995 can have bearings (not shown) to reduce friction and/or to better hold pivot rod 252. Stop 993 provides a place for weight resistance mechanism 300 to rest or sit when not in use, and prevents weight resistance mechanism 300 from traveling downward more than a suitable distance.

FIG. 54 illustrates an exemplary configuration of bar linkage mechanism 430 operatively connecting actuating device 1014 to moment arm weight resistance mechanism 300. First bar 432 comprises two ends, a first of which is pivotally attached to actuating device 1014, such as by pivot point bracket 400A. First bar 432 is illustratively shown as a straight bar, but can be of other configurations. Second bar 434 comprises two ends and is pivotally attached at a central location to frame 997, such as by bearings 440 and/or journals 442. A first end of second bar 434 is pivotally attached to a second end of first bar 432, and a second end of second bar 434 is pivotally attached to a first end of third bar 436. Second bar 434 is illustratively shown as an L-shape with the vertex of the L pivotally attached to frame 997, but second bar 434 can be of other configurations. Third bar 436 comprises two ends, a first of which is pivotally attached to a second end of second bar 434 and a second of which is pivotally attached to a first end of fourth bar 438. Third bar 436 is illustratively shown as a straight bar, but can be of other configurations. Fourth bar 438 comprises two ends, a first of which is pivotally attached to a second end of third bar 436 and a second of which is rigidly attached to weight resistance mechanism 300. Alternatively, fourth bar 438 can be a structural extension of weight resistance mechanism 300 and not necessarily a separate component. In this weight training machine 999, the moment arm weight resistance mechanism 300 is shown mounted pointed rearward.

FIG. 55 is a side view of the weight training machine 999 shown in FIG. 54 comprising an embodiment of the moment arm weight resistance mechanism 300 in the operating mode, that is, when the user U is exercising on the machine 999. The user U sits on the seat 991 of weight training machine 999 in the known manner, with the user's legs contacting the actuating means 1014. Weight training machine 999 also has a backrest 989. When the user U actuates (moves, such as by lifting his or her lower legs so as to pivot) the actuating means 1014 upwards, first bar 432 is pulled forwards with the result of pulling and thus rotating second bar 434 about the central attachment to frame 997. As second bar 434 rotates, second bar 434 causes third bar 436 to move and to act on fourth bar 438 in a manner causing the rotation of fourth bar 438 and weight resistance mechanism 300 about pivot point 322, thus rotating weight resistance mechanism 300 and moment arm 314 upwards, causing the moment about pivot point 322 and weight resistance against and through bar linkage mechanism 430 to actuating means 1014 and therefore to user U. By lifting and lowering actuating means 1014, the user U causes the upward and downward rotation of weight resistance mechanism 300 and moment arm 314, and obtains a weight resistance workout. One alternative of this embodiment comprises a first bar 432 and a second bar 434 as disclosed, with weight resistance mechanism 300 attached directly and preferably rigidly to a second end of second bar 434. Second bar 434 may need to be mounted somewhat higher on frame 997 than shown in FIGS. 54 and 55 to allow sufficient clearance for weight resistance mechanism 300 to rotate upwards and downwards. The use of a greater or lesser number of linkage bars can be determined by one of ordinary skill in the art without undue experimentation.

FIG. 56 is a side view of another weight training machine 999 comprising an embodiment of a moment arm weight resistance mechanism 300 in the resting mode, that is, when the user U is at rest. FIG. 56 is a combination leg extension quadriceps and torso rotational crunch machine. This embodiment further comprises an additional bar linkage mechanism 430A comprising a fifth bar 444, the fifth bar 444 comprising two ends, a first of which is pivotally attached to frame 997, preferably proximal to upper torso pad 987, such as by pivot point bracket 400A, and a second of which is pivotally attached to a second end of fourth bar 438. Fifth bar 444 is illustratively shown as a straight bar, but can be of other configurations. In this embodiment, fourth bar 438 comprises two ends, a first of which is pivotally attached to a second end of third bar 436 and a second of which is pivotally attached to a second end of fifth bar 444. In this embodiment, a central portion of fourth bar 438 is rigidly attached to weight resistance mechanism 300. Alternatively, fourth bar 438 can be a structural extension of weight resistance mechanism 300 and not necessarily a separate component. In this weight training machine 999, the moment arm weight resistance mechanism 300 is shown mounted pointed rearward.

FIG. 57 is a side view of the weight training machine 999 shown in FIG. 56 comprising an embodiment of a moment arm weight resistance mechanism 300 in the operating mode, that is, when the user U is exercising on the machine 999. To use as a leg extension quadriceps machine, the user U operates the machine as disclosed in connection with FIGS. 55 and 56. To use as a torso rotational crunch machine, the user U sits on the seat 991 of weight training machine 999 in the known manner, preferably with the user U leaning against upper torso pad 987 and backrest 989, and with the user's hands grasping the actuating means 1014C. When the user U actuates (moves, such as by pulling his or her arms so as to pivot) the actuating means 1014 forwards and downwards, fifth bar 444 is pulled and rotated forwards with the result of acting on fourth bar 438 in a manner causing the rotation of fourth bar 438 and weight resistance mechanism 300 about pivot point 322, thus rotating weight resistance mechanism 300 and moment arm 314 upwards, causing the moment about pivot point 322 and weight resistance against and through additional bar linkage mechanism 430A to actuating means 1014C and therefore to user U. By pulling and releasing actuating means 1014C, the user U causes the upward and downward rotation of weight resistance mechanism 300 and moment arm 314, and obtains a weight resistance workout. To use as a simultaneous combination leg extension quadriceps machine and torso rotational crunch machine, the user U operates the machine as disclosed in connection with both FIGS. 54 and 55 and with FIGS. 56 and 57 by actuating both actuating means 1014 with the legs and actuating means 1014C with the arms simultaneously. The use of a greater or lesser number of linkage bars can be determined by one of ordinary skill in the art without undue experimentation.

FIG. 58 is a side view of another weight training machine 999 comprising an embodiment of a moment arm weight resistance mechanism 300 in the resting mode, that is, when the user U is at rest. FIG. 58 is a combination lower back and triceps press machine with a bar linkage mechanism 430 rather than a cable 302 or a cam 312. FIG. 58 illustrates an exemplary configuration of bar linkage mechanism 430 operatively connecting frame 997, which serves as actuating device 1014 in this embodiment, to moment arm weight resistance mechanism 300. First bar 462 comprises two ends, a first of which is pivotally attached to frame 997, such as by bracket 995, proximal to backrest 989. First bar 462 is illustratively shown as a straight bar, but can be of other configurations. Second bar 464 comprises two ends, a first of which is pivotally attached to a second end of first bar 462 and a second of which is rigidly attached to weight resistance mechanism 300 at the pivot point 322. Alternatively, second bar 464 can be a structural extension of weight resistance mechanism 300 and not necessarily a separate component, whereby second bar 464 and weight resistance mechanism 300 can be structured in and act in the manner of a lever. In this weight training machine 999, the moment arm weight resistance mechanism 300 is shown mounted pointed rearward.

FIG. 58 illustrates moment arm weight resistance mechanism 300 pivotally attached to the back side of weight training machine 999 via second bar 464 such that when activated, weight resistance mechanism 300 and moment arm 314 can pivot or swing upwards and downwards without any or undue hindrance by any components of weight training machine 999. Pivot rod 252 is pivotally mounted on or through the frame 997 of weight training machine 999 so as to pivotally connect second arm 464 to frame 997. Bearings (not shown) can be used to reduce friction and/or to better hold pivot rod 252. Stop 993 provides a place for weight resistance mechanism 300 to rest or sit when not in use, and prevents weight resistance mechanism 300 from traveling downward more than a suitable distance.

FIG. 58 also illustrates two different embodiments of the invention, an embodiment where extensions 983 rigidly attached to frame 997 and an embodiment where extensions 983 are rigidly attached to weight resistance mechanism 300 and pivotally attached to frame 997. In the first mentioned embodiment, handles 985 are primarily for grasping and pushing against, so as to provide a base for pushing against backrest 989. In the second mentioned embodiment, handles 985 also allow for an additional means for lifting weight resistance mechanism 300 and an additional exercise for the arms.

FIG. 59 is a side view of the weight training machine 999 shown in FIG. 58 comprising an embodiment of a moment arm weight resistance mechanism 300 in the operating mode, that is, when the user U is exercising on the machine 999. The user U sits on the seat 991 of weight training machine 999 in the known manner, with the user's hands contacting the handles 985. When the user U actuates (moves, such as by pushing backwards against backrest 989 so as to pivot) the backrest 989 backwards, first bar 462 is pushed backwards and downwards with the result of pushing and thus rotating second bar 464 about the central attachment to frame 997. As second bar 464 rotates, weight resistance mechanism 300 pivots about pivot point 322, thus rotating weight resistance mechanism 300 and moment arm 314 upwards, causing the moment about pivot point 322 and weight resistance against and through bar linkage mechanism 430 to backrest 989 and therefore to the user U. By pushing against and releasing backrest 989, the user U causes the upward and downward rotation of weight resistance mechanism 300 and moment arm 314, and obtains a weight resistance workout. The use of a greater or lesser number of linkage bars can be determined by one of ordinary skill in the art without undue experimentation.

FIG. 59 also illustrates embodiments of handles 985. In a first handle embodiment, handles 985 are rigidly attached to frame 997 via extensions 983. In this first handle embodiment, handles 985 are primarily for grasping and pushing against, so as to provide a base for pushing against backrest 989. In a second handle embodiment, handles are pivotally attached to frame 997 at pivot point 322 and are rigidly attached to weight resistance mechanism 300. In this second handle embodiment, handles 985 also allow for an additional means for lifting weight resistance mechanism 300 and an additional exercise for the arms. In this second handle embodiment, extensions 983 and second bar 464 pivot together and both about pivot point 322 as both are rigidly attached to weigh resistance mechanism 300.

FIG. 60 is a first perspective view of an alternate embodiment of a moment arm weight resistance mechanism 300 showing basic working elements. This embodiment of moment arm weight resistance mechanism 300 comprises moment arm 314, weight 316, weight adjusting drive 318, pivot point 322, weight adjusting motor 324, and cable attachment means 400. Weight resistance mechanism 300 is pivotally secured about pivot point 322, about which the moment is created, and extends generally normal to the pivot axis of pivot point 322. Thus, weight resistance mechanism 300 in general and moment arm 314 in particular acts as a cantilever extending from pivot point 322, and weight resistance mechanism 300, including moment arm 314 and other components of weight resistance mechanism 300, can rotate about the pivot axis of pivot point 322. Weight resistance mechanism 300 is pivotally attached to a bracket 406 that is attached to the frame of the weight training machine 999. In this embodiment, moment arm 314 is a generally rod-like structure on which weight 316 can slide and can be termed an open arm embodiment.

FIG. 60 also illustrates that, in this embodiment, moment arm 314 is a generally solid, elongated, rod-like structure. Weight adjusting drive 318 is located below and parallel to moment arm 314, both being attached to supports 408, 410. Weight 316 is slidably mounted on moment arm 314 and drivably mounted on weight adjusting drive 318. Weight adjusting motor 324 is shown mounted on support 408 and operatively connected to weight adjusting drive via gear box 412. Moment arm 314 is illustratively shown as being rigidly connected to supports 408, 410, but moment arm 314 can be secured to supports 408, 410 by any known or suitable means. Similarly, weight adjusting drive 318 is illustratively shown as being rotationally connected to supports 408, 410.

FIG. 60 illustrates that weight 316, or a portion or component of weight 316, comprises an internal passage 352 comprising a screw thread 354. The structure of the internal passage 352 and associated components 350, 354, 356 can be the same as that disclosed in connection with FIG. 40, or internal passage 352 can simply comprise a hole with screw thread 356 about the diameter of the hole. In this embodiment of weight 316, weight 316 comprises an additional internal passage 402 through which moment arm 314 passes, and which supports moment arm 314. The diameter of additional internal passage 402 is greater than the outer diameter of the moment arm 314 such that weight 316 can slide over moment arm 314. One or more bearings 404, such as for example low-friction material washers or roller bearings, are inserted into additional internal passage 402 and secured by known means to allow weight 316 to slide more easily on moment arm 314. Weight adjusting drive 318, and particularly the screw thread 354 of weight adjusting drive 318 cooperates with the screw thread 356 of weight 316 such that when weight adjusting drive 318 is rotated, as disclosed herein, weight 316 will move relatively along weight adjusting drive 318.

FIG. 60 illustrates weight adjusting drive 318 as a screw journaled to support 410 and operatively connected to gear box 412 at support 408, with supports 408, 410 being located on opposite ends of the moment arm 314. Weight adjusting motor 324 cooperates directly with weigh adjusting drive 318 via gear box 412, such that when weight adjusting motor 324 is actuated, weight adjusting drive 318 is rotated via gearing in gear box 412. Thus, depending on the direction of motion of weight adjusting motor 324, weight adjusting drive 318 will rotate in one direction or the other, thus causing weight 316 to move in one direction or the other along weight adjusting drive 318 and moment arm 314. As weight 316 moves away from pivot point 322, the moment increases, thus increasing the relative weight applied to the user U.

FIG. 61 is a second perspective view of the alternate embodiment of the moment arm weight resistance mechanism 300 shown in FIG. 60. The structural relationship of pivot point 322 can be seen in better detail in this view. The structure of an illustrative embodiment of weight 316 also can be seen in better detail in this view. Weight 316 can comprise a single mass or can comprise two or more plates 316A, 316B. In this view, weight 316 comprises one drive plate 316A and several non-drive plates 316B. Drive plate 316A can comprise additional internal passage 402 and thread 356 to cooperate with weight adjusting drive 318, while non-drive plates 316B can be shaped so as to not cooperate or even contact weight adjusting drive 318. In this multi-plate configuration, weight 316 can be adjusted to have more or less mass as desired.

Although moment arm 314 is shown on the back of the weight training machine 999 and extending either backward, frontward, or from side to side in several of the illustrative examples, the location of moment arm weight resistance mechanism 300 can be changed depending on the desired footprint, function, and/or aesthetics of the weight training machine 999 with relocation of the various operating components, such as cable 302, pulleys 304, and linkages 432, 434, 436, 438, 444, 462, 464.

In the closed arm embodiment illustrated in FIG. 39, moment arm weight resistance mechanism 300 illustratively comprises cam 312, moment arm 314, weight 316, weight adjusting drive 318, pivot point 322 (corresponding to the end of the moment arm pivot rod 252), and weight adjusting motor 324. In this embodiment, moment arm 314 can be an elongated hollow box-like structure containing weight 316, weight adjusting drive 318, and weight adjusting motor 324. This embodiment is more self-contained than the open arm embodiment disclosed herein and can help prevent outside interference with the movement of weight 316 and the operation of weight adjusting drive 318 and weight adjusting motor 324.

In the closed arm embodiment, weight adjusting drive 318 is operatively connected to weight adjusting motor 324 and to weight 316 and can be used to transfer the motion generated by weight adjusting motor 324 to weight 316 and move weight along moment arm 314. In the illustrative examples shown, weight adjusting drive 318 is a linear screw attached at one end to weight adjusting motor 324 and is free-floating at another end. Weight adjusting motor 324, in this example, turns weight adjusting device 318, which in turn cooperates with a complimentary internal threaded passage or a combination of an internal passage 352 and threaded nut 350, on weight 316 so as to move weight 316 back and forth along moment arm 314. Weight adjusting drive 318 is located generally parallel with and slightly offset from moment arm 314.

In the open arm embodiment illustrated in FIG. 41, moment arm weight resistance mechanism 300 illustratively comprises cam 312, moment arm 314, weight 316, weight adjusting drive 318, weight adjusting means support 320, pivot point 322 (corresponding to the axis of the moment arm pivot rod 252), and weight adjusting motor 324. In this embodiment, moment arm 314 can be a rod or tube, hollow or solid, having a rectangular cross-section, or at least a flat upper surface 328. Alternatively, moment arm 314 can have an I-beam structure, be a flat planar structure, or any equivalent structure that can support weight 316, allow the operative attachment of weight adjusting drive 318 to weight 316, and provide for attachment to moment arm pivot rod 252.

In this open arm embodiment, weight adjusting drive 318 is operatively connected to weight adjusting motor 324 and to weight 316 and can be used to transfer the motion generated by weight adjusting motor 324 to weight 316 and move weight along moment arm 314. In the illustrative example shown, weight adjusting drive 318 is a linear screw attached at one end to weight adjusting motor 324 and attached at another end to weight adjusting drive support 320. Specifically, weight adjusting drive support 320 is journaled into weight adjusting drive support 320 via a bearing, a low friction device, or the equivalent. Weight adjusting motor 324, in this example, turns weight adjusting device 318, which in turn cooperates with a complimentary internal threaded passage on weight 316 or a combination of an internal passage 352 and threaded nut 350, so as to move weight 316 back and forth along moment arm 314. Weight adjusting drive 318 is located generally parallel with and slightly offset from moment arm 314.

In the open arm embodiment illustrated in FIGS. 60 and 61, moment arm weight resistance mechanism 300 illustratively comprises cable attachment means 400, moment arm 314, weight 316, weight adjusting drive 318, weight adjusting means support 320, pivot point 322 (corresponding to the axis of the moment arm pivot rod 252), and weight adjusting motor 324. In this embodiment, moment arm 314 can be a rod, hollow or solid, having any cross-section that can be made to slide through additional internal passage 402.

In this open arm embodiment, weight adjusting drive 318 is operatively connected to weight adjusting motor 324 via gear box 412 and to weight 316 via threads 354, 356 and can be used to transfer the motion generated by weight adjusting motor 324 to weight 316 and move weight 316 along moment arm 314. In the illustrative example shown, weight adjusting drive 318 is a linear screw pivotally attached at one end to supports 410, and at the other end to gear box 412. Weight adjusting motor 324, in this example, turns weight adjusting device 318 via gear box 412, which in turn cooperates with a complimentary internal threaded passage 352 on weight 316 or a combination of an internal passage 352 and threaded nut 350 or a thread 356, so as to move weight 316 back and forth along moment arm 314. Weight adjusting drive 318 is located generally parallel with and slightly offset from moment arm 314.

Weight adjusting motor 324 can be a bidirectional electric motor secured on the upper surface of moment arm 314 or on the weight resistance mechanism 300. Preferably, weight adjusting motor 324 is located proximal to the pivot point 322 as weight adjusting motor 324 does have some weight and, if located on the free end 330 of moment arm 314, would impart a certain amount of weight to moment arm 314 creating an increased base moment about pivot point 322. Weight adjusting motor 324 can be selected to move weight 316 relative to or along moment arm 314 away from or towards pivot point 322, and therefore must be of sufficient power to accomplish this task. Alternatively, weight adjusting motor 324 can be mounted outside of moment arm 314 and a hole can be located on the end of moment arm 314 to allow weight adjusting drive to extend therethrough and into the interior of moment arm 314 to cooperate with weight 316.

Weight 316 can be any structure having mass. In one illustrative example shown, weight 316 is a solid mass having an internal threaded passage extending from a first side to an opposite second side or a combination of an internal passage 352 and threaded nut 350. Internal threaded passage or nut 350 cooperates with the screw thread on weight adjusting drive such that when weight adjusting drive is turned or rotated by weight adjusting motor 324, weight 316 is forced to move linearly. Weight 316 can comprise optional wheels 332 on the bottom and optionally on the top that cooperate with moment arm 314 to allow the easier movement of weight 316 along moment arm 314. Thus, as weight adjusting motor 324 turns weight adjusting drive 318, the complimentary screw threads cooperate and force weight 316 to move linearly along or relative to moment arm 314. In another illustrative example shown, weight 316 comprises plates 316A, 316B, with at least one plate 316 being a driven plate 316A having a thread 356 for cooperating with weight adjusting drive 318.

Weight 316 causes a moment about pivot point 322, thus urging a rotation of moment arm pivot rod 252 about its axis. In one embodiment, as moment arm pivot rod 252 is rotationally urged, cam 312 also is rotationally urged in the same direction, thus acting on cam cable 326 by pulling main cable 302 downward or at least imparting a downward tensional force on main cable 302. The tensional force on main cable 302 is imparted to actuating means 1014, which imparts a pulling force or weight resistance on the user U grasping the actuating means 1014. In another embodiment, moment arm 314 imparts weight directly to cable 302 via cable attachment means 400, thus pulling main cable 302 downward or at least imparting a downward tensional force on main cable 302. The tensional force on main cable 302 is imparted to actuating means 1014, which imparts a pulling force or weight resistance on the user U grasping the actuating means 1014. In yet another embodiment, moment arm 314 imparts weight directly to bar linkages 432, 434, 436, 438, 444, 462, 464, thus imparting a force to actuating means 1014, which imparts a pulling or pushing force or weight resistance on the user U grasping the actuating means 1014 (which can be frame 997 or backrest 989 in certain embodiments), and imparting a rotational force on actuating arm 983 and handle 985.

The amount or level of force or weight resistance can be adjusted by moving the weight 316 along the moment arm 314. If the weight 316 is proximal to the pivot point 322, then the moment created by the weight 316 is minimal and therefore the amount or level of force or weight resistance imparted to the user U is minimized. If the weight 316 is distal to the pivot point, then the moment created by the weight 316 is maximized and therefore the amount or level of force or weight resistance imparted to the user U is maximized. Conventional controls operate the weight adjusting motor 324 so as to move the weight 316 to the desired position along the moment arm 314 for imparting the desired amount or level of force or weight resistance to the user U as the user U pulls or pushes on the actuating means 1014. Alternatively, weight 316 can be moved manually by the user U.

Main cable 302 and cam cable 326 can be of any structure, such as a rope, a chain, a belt, monofilaments, braided wires, flexible materials, and other suitable equivalents, that allow a transfer of force between actuating means 1014 and moment arm weight resistance mechanism 300, and is not limited to a standard cable. As disclosed herein, main cable 302 can be directed around one or more pulleys 304 to direct or redirect main cable 302 between the actuating means 1014 and the moment arm weight resistance mechanism 300, and to prevent main cable 302 from becoming entangled in the internal mechanical components of weight training machine 999. Thus, in operation, when user pulls or moves actuating means 1014, this force transfers to main cable 302, which in turn acts on moment arm weight resistance mechanism 300 by lifting moment arm 314, thus creating the moment due to the weight of the weight 316 (and the moment arm itself, as well as any components on or attached to the moment arm 314). Alternatively, main cable 302 can be connected directed to cam 312 without the need for cam cable 326.

Pulleys 304 can be fixed class 1 pulleys that are mounted on a frame of the weight training machine 999 to direct and redirect the force of main cable 302 and do not move, except to rotate as main cable 302 moves over them. Alternatively, one or more of pulleys 304 can be a movable class 2 pulley to transform the force of main cable 302 to cam 312. Although all pulleys 304 can be fixed pulleys or movable pulleys, or a combination of fixed and movable pulleys, depending on the relative force needed to operate the moment arm weight resistance mechanism 300, the combination of fixed and movable pulleys provides a suitable transformation of the user's U energy to the actuation of the moment arm weight resistance mechanism 300.

Bar linkages 432, 434, 436, 438, 444, 462, 464 can be of any rigid structure, such as a bar, rod, or tube, and other suitable equivalents, that allow a transfer of force between actuating means 1014 and moment arm weight resistance mechanism 300, and is not limited to a standard bar.

The degree of weight resistance can be controlled by user U. At settings in which weight 316 is creating a moment on moment arm 314 about pivot point 322, user would be subject to weight resistance and the exercise regimen would be similar to conventional electronic, stack or free weight exercise machines, for example. The higher the setting of the moment arm weight resistance mechanism 300 (that is, with weight 316 further from pivot point 322), the heavier the weight resistance. With this arrangement, it is therefore possible to vary the weight resistance during the exercise regimen.

A comparison of the position of actuating means 1014 shows how actuating means 1014 can move. Actuating means 1014 is shown in the at rest position in FIGS. 41, 44, 47, 51, 53, 55, and 57 and in the operational position (partially extended) in FIGS. 42, 45, 48, 52, 54, 56, and 58. Actuating means 1014 can move between the at rest position and a fully extended position, and the position of actuating means 1014 during operation is dependent on user U. Optional stops (not shown) can prevent actuating means 1014 from moving past the at rest position in one direction of motion and the fully extended position in the opposite direction of motion.

Various other features and elements can be included in the weight training machine 999 to compliment the moment arm weight resistance mechanism 300. For example, the moment arm weight resistance mechanism 300 can be enclosed in a structure attached to or supported by frame 997 for aesthetic and safety purposes. A second stop can be attached to frame 997 to stop the upward motion of the moment arm 314 so as to prevent over extension. Locks or stops, adjustable or otherwise, also can be added to lock the moment arm in the resting position or at any desired operating position or to limit the range of motion.

FIGS. 62 and 63 are side views of the weight training machine as shown in FIG. 56 comprising a weight stack weight resistance mechanism as an alternate embodiment. In this embodiment, one end of cable 108 is attached to an end of fifth bar 444. Another end of cable 108 connects to weight stack 106. When the user U actuates (moves, such as by pulling his or her arms or by lifting his or her legs so as to pivot) the actuating means 1014C forwards and downwards, or the actuating means 1014 forwards and upwards, fifth bar 444 is pulled and rotated forwards with the result of acting on cable 108, thus pulling on cable 108. Cable 108 travels through pulleys 114, 116, 118 to weight stack 106, thus lifting weights 112 and creating weight resistance against and through additional bar linkage mechanism 430 to actuating means 1014, 1014C and therefore to user U. By pulling and releasing actuating means 1014C, or by lifting and lowering actuating means 1014, the user U causes the upward and downward movement of weights 112, and obtains a weight resistance workout. To use as a simultaneous combination leg extension quadriceps machine and torso rotational crunch machine, the user U operates the machine as disclosed in connection with both FIGS. 54 and 55 and with FIGS. 56 and 57 by actuating both actuating means 1014 with the legs and actuating means 1014C with the arms. The use of a greater or lesser number of linkage bars can be determined by one of ordinary skill in the art without undue experimentation. FIG. 62 is the machine in the resting mode and FIG. 63 is the machine in the operating mode.

Thus in a preferred general embodiment, the present invention is a weight training machine for allowing a user to operate at least two actuating members simultaneously that impart force to at least two separate muscle groups of the user's body in a synchronized and unified fashion, comprising:

a) at least one common counter or weight resistance mechanism;

b) a first actuating means operatively connected to the at least one common counter or weight resistance mechanism for allowing actuation of the at least one common counter or weight resistance mechanism by a first muscle group of the user's body; and c) a second actuating means operatively connected to the at least one common counter or weight resistance mechanism for allowing actuation of the at least one common counter or weight resistance mechanism by a second muscle group of the user's body, wherein actuation of both the first actuating means and the second actuation means simultaneously acts upon and or resists against the at least one common counter or weight resistance mechanism.

In a preferred general embodiment, the first actuating means and the second actuating means are operatively connected to each other such that actuation of the first actuating means actuates the second actuating means, and actuation of the second actuating means actuates the first actuating means. Thus, if the user acts upon the first actuating means by moving it in its intended first direction without acting on the second actuating means, the second actuating means moves independently in its first intended direction, or when the user acts upon the second actuating means by moving it in its intended first direction without acting on the first actuating means, the first actuating means moves independently in its first intended direction. Similarly, if the user acts upon the first actuating means by moving it in its intended second direction without acting on the second actuating means, the second actuating means moves independently in its second intended direction, or when the user acts upon the second actuating means by moving it in its intended second direction without acting on the first actuating means, the first actuating means moves independently in its second intended direction.

While the invention has been described in connection with certain preferred embodiments, it is not intended to limit the spirit or scope of the invention to the particular forms set forth, but is intended to cover such alternatives, modifications, and equivalents as may be included within the true spirit and scope of the invention as defined by the appended claims.

What is claimed is:

1. A weight training machine for allowing a user to simultaneously operate at least two separate actuating means to impart force or weight resistance to at least two separate muscle groups of the user's body in a synchronized and unified fashion, comprising:

a) at least one common counter or weight resistance mechanism operatively connected to a common axle;

b) a first actuating means operatively connected to the common axle for allowing actuation of the at least one common counter or weight resistance mechanism by a first muscle group of the user's body; and c) a second actuating means operatively connected to the common axle for allowing actuation of the at least one common counter or weight resistance mechanism by a second muscle group of the user's body, wherein actuation of both the first actuating means and the second actuation means simultaneously acts upon and or resists against the at least one common counter or weight resistance mechanism.

2. The weight training machine as claimed in claim 1, wherein the at least two actuating means are movable between a first at rest position and a second fully extended position and can be maintained at any position between the first at rest position and the second fully extended position.

3. The weight training machine as claimed in claim 1, wherein the at least two actuating means are operatively connected to the at least one common counter or weight resistance mechanism, wherein moving at least one of the at least two actuating means actuates the at least one common counter or weight resistance mechanism.

4. The weight training machine as claimed in claim 3, wherein moving the at least two actuating means actuates the at least one common counter or weight resistance mechanism.

5. The weight training machine as claimed in claim 3, wherein each of the at least two actuating means is actuated by different exercise motions.

6. The weight training machine as claimed in claim 1, wherein the first actuating means and the second actuating means are operatively connected to each other such that actuation of the first actuating means actuates the second actuating means, and actuation of the second actuating means actuates the first actuating means.

7. The weight training machine as claimed in claim 1, wherein the at least one common counter or weight resistance mechanism comprises a weight stack.

8. The weight training machine as claimed in claim 1, wherein the at least one common counter or weight resistance mechanism comprises weight plates.

9. The weight training machine as claimed in claim 1, wherein the at least one common counter or weight resistance mechanism comprises a spring.

10. The weight training machine as claimed in claim 1, wherein the at least one common counter or weight resistance mechanism comprises a hydraulic or pneumatic piston.

11. The weight training machine as claimed in claim 1, wherein the at least one common counter or weight resistance mechanism is a moment arm weight resistance mechanism comprising:

a) a frame;

b) a cantilevered moment arm pivotally attached to the frame at a pivot point;

c) an adjustable weight attached to the moment arm; and d) a weight adjusting drive for adjusting the adjustable weight along the moment arm, wherein the weight on the moment arm creates a moment about the pivot point, wherein the degree of weight resistance can be controlled by a user by movement of the adjustable weight along the moment arm, and wherein the moment arm weight resistance mechanism is variable for providing increased or decreased amounts of weight resistance and can be varied by a user during an exercise motion.

12. The weight training machine as claimed in claim 11, further comprising a cam, wherein:

a) the cam is secured to the moment arm coaxially with the pivot point;

b) the actuating means is operatively connected to the moment arm weight resistance mechanism via the cam; and c) moving the actuating means causes the pivoting of the cam about the pivot point thereby actuating the moment arm weight resistance mechanism.

13. The weight training machine as claimed in claim 11, further comprising a cable attachment means, wherein:

a) the cable attachment means is secured on an end of the moment arm distal from the pivot point;

b) the actuating means is operatively connected to the moment arm weight resistance mechanism via the cable attachment means; and c) moving the actuating means causes the pivoting of the moment arm about the pivot point thereby actuating the moment arm weight resistance mechanism.

14. The weight training machine as claimed in claim 11, further comprising a bar linkage mechanism, wherein:

a) the actuating means is operatively connected to the moment arm weight resistance mechanism via the bar linkage mechanism; and b) moving the actuating means causes the pivoting of the moment arm about the pivot point thereby actuating the moment arm weight resistance mechanism.

15. The weight training machine as claimed in claim 11, further comprising a direct connection between the actuating means and the moment arm weight resistance mechanism, wherein:

a) the actuating means is rigidly connected to the moment arm weight resistance mechanism; and b) moving the actuating means causes the pivoting of the moment arm about the pivot point thereby actuating the moment arm weight resistance mechanism.

16. The weight training machine as claimed in claim 11, wherein the adjustable weight and the weight adjusting drive are supported on the moment arm weight resistance mechanism and the weight adjusting drive is operatively attached to the adjustable weight.

17. The weight training machine as claimed in claim 11, wherein the actuating means is operatively connected to the moment arm weight resistance mechanism proximal to the pivot point.

18. The weight training machine as claimed in claim 11, wherein the actuating means is operatively connected to the moment arm weight resistance mechanism distal from the pivot point.

19. The weight training machine as claimed in claim 1, wherein the actuating means cooperate with each other in a synchronized and unified manner whereby simultaneous actuation of either of the actuating means by two of the at least two separate muscle groups will concurrently cause the actuation of the other of the actuating means and movement of the common axle and the at least one common or counter weight resistance mechanism.

20. The weight training machine as claimed in claim 19, wherein the first actuating means allows a user to engage the first muscle group and the second actuating means allows a user to engage the second muscle group simultaneously against the common axle and the at least one common counter or weight resistance means.

21. The weight training machine as claimed in claim 20, wherein the first muscle group is located on a user's upper extremities and the second muscle group is located on a user's lower extremities.

22. The weight training machine as claimed in claim 20, wherein the first muscle group is located on a user's upper extremities and the second muscle group is located on a user's torso.

23. The weight training machine as claimed in claim 20, wherein the first muscle group is located on a user's lower extremities and the second muscle group is located on a user's torso.

24. The weight training machine as claimed in claim 20, wherein the first muscle group is located on a user's upper extremities and the second muscle group is located on a user's buttocks.

25. The weight training machine as claimed in claim 20, wherein at least one of the actuating means is operatively connected to the common axle and to the at least one common counter or weight resistance mechanism via a pivoting rigid levers mechanism comprising at least two pivoting rigid levers.

26. The weight training machine as claimed in claim 20, wherein at least one of the actuating means is directly and rigidly connected to the common axle and to the at least one common counter or weight resistance mechanism.

27. The weight training machine as claimed in claim 26, wherein movement of any of the actuating means engages the at least one common counter or weight resistance mechanism.

28. The weight training machine as claimed in claim 1, wherein at least one of the actuating means is operatively connected to the common axle and to the at least one common counter or weight resistance mechanism via a flexible member.

29. The weight training machine as claimed in claim 28, wherein movement of any of the actuating means engages the at least one common counter or weight resistance mechanism.

30. The weight training machine as claimed in claim 1, wherein the common axle is rigidly connected to the at least one common counter or weight resistance mechanism.

31. The weight training machine as claimed in claim 2, wherein the at rest starting position of at least one of the actuating means is adjustable to accommodate a user's size and preference for range of motion.

* * * * *